US010378252B2

(12) United States Patent
Ottino et al.

(10) Patent No.: US 10,378,252 B2
(45) Date of Patent: Aug. 13, 2019

(54) DUAL MOTOR LATCH ASSEMBLY WITH POWER CINCH AND POWER RELEASE HAVING SOFT OPENING FUNCTION

(71) Applicant: Magna Closures S.p.A., Guasticce (Leghorn) (IT)

(72) Inventors: Franco Giovanni Ottino, S. Giuliano Terme (IT); Francesco Cumbo, Pisa (IT); Marco Taurasi, Leghorn (IT); Enrico Margheritti, Lucca (IT)

(73) Assignee: MAGNA CLOSURES S.P.A., Guasticce (Leghorn) (IT)

( * ) Notice: Subject to any disclaimer, the term of this patent is extended or adjusted under 35 U.S.C. 154(b) by 711 days.

(21) Appl. No.: 15/050,692

(22) Filed: Feb. 23, 2016

(65) Prior Publication Data

US 2016/0244999 A1 Aug. 25, 2016

Related U.S. Application Data

(60) Provisional application No. 62/120,451, filed on Feb. 25, 2015, provisional application No. 62/157,088, filed on May 5, 2015.

(51) Int. Cl.

| | |
|---|---|
| ***E05B 81/20*** | (2014.01) |
| ***E05B 81/06*** | (2014.01) |
| ***E05B 85/26*** | (2014.01) |
| ***E05B 85/24*** | (2014.01) |
| ***E05B 81/68*** | (2014.01) |
| ***E05B 81/18*** | (2014.01) |
| *E05B 77/36* | (2014.01) |
| *E05B 81/16* | (2014.01) |

(52) U.S. Cl.

CPC ..... *E05B 81/20* (2013.01); *E05B 81/06* (2013.01); *E05B 81/18* (2013.01); *E05B 81/68* (2013.01); *E05B 85/243* (2013.01); *E05B 85/26* (2013.01); *E05B 77/36* (2013.01); *E05B 81/16* (2013.01)

(58) Field of Classification Search

CPC ..... E05B 81/06; E05B 81/16; E05B 81/18; E05B 81/20; E05B 77/36

USPC ..... 292/201, 216

See application file for complete search history.

(56) References Cited

U.S. PATENT DOCUMENTS

| | | | | |
|---|---|---|---|---|
| 5,288,115 A * | 2/1994 | Inoue | E05B 81/20 | 292/201 |
| 5,918,917 A * | 7/1999 | Elton | E05B 81/20 | 292/201 |
| 6,053,542 A * | 4/2000 | Ostrowski | E05B 81/20 | 292/201 |
| 6,123,372 A * | 9/2000 | Rogers, Jr. | E05B 81/20 | 292/201 |

(Continued)

FOREIGN PATENT DOCUMENTS

| | | |
|---|---|---|
| EP | 0978609 A1 | 2/2000 |
| EP | 1176273 A2 | 1/2002 |

*Primary Examiner* — Carlos Lugo
(74) *Attorney, Agent, or Firm* — Dickinson Wright PLLC

(57) ABSTRACT

A two-motor power latch assembly for a motor vehicle closure system configured to provide a power cinching feature and a power release feature. The power cinching feature is configured to retain the ratchet in a cinched striker capture position with the pawl disengaged from the ratchet. The power release feature is configured to move the ratchet from its cinched striker capture position to a cinch release striker capture position for unloading the seals prior to release of the ratchet to its striker release position.

20 Claims, 63 Drawing Sheets

(56) References Cited

U.S. PATENT DOCUMENTS

| | | | | |
|---|---|---|---|---|
| 6,341,448 | B1 | 1/2002 | Murray et al. | |
| 6,550,825 | B2 | 4/2003 | Ostrowski et al. | |
| 6,719,333 | B2 * | 4/2004 | Rice | E05B 81/14 292/201 |
| 6,848,727 | B1 | 2/2005 | Cetnar et al. | |
| 7,261,334 | B2 | 8/2007 | Oberheide et al. | |
| 7,827,836 | B2 | 11/2010 | Cetnar | |
| 8,336,929 | B2 | 12/2012 | Halliwell | |
| 8,474,888 | B2 | 7/2013 | Tomaszewski | |
| 8,740,263 | B2 * | 6/2014 | Singh | E05B 85/243 292/200 |
| 2008/0224482 | A1 * | 9/2008 | Cumbo | E05B 77/02 292/216 |
| 2009/0151257 | A1 | 6/2009 | Dominique | |
| 2010/0117379 | A1 | 5/2010 | Mitchell et al. | |
| 2015/0233157 | A1 * | 8/2015 | Bendel | E05B 85/243 292/199 |
| 2015/0308156 | A1 * | 10/2015 | Hunt | E05B 79/20 292/201 |
| 2015/0368934 | A1 * | 12/2015 | Tomaszewski | B60Q 9/00 292/199 |
| 2016/0060922 | A1 | 3/2016 | Clark et al. | |
| 2016/0186468 | A1 | 6/2016 | Ilea | |
| 2016/0245000 | A1 * | 8/2016 | Ottino | E05B 81/18 |

* cited by examiner

DUAL MOTOR LATCH ASSEMBLY WITH POWER CINCH AND POWER RELEASE HAVING SOFT OPENING FUNCTION

CROSS-REFERENCE TO RELATED APPLICATIONS

This application claims the benefit of U.S. Provisional Application No. 62/120,451, filed Feb. 25, 2015 and U.S. Provisional Application No. 62/157,088 filed May 5, 2015. The entire disclosure of each of the above applications is incorporated herein by reference.

FIELD OF THE INVENTION

The present disclosure relates generally to a closure latch for a vehicle closure panel and, more particularly, to a power latch assembly providing at least one of a power cinching feature and a power release feature having a soft opening function.

BACKGROUND OF THE INVENTION

This section provides background information related to the present disclosure which is not necessarily prior art.

In view of increased consumer demand for motor vehicles equipped with advanced comfort and convenience features, many modern motor vehicles are now provided with passive entry systems to permit locking and release of closure panels (i.e., doors, tailgates, liftgates and decklids) without use of a traditional key-type entry system. In this regard, some popular features now available with vehicle latch systems include power locking/unlocking, power release and power cinching. These "powered" features are provided by a latch assembly mounted to the closure panel and which includes a ratchet and pawl type of latching mechanism controlled via at least one electric actuator. Typically, the closure panel is held in a closed position by virtue of the ratchet being positioned in a striker capture position to releaseably retain a striker that is mounted to a structural portion of the vehicle. The ratchet is held in its striker capture position by the pawl engaging the ratchet in a ratchet holding position. In most ratchet and pawl type of latching mechanisms, the pawl is operable in its ratchet holding position to retain the ratchet in one of an initial or soft close striker capture position and a primary or hard close striker capture position. Latch assemblies providing a power cinching feature are typically equipped with a cinching mechanism operated by an electric actuator. Commonly, the cinching mechanism is directly connected to the ratchet and, when actuated, is operable for moving the ratchet from its initial striker capture position into its primary striker capture position, thereby cinching the closure panel in its closed position. To subsequently release the closure panel from its closed position, a release mechanism is actuated for moving the pawl from its ratchet holding position into a ratchet release position, whereby a ratchet biasing arrangement forcibly pivots the ratchet from its primary striker capture position into a striker release position so as to release the striker. In latch assemblies providing a power release feature, the release mechanism is controlled by an electric actuator. A common electric actuator or separate electric actuators can be used in associated with the power release and power cinching features. However, the power release feature is typically independent from the power cinch feature. As an alternative, it is also known to employ a double pawl type of latching mechanism to reduce the release effort required for the electric actuator to release the latching mechanism.

In most latch assemblies equipped with a power cinching feature, the cinching mechanism is normally maintained in a non-actuated or "stand-by" condition and is only shifted into an actuated condition once the sensors indicate that the ratchet is located in its initial striker capture position. Following completion of the cinching operation, when the sensors indicate that the ratchet is located in its primary striker capture position, the cinching mechanism must be "reset", that is returned to its stand-by condition, to permit subsequent uninhibited movement of the ratchet to its striker release position via actuation of the release mechanism. If the closure panel is initially closed with a sufficient closing force to locate the ratchet in its primary striker capture position, then the cinching operation is bypassed and the cinching mechanism is retained in its stand-by condition. One example of a power cinching latch assembly is disclosed in U.S. Pat. No. 6,341,448 as having a cable-type cinching mechanism.

To ensure that precipitation and road debris do not enter the vehicle, virtually all vehicle closure panels are equipped with weather seals around their peripheral edge and which are configured to seal against a mating surface of the vehicle body surrounding the closure opening. These weather seals also function to reduce wind noise. The seals are typically made from an elastomeric material and are configured to compress upon closing the closure panel by virtue of the latch assembly. As is recognized, increasing the compressive clamping force applied to the weather seals provides improved noise reduction within the passenger compartment. As will be appreciated, with the weather seals held in a highly compressed condition, they tend to force the closure panel toward its open position and this "opening" force is resisted by the pawl and ratchet latching mechanism of the power latch assembly. Because the seal loads exerted on the latching mechanism are increased, the forces required to release the latching mechanism are also increased which, in turn, impacts the size and power requirements of the electric actuator. Further, an audible "pop" sound is sometimes generated following actuation of the electric actuator during a power release operation due to the quick release of the seal loads while the ratchet of the latching mechanism is forcibly driven from its primary striker capture position into its striker release position.

To address this dichotomy between high seal loads and low release efforts, it is known to provide an arrangement for controllably releasing the seal loading in coordination with release of the latching mechanism. For example, European Publication No. EP1176273 discloses a single ratchet/double pawl type of power-operated latching mechanism that is configured to provide a progressive releasing of the ratchet for reducing noise associated with its release. In addition, European Publication EP0978609 utilizes an eccentric mechanism in association with a single pawl latching mechanism to reduce seal loads prior to release of the ratchet.

While current power latch assemblies are sufficient to meet regulatory requirements and provide enhanced comfort and convenience, a need still exists to advance the technology and provide alternative power latch assemblies and arrangements that address and overcome at least some of the known shortcomings.

SUMMARY OF THE INVENTION

This section provides a general summary of the disclosure and is not intended to be a comprehensive disclosure of all features, advantages, aspects and objectives associated with the inventive concepts described and illustrated in the detailed description provided herein.

It is an aspect of the present disclosure to provide a power latch assembly for a motor vehicle closure system configured to provide at least one of a power cinching feature and a soft opening power release feature.

It is a related aspect of the present disclosure to provide the power latch assembly with a power-operated latch cinch mechanism operable to cinch a striker retained by a ratchet of a ratchet and pawl latch mechanism by moving the ratchet from one of a soft close striker capture position and a hard close striker capture position into a cinched striker capture position.

It is another related aspect of the present disclosure to utilize the power-operated latch cinch mechanism to establish a first or Cinch mode and a second or Uncinch/Release mode. The Cinch mode is established when the power-operated latch cinch mechanism engages and forcibly drives the ratchet to move from one of its soft close and hard close striker capture positions into its cinched striker capture position. The Uncinch/Release mode is established when the power-operated latch cinch mechanism initially moves the ratchet from its cinched striker capture position to a cinch release striker capture position and subsequently moves the ratchet from its cinch release striker capture position to a ratchet released position.

It is another related aspect of the present disclosure to utilize the power-operated latch cinch mechanism to mechanically hold the ratchet in its cinched striker capture position.

It is another related aspect of the present disclosure to utilize the power-operated latch cinch mechanism to maintain engagement with the ratchet during movement of the ratchet from its cinched striker capture position into its cinch release striker position for uncinching the striker and to subsequently release engagement with the ratchet upon movement of the ratchet from its cinch release striker capture position into its ratchet release position.

It is yet another related aspect of the present disclosure to provide the power latch assembly with a power-operated latch release mechanism operable, in cooperation with the latch cinch mechanism, to permit movement of the ratchet from its cinched striker capture position into its cinch release striker capture position for uncinching the striker prior to permitting movement of the ratchet from its ratchet release position to a striker release position so as to provide the soft opening power release feature.

It is another aspect of the present disclosure to provide the power latch assembly with an actuation mechanism operable to coordinate the power cinching feature and the soft opening power release feature.

In accordance with these and other aspects, a power latch assembly is provided which comprises: a ratchet moveable between a striker release position whereat the ratchet is positioned to release a striker and three distinct striker capture positions whereat the ratchet is positioned to retain the striker, wherein the three distinct striker capture positions include a soft close striker capture position, a hard close striker capture position and a cinched striker capture position; a ratchet biasing member for normally biasing the ratchet toward its striker release position; a pawl moveable between a ratchet checking position whereat the pawl is positioned to hold the ratchet in one of its soft close and hard close striker capture positions and a ratchet release position whereat the pawl is located to permit movement of the ratchet to its striker release position; a pawl biasing member for normally biasing the pawl toward its ratchet checking position; a latch release mechanism engaging the pawl and operable in a first latch release mode for locating the pawl in its ratchet checking position and a second latch release mode for locating the pawl in its ratchet release position; a latch cinch mechanism including a cinch link lever having an engagement surface configured to selectively engage a ratchet projection extending from the ratchet when the ratchet is initially rotated by the striker from its striker release position into one of its soft close striker capture and hard close striker capture positions; and an actuation mechanism operably moveable in a cinching direction from a cinch start position to a cinch stop position to provide a power cinching function after the ratchet has been rotated by the striker into one of its soft close striker capture and hard close striker capture positions and the pawl has moved into its ratchet checking position, wherein movement of the actuation mechanism from its cinch start position to its cinch stop position causes pivotal movement of the cinch link lever which forcibly rotates the ratchet into its cinched striker capture position due to continued engagement of the ratchet projection with the engagement surface of the cinch link lever, and wherein the pawl is located in its ratchet checking position but is disengaged from the ratchet when the ratchet is held in its cinched striker capture position. The power latch assembly is also configured to provide a soft release function for uncinching the striker prior to release of the ratchet projection from the engagement surface on the cinch link lever by moving the actuation mechanism in a releasing direction from its cinch stop position toward its cinch start position for moving the ratchet from its cinched striker capture position to a cinch release striker capture position.

In accordance with these and other aspects, a power latch assembly is provided which comprises: a ratchet moveable between a striker release position whereat the ratchet is positioned to release a striker and three distinct striker capture positions whereat the ratchet is positioned to retain the striker, wherein the three distinct striker capture positions of the ratchet include a first or soft close striker capture position, a second or hard close striker capture position, and a third or cinched striker capture position; a ratchet biasing member configured to normally bias the ratchet toward its striker release position; a pawl moveable between a ratchet checking position whereat the pawl is positioned to hold the ratchet in one of its soft closed and hard closed striker capture positions and a ratchet release position whereat the pawl is located to permit movement of the ratchet to its striker release position; a pawl biasing member configured to normally bias the pawl toward its ratchet checking position; a latch cinch mechanism having a cinch lever and a cinch link lever, the cinch lever having a first segment pivotably mounted to a cinch pivot pin and a second segment pivotably connected to a first segment of the cinch link lever, wherein a second segment of the cinch link lever is configured to include an engagement shoulder adapted to selectively engage and retain a ratchet projection extending from the ratchet in response to the striker moving the ratchet from its striker release position into its soft close striker capture position; and an actuation mechanism operable for providing a power cinching function, wherein the actuation mechanism includes an electric motor driving a gear having a drive slot within which a drive post on the second segment of the cinch lever is retained for coordinating pivotal movement of the cinch lever with rotation of the gear, wherein the power cinching function is provided by actuating the electric motor to rotate the gear in a cinching direction from a cinch start position to a cinch stop position which causes the latch cinch mechanism to forcibly rotate the ratchet from its soft close striker capture position or its hard close striker capture position into its cinched striker capture position due to engagement between the ratchet projection and the engagement shoulder on the cinch link lever while the pawl is maintained in its ratchet checking position.

In accordance with the power latch assembly constructed as described above, a power release function is also made available by further providing: a latch release mechanism having a pawl lever and a release lever, the pawl lever engaging the pawl and being moveable between a first pawl lever position whereat the pawl is located in its ratchet release position and a second pawl lever position whereat the pawl is located in its ratchet release position. The release lever being selectably engageable with the pawl lever and a cam segment formed on the gear and moveable between a non-actuated position whereat the pawl lever is located in its first pawl lever position and an actuated position whereat the pawl lever is located in its second pawl lever position; and a cinch disengage mechanism including a disengage lever having a first segment pivotably mounted on the cinch pivot pin and a second segment with a follower disposed in a lost motion slot formed in the cinch link lever. The power release function is provided by actuating the electric motor to rotate the gear in a releasing direction from its cinch stop position toward its cinch start position for causing its cam segment to move the release lever from its non-actuated position into its actuated position. Such movement of the release lever causes the pawl lever to move the pawl from its ratchet checking position toward its ratchet release position while concurrently acting on the cinch disengage mechanism to cause movement of the cinch link lever toward a released position whereat the ratchet projection is released from engagement with the engagement shoulder, thereby permitting the ratchet to rotate from its ratchet release position into its striker release position due to the biasing of the ratchet biasing member. The soft open feature is provided by the ratchet being initially rotated from its cinched striker capture position to its cinch release striker capture position in response to initial rotation of the gear in the releasing direction from it cinch stop position toward an uncinch position while the ratchet projection is maintained in engagement with the shoulder on the cinch link lever. This limited rotation of the gear in the releasing direction causes the latch cinch mechanism to move and permit rotation of the ratchet from its cinch striker capture position into its cinch release striker capture position, thereby uncinching the striker prior to release of the ratchet for uninhibited movement from its ratchet release position into its striker release position.

In accordance with these and other aspects, a one-motor version of a power latch assembly is provided which comprises a ratchet moveable between a striker release position whereat the ratchet is positioned to release a striker and three distinct striker capture positions whereat the ratchet is positioned to retain the striker, wherein the three distinct striker capture positions include a soft close striker capture position, a hard close striker capture position and a cinched striker capture position; a ratchet biasing member for normally biasing the ratchet toward its striker release position; a pawl moveable between a ratchet checking position whereat the pawl is positioned to hold the ratchet in one of its soft close and hard close striker capture positions and a ratchet release position whereat the pawl is positioned to permit movement of the ratchet to its striker release position; a pawl biasing member for normally biasing the pawl toward its ratchet checking position; a latch release mechanism having a pawl lever and a release lever, the pawl lever engaging the pawl and being moveable between a first pawl lever position whereat the pawl is located in its ratchet checking position and a second pawl lever position whereat the pawl is located in its ratchet release position, the release lever being selectably engageable with the pawl lever and moveable between a non-actuated position whereat the pawl lever is positioned in its first pawl lever position and an actuated position whereat the pawl lever is moved to its second pawl lever position; a latch cinch mechanism having a cinch lever and a cinch link lever, the cinch lever having a first segment pivotably mounted to a cinch pivot pin and a second segment pivotably connected to a first segment of the cinch link lever, wherein a second segment of the cinch link lever includes an engagement shoulder configured to selectively engage a ratchet projection extending from the ratchet when the ratchet is positioned in its soft close striker capture position; a cinch disengage mechanism including a disengage lever having a first segment pivotably mounted on the cinch pivot pin and a second segment with a follower disposed in a lost motion slot formed in the cinch link lever; and an actuation mechanism operable for providing a power cinching function and a power release function, the actuation mechanism including an electric motor and a gearset having a first gear driven by the motor and which is meshed with a second gear supported for rotation on the cinch pivot pin, wherein the second gear includes an edge section defining a drive slot, a recessed segment and a cam segment, and wherein a drive post extending from the second end of the cinch lever is disposed within the drive slot for coordinating pivotal movement of the cinch lever with rotation of the second gear.

In accordance with the one-motor version of the power latch assembly constructed as described above, the power cinching function is provided by actuating the electric motor to rotate the second gear in a cinching direction from a cinch start position to a cinch stop position. The power cinching function is initiated following the ratchet being rotated by the striker into one of its soft close and hard close striker capture positions while the pawl is located in its ratchet checking position. Such rotation of the second gear to its cinch stop position causes pivotal movement of the cinch lever and the cinch link lever which forcibly rotates the ratchet into its cinched striker capture position due to engagement of the ratchet projection with the engagement shoulder on the cinch link lever, and wherein the pawl is positioned in its ratchet checking position but is disengaged from the ratchet when the ratchet is rotated to its cinched striker capture position.

In accordance with the one-motor version of the power latch assembly constructed as above, the power release function is provided by actuating the electric motor to rotate the second gear in a releasing direction from its cinch stop position toward its cinch start position while the ratchet is held in its cinched striker capture position by the latch cinch mechanism. This rotation of the second gear causes the cam segment to engage and move the release lever from its non-actuated position toward its actuated position for causing the pawl lever to move the pawl from its ratchet checking position toward its ratchet release position. This movement of the pawl lever also causes the cinch disengage mechanism to engage the cinch link lever and forcibly move it to a release position whereat the cinch link lever is released from engagement with the ratchet projection, whereby the ratchet is released and permitted to rotate from its ratchet released position to its striker release position. To provide the soft open function, the second gear is initially rotated in the releasing/uncinching direction from its cinch stop position into an uncinch position. Such rotation of the second gear causes the latch cinch mechanism to permit the ratchet to be initially rotated from its cinched striker capture position to a cinch released striker capture position while the ratchet projection is maintained in engagement with the shoulder on the cinch link lever, thereby uncinching the striker. Continued rotation of the second gear in the releasing/uncinching direction causes the ratchet to move from its cinch released striker capture position into its ratchet release position whereat the ratchet projection is disengaged from the shoulder on the cinch link lever, thereby releasing the ratchet for subsequent movement to its striker release position following the uncinching process.

In accordance with these and other aspects, a two-motor version of a power latch assembly is provided which comprises a ratchet moveable between a striker release position whereat the ratchet is positioned to release a striker and three distinct striker capture positions whereat the ratchet is positioned to retain the striker, wherein the three distinct striker capture positions include a soft close striker capture position, a hard close striker capture position and a cinched striker capture position; a ratchet biasing member for normally biasing the ratchet toward its striker release position; a pawl moveable between a ratchet checking position whereat the pawl is positioned to hold the ratchet in one of its soft close and hard close striker capture positions and a ratchet release position whereat the pawl permits movement of the ratchet to its striker release position; a pawl biasing member for normally biasing the pawl toward its ratchet checking position; a latch release mechanism having a pawl lever, a release lever, and a backup lever, the pawl lever engaging the pawl and being moveable between a first pawl lever position whereat the pawl is located in its ratchet checking position and a second pawl lever position whereat the pawl is located in its ratchet release position, the release lever being selectably engageable with the backup lever and moveable between a non-actuated position whereat the backup lever is positioned in a first position and an actuated position whereat the backup lever is moved to a second position; a latch cinch mechanism having a cinch lever and a cinch link lever, the cinch lever having a first segment pivotably mounted to a cinch pivot pin and a second segment pivotably connected to a first segment of the cinch link lever, wherein a second segment of the cinch link lever includes an engagement shoulder configured to selectively engage a ratchet rivet fixed to the ratchet when the ratchet is positioned in its soft close striker capture position; a cinch disengage mechanism including a disengage lever having a first segment pivotably mounted on the cinch pivot pin and a second segment with a follower disposed in a lost motion slot formed in the cinch link lever; and an actuation mechanism having a power cinching actuator and a power release actuator, the power cinching actuator including a first electric motor and a cinch gear driven by the first electric motor, wherein the cinch gear includes an edge section defining a drive slot, a recessed segment and a cam segment, and wherein a drive post extending from the second end of the cinch lever is disposed within the drive slot for coordinating pivotal movement of the cinch lever with rotation of the second gear, and wherein the power release actuator includes a second electric motor and a power release gear driven by the second electric motor for moving the pawl lever between its first and second pawl lever position.

In accordance with the two-motor version of the power latch assembly constructed as described above, the power cinching function is provided by actuating the power cinching actuator to rotate the cinch gear in a cinching direction from a cinch start position to a cinch stop position. The power cinching function is initiated following the ratchet being rotated by the striker into one of its soft close and hard close striker capture positions while the pawl is located in its ratchet checking position. Such rotation of the cinch gear to its cinch stop position causes pivotal movement of the cinch lever and the cinch link lever which forcibly rotates the ratchet into its cinched striker position due to engagement of the ratchet projection with the engagement shoulder of the cinch link lever, while the pawl is maintained in its ratchet checking position but disengaged from the ratchet.

In accordance with the two-motor version of the power latch assembly constructed as above, the power release function is provided by initially actuating the power release actuator to rotate the power release gear in a releasing direction for pivoting the pawl lever of the latch release mechanism from its first pawl lever position into its second pawl lever position for moving the pawl from its ratchet checking position into its ratchet release position. The power cinching actuator is also actuated to cause the cinch gear to be rotated in a releasing direction from its cinch stop position toward its cinch start position. Such rotation of the cinch gear causes the release lever to rotate from its non-actuated position into an actuated position which in turn forcibly pivots the inside backup lever from a first position to a second position. Such pivotal movement of the inside backup lever causes it to act on and move the cinch link lever to release the ratchet projection from the shoulder on the cinch link lever, thereby permitting the ratchet to rotate from its ratchet position into its striker release position. Rotation of the cinch gear concurrently acts on the cinch disengage mechanism to assist in moving the cinch link lever out of engagement with the ratchet.

Further areas of applicability will become apparent from the detailed description provided herein. The description and specific examples in this summary are intended for purposes of illustration only and are not intended to limit the scope of the present disclosure.

DRAWINGS

The drawings described herein are for illustrative purposes only of selected embodiments and not all possible implementations such that the drawings are not intended to limit the scope of the present disclosure.

Figure 13A:
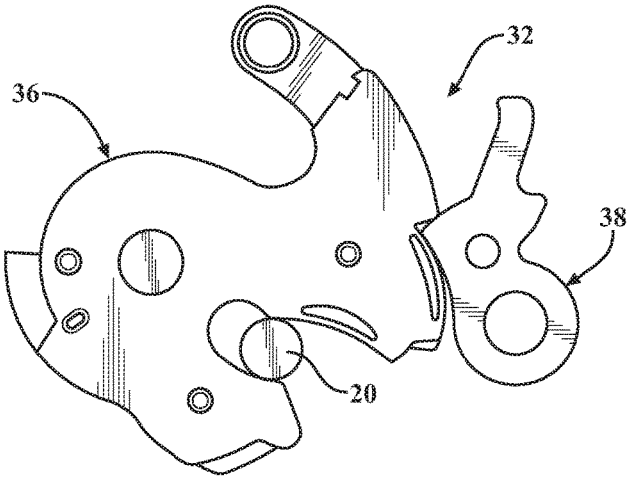
Figure 13B:
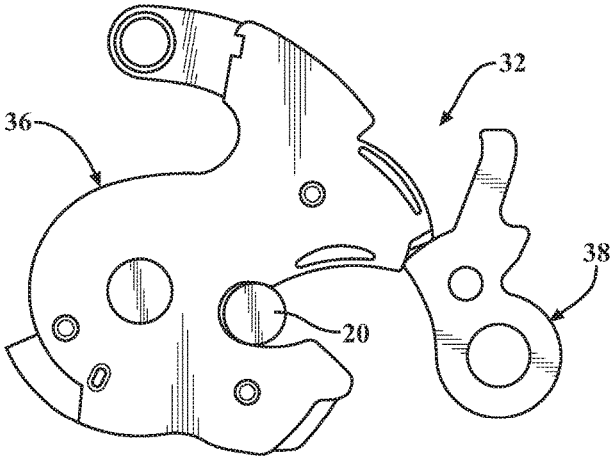
Figure 13C:
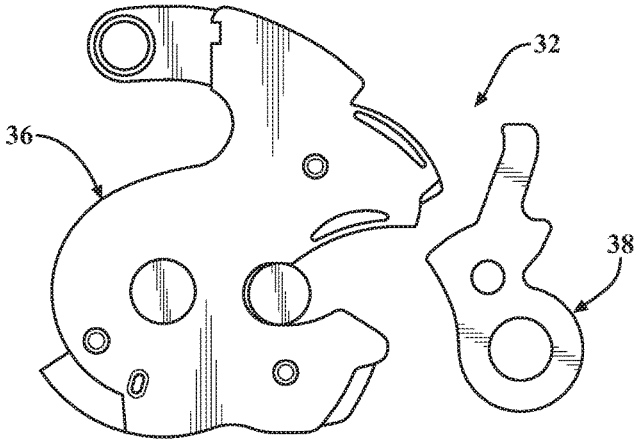
Figure 14A:
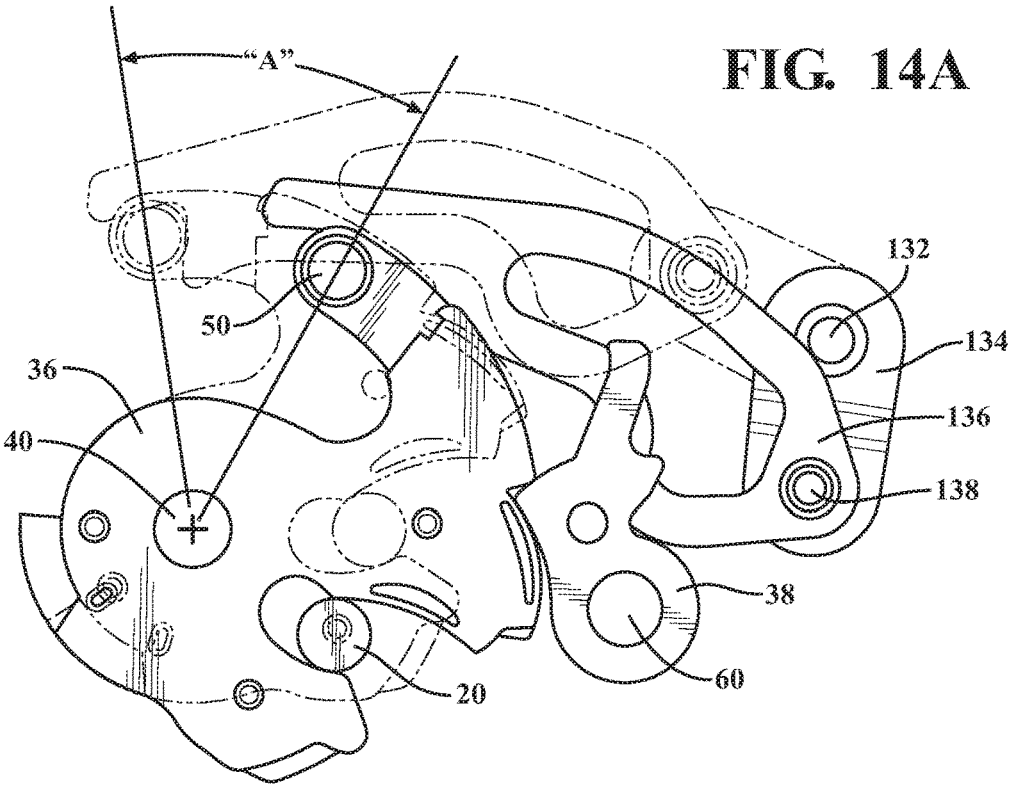
Figure 14B:
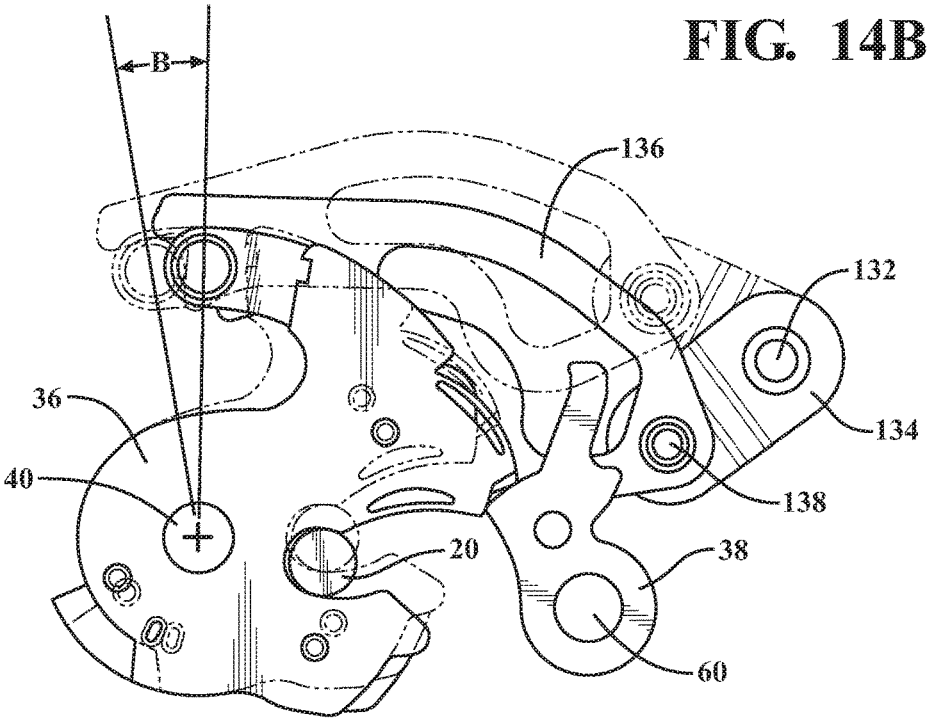
Figure 17A:
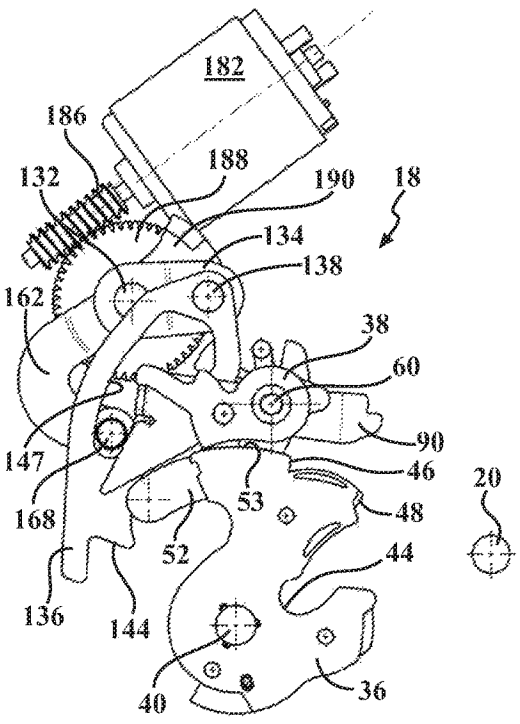
Figure 16A:
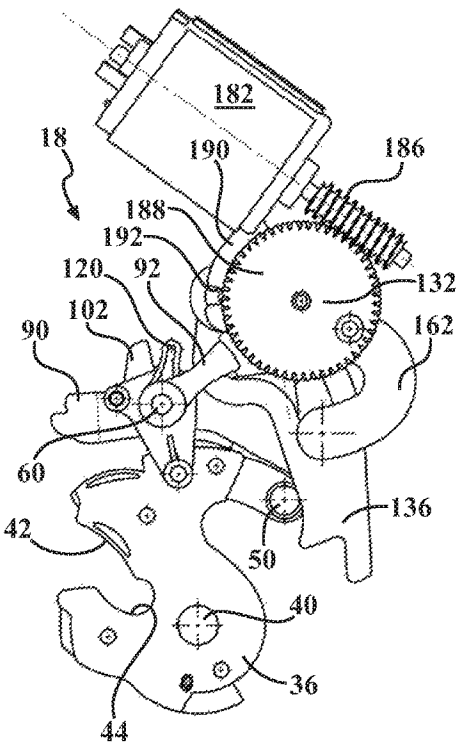
Figure 15A:
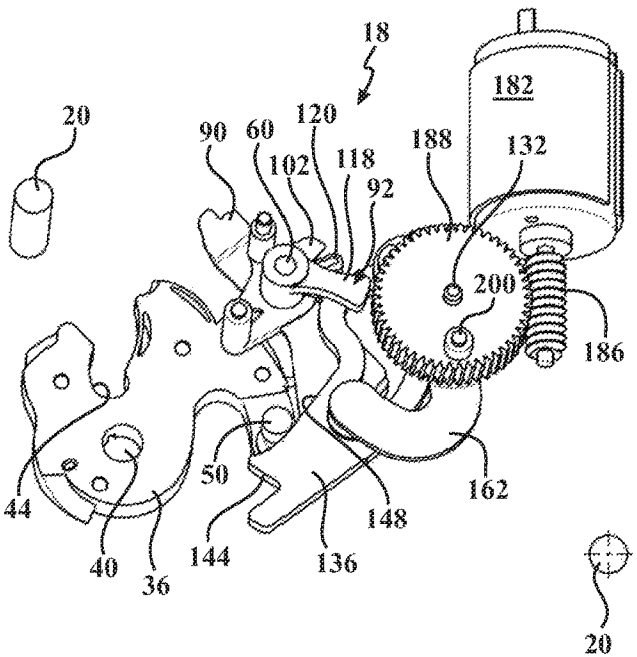
Figure 17B:
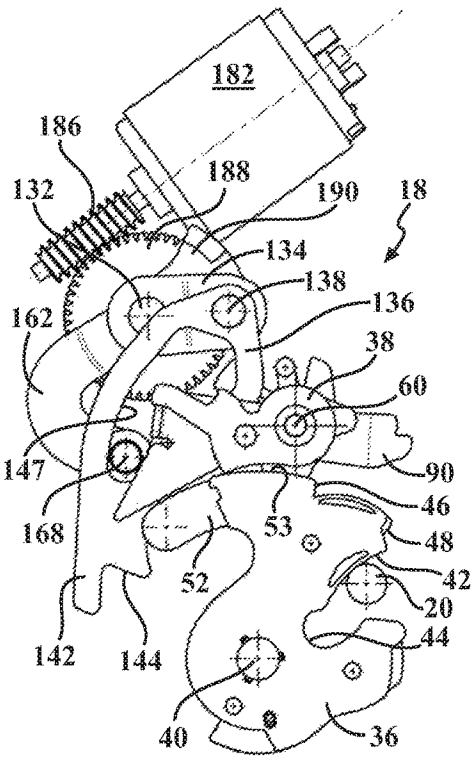
Figure 16B:
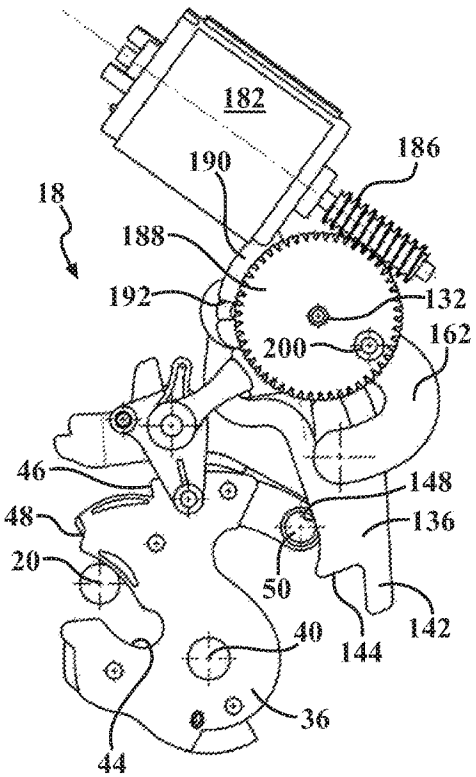
Figure 15B:
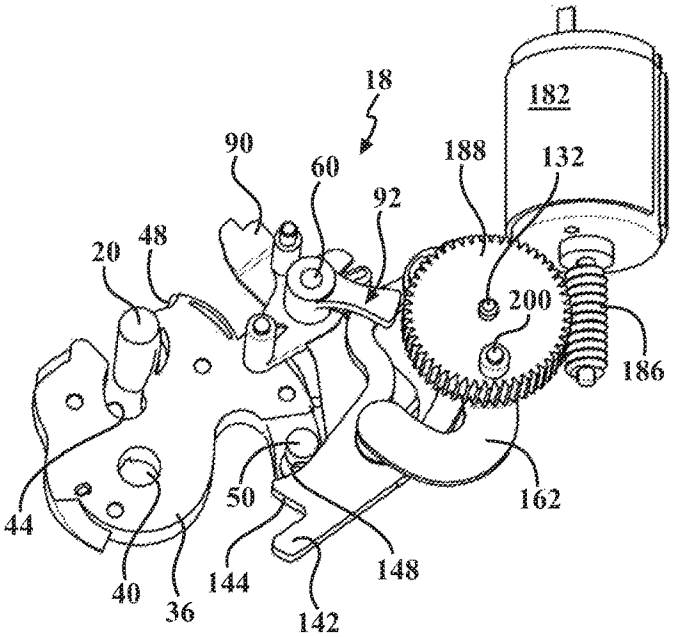
Figure 17C:
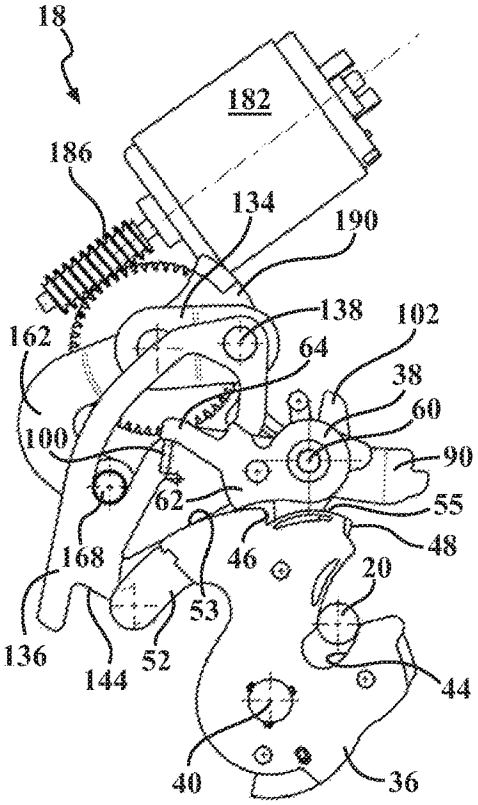
Figure 16C:
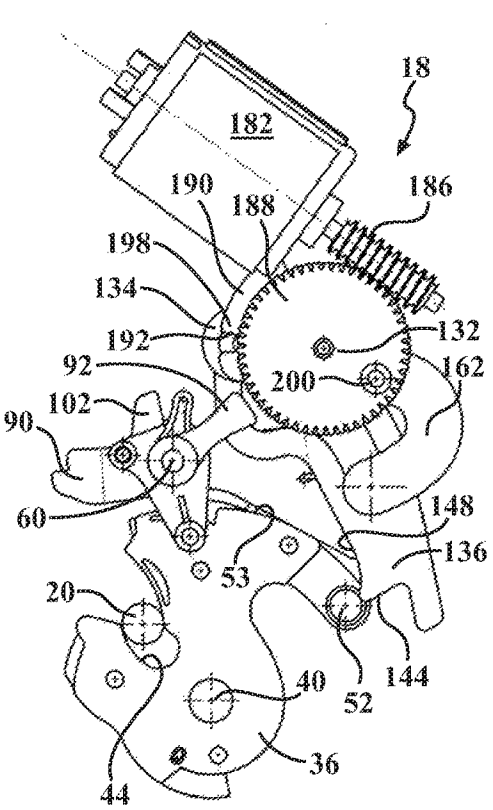
Figure 15C:
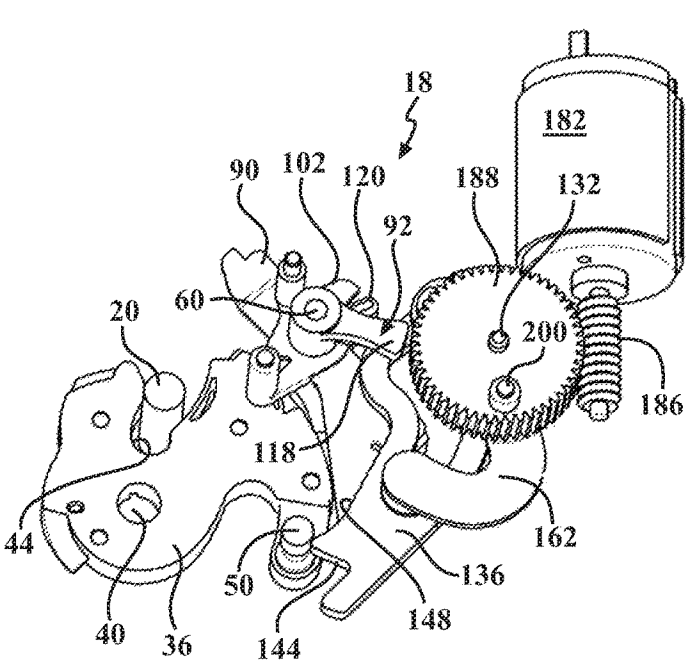
Figure 17D:
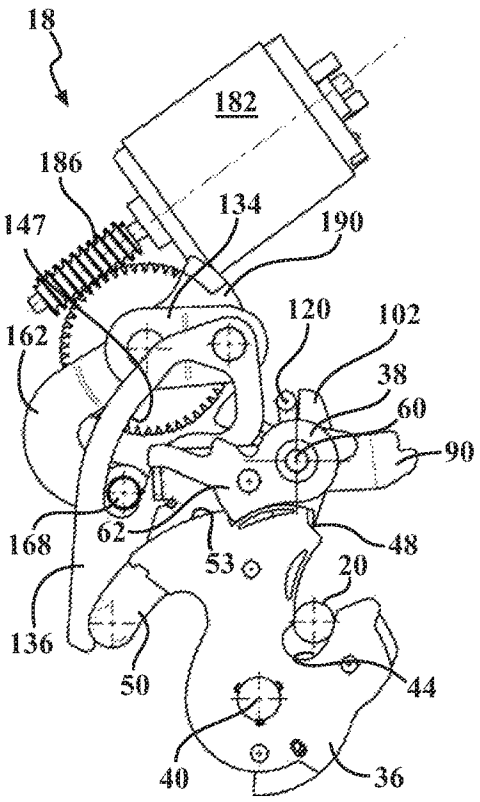
Figure 16D:
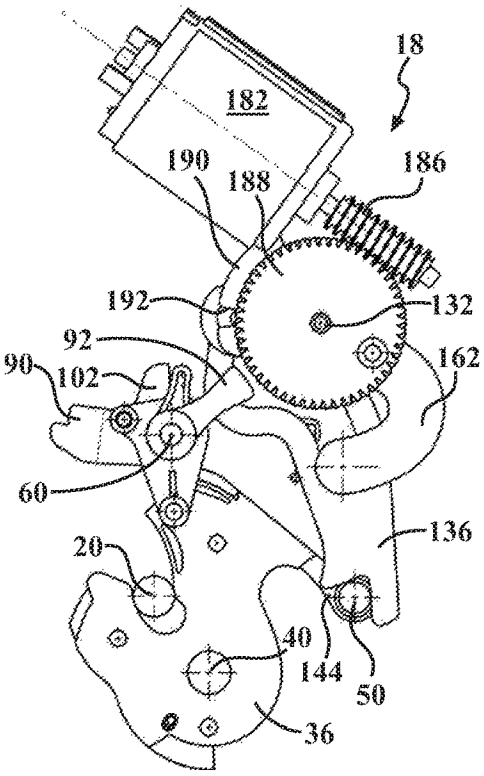
Figure 15D:
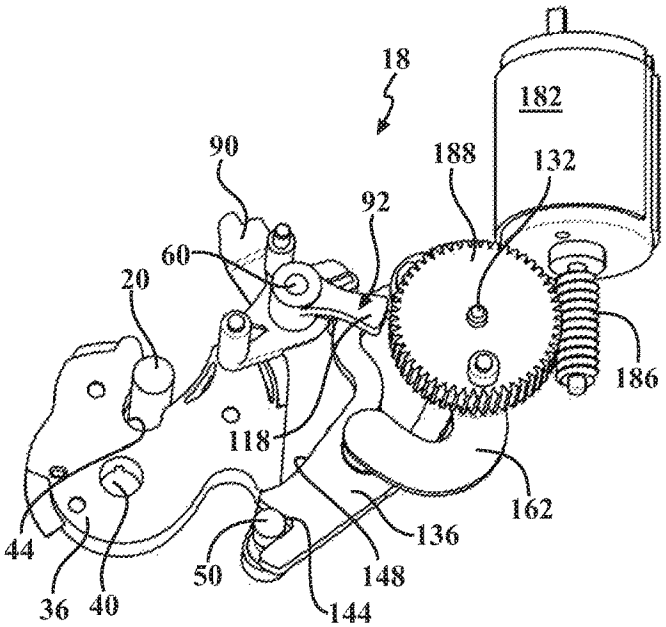
Figure 17E:
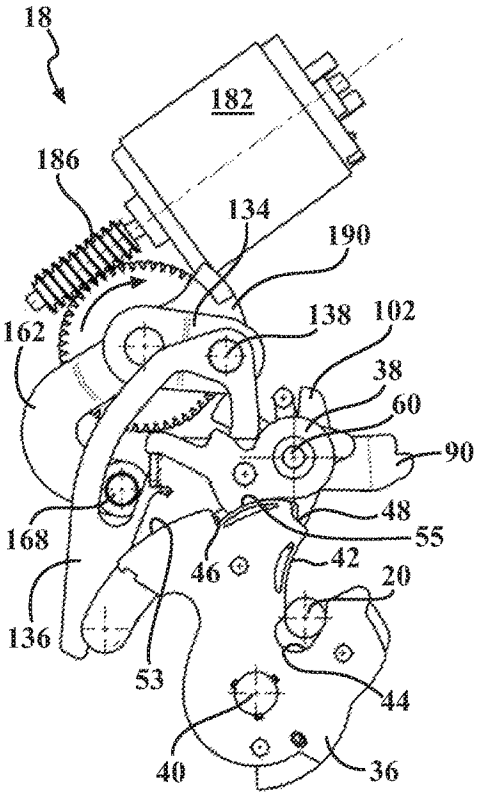
Figure 16E:
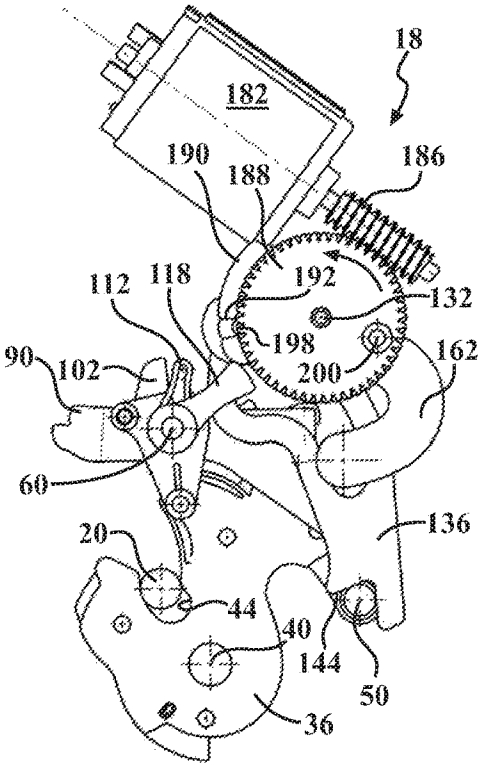
Figure 15E:
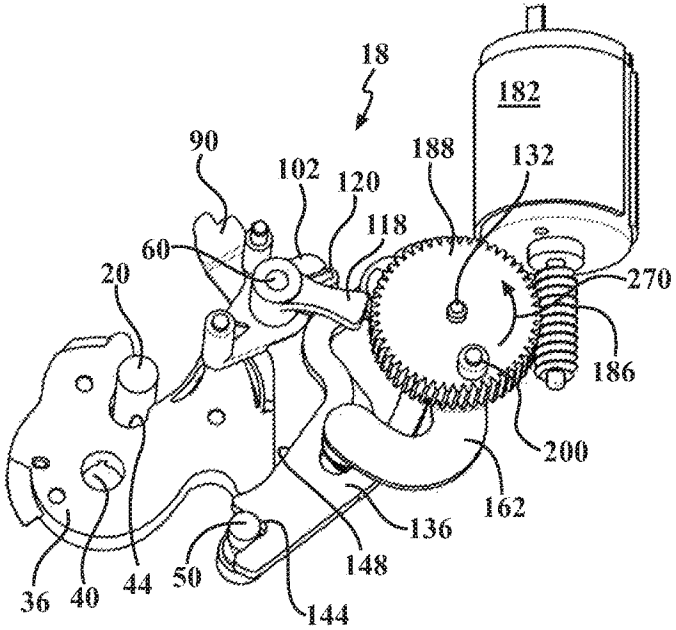
Figure 17F:
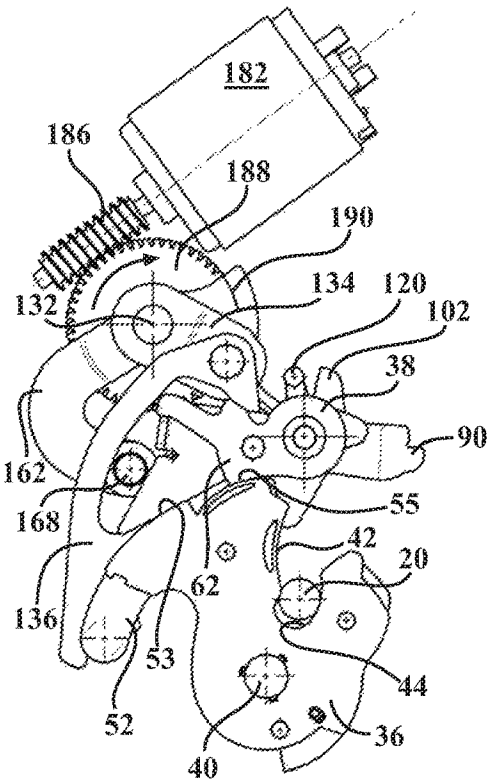
Figure 16F:
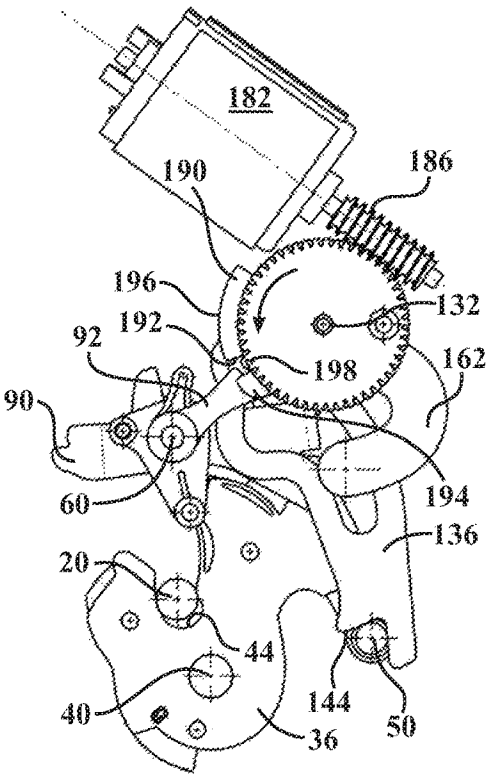
Figure 15F:
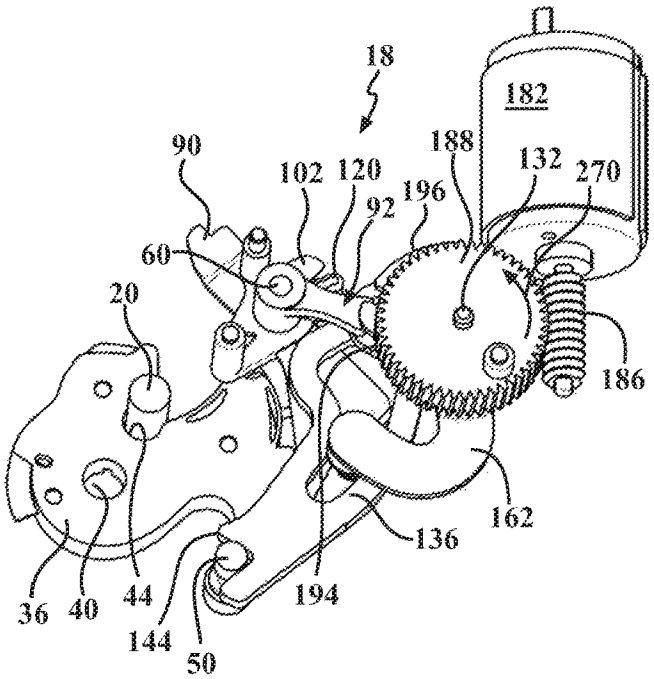
Figure 17G:
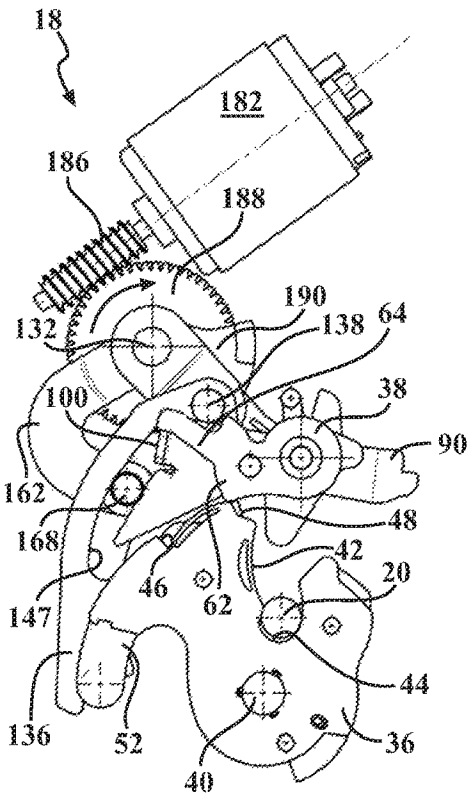
Figure 16G:
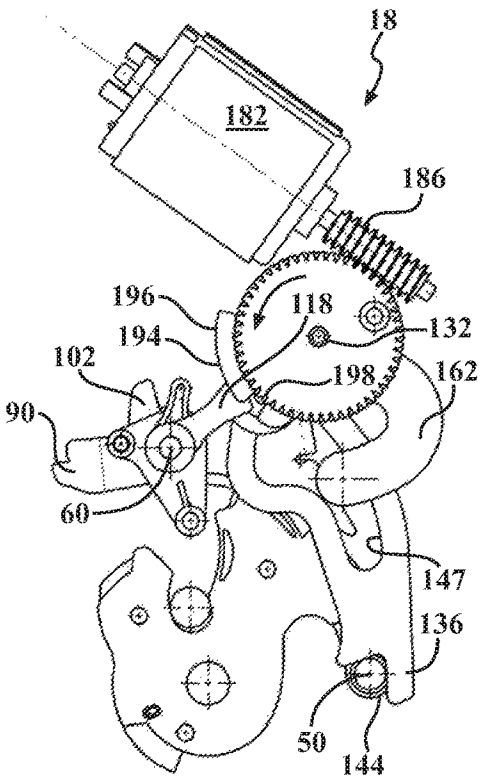
Figure 15G:
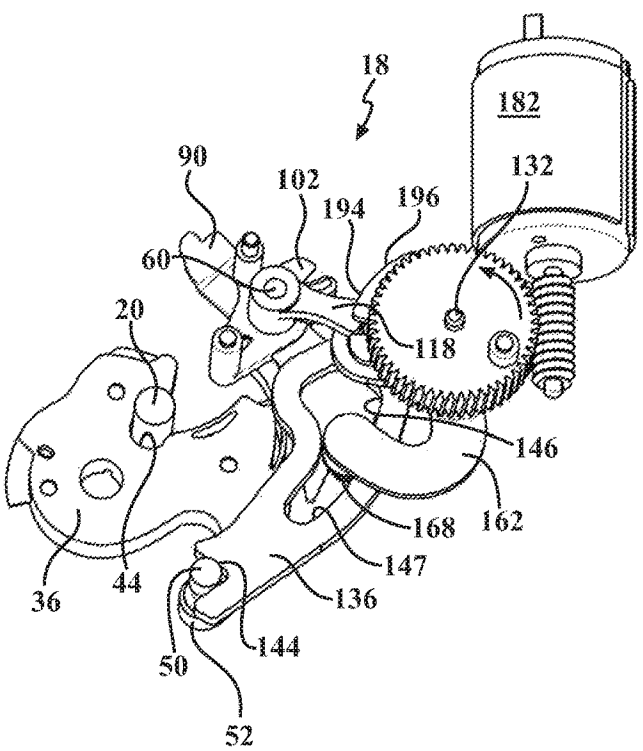
Figure 17H:
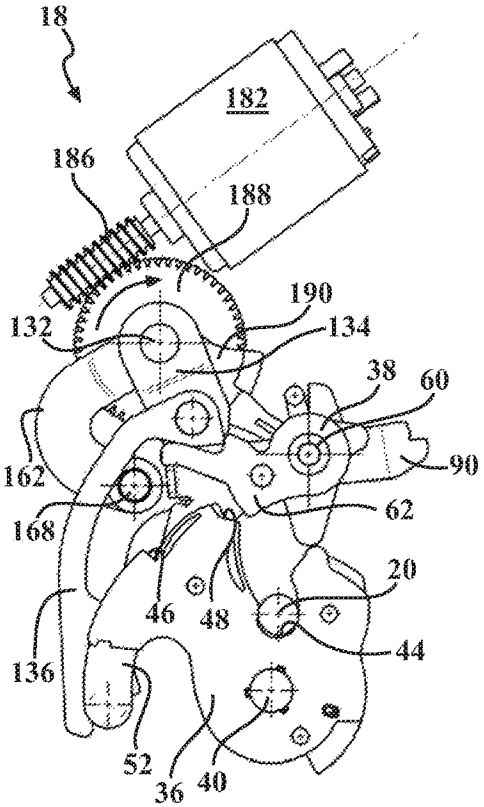
Figure 16H:
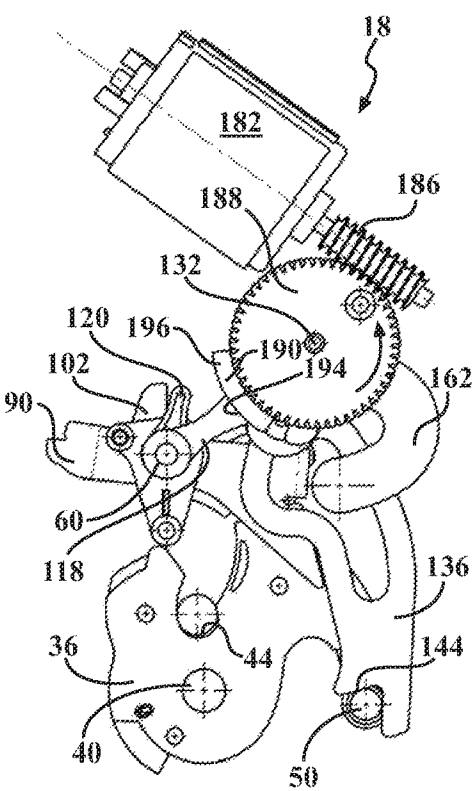
Figure 15H:
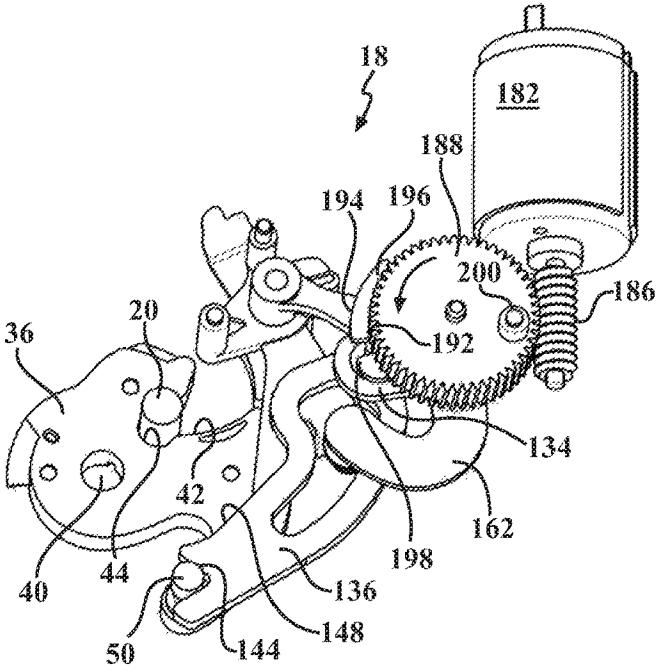
Figure 17I:
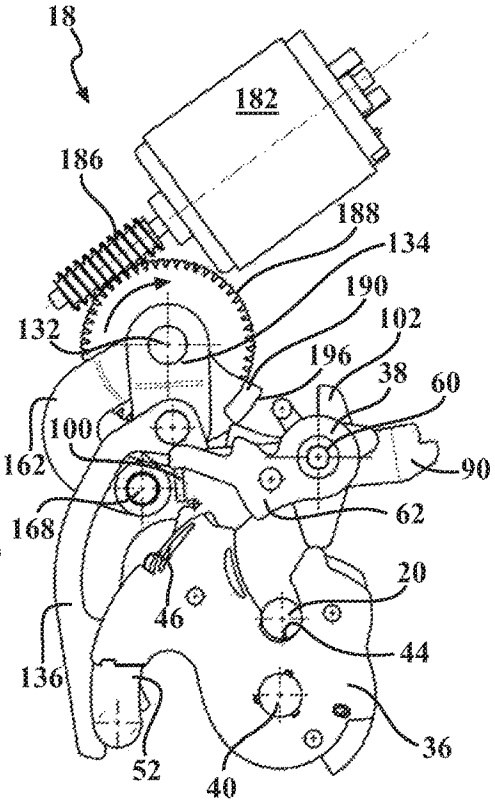
Figure 16I:
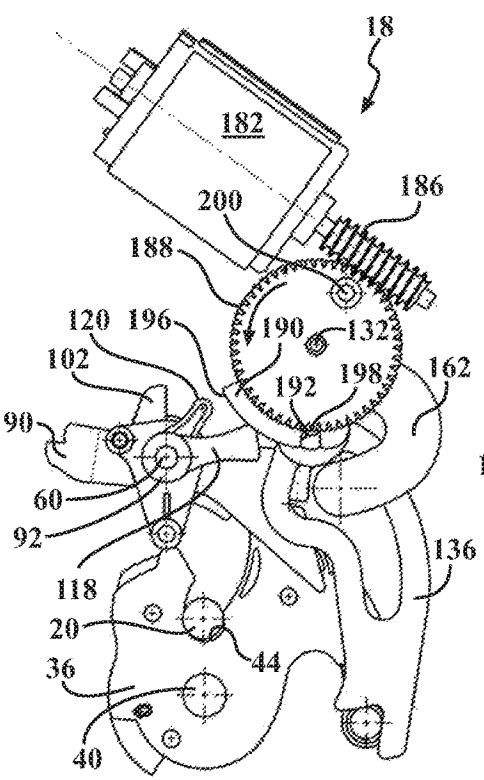
Figure 15I:
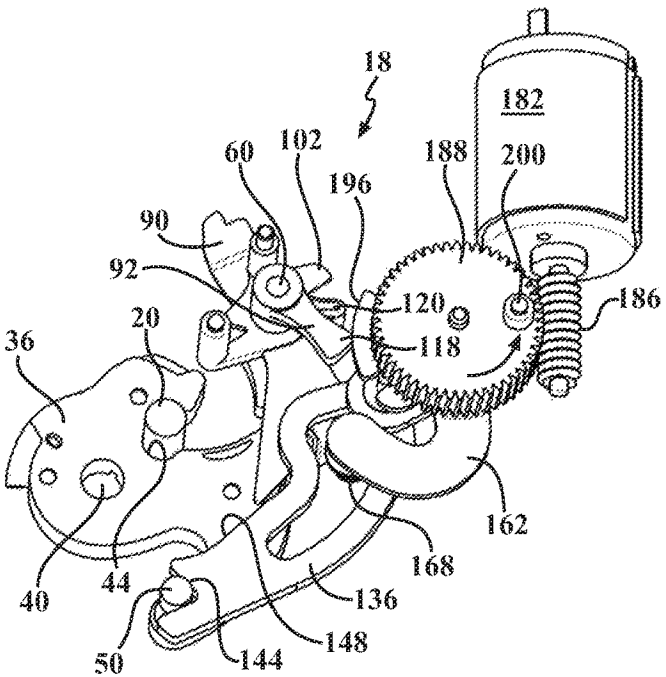
Figure 17J:
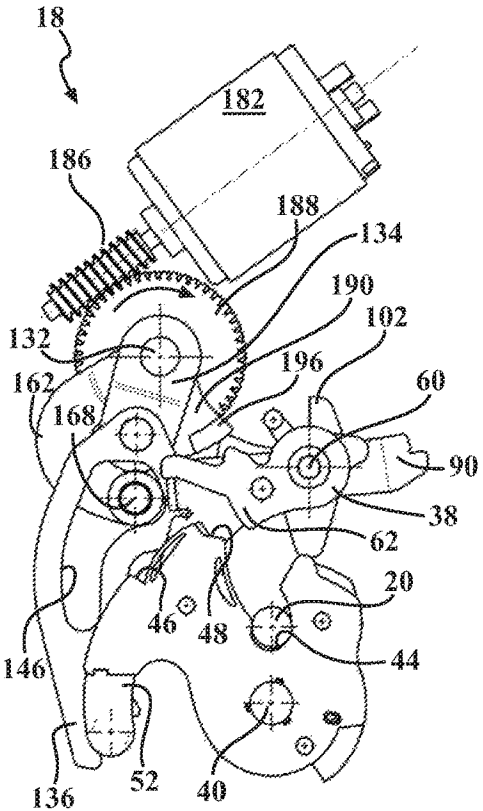
Figure 16J:
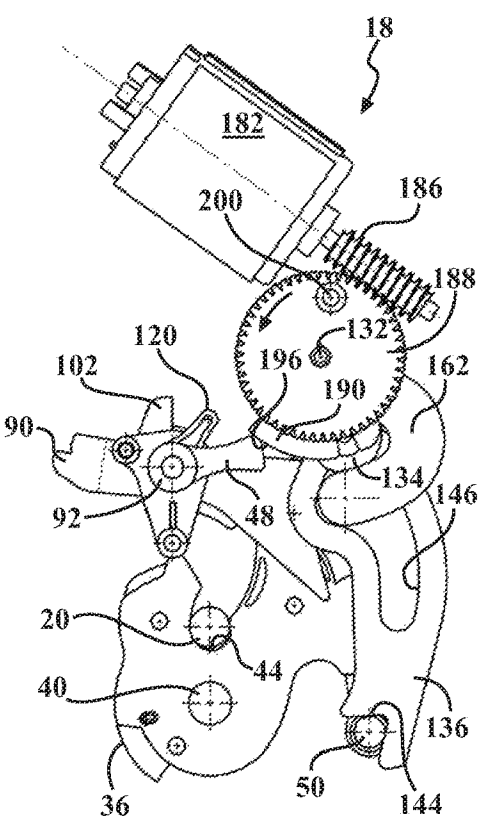
Figure 15J:
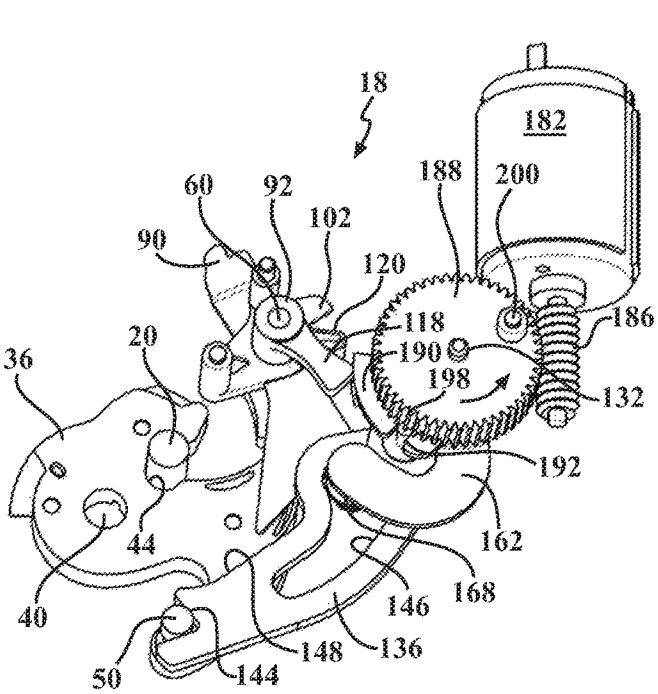
Figure 17K:
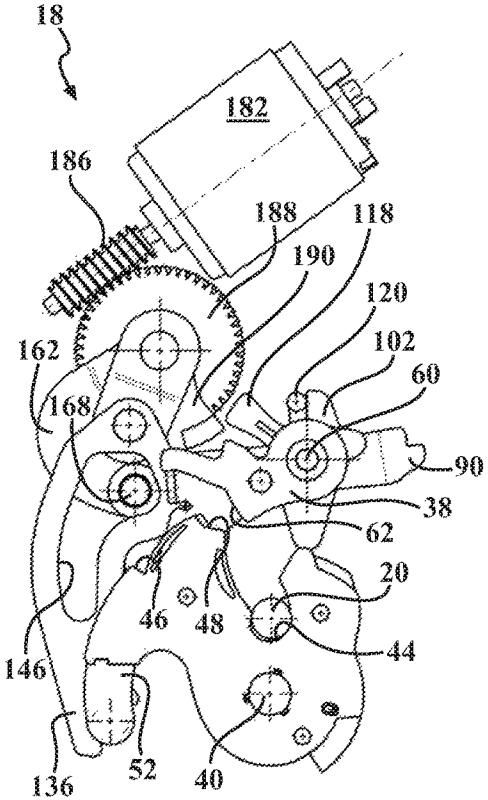
Figure 16K:
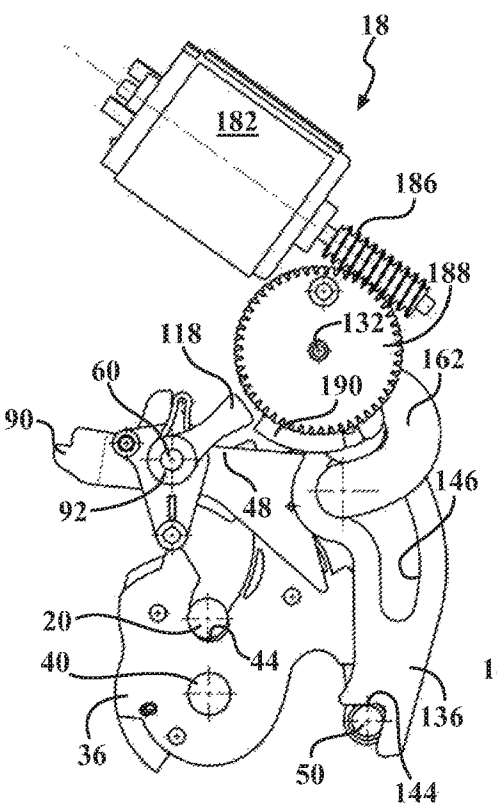
Figure 15K:
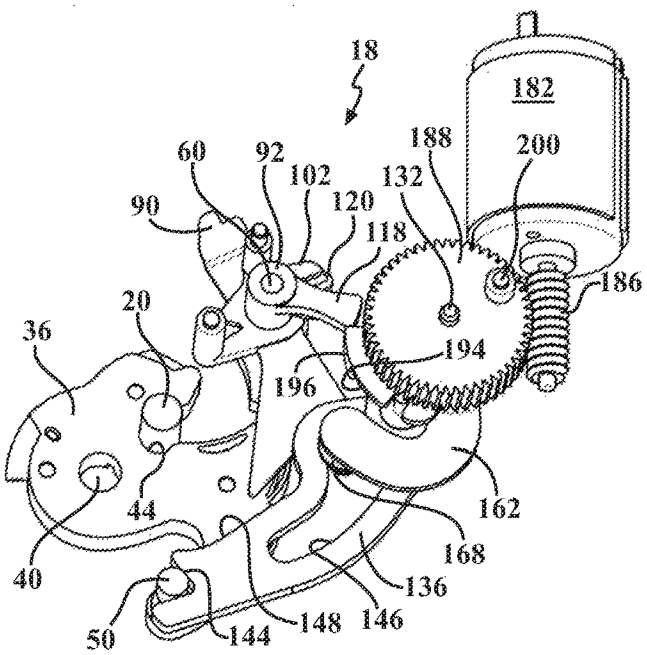
Figure 17L:
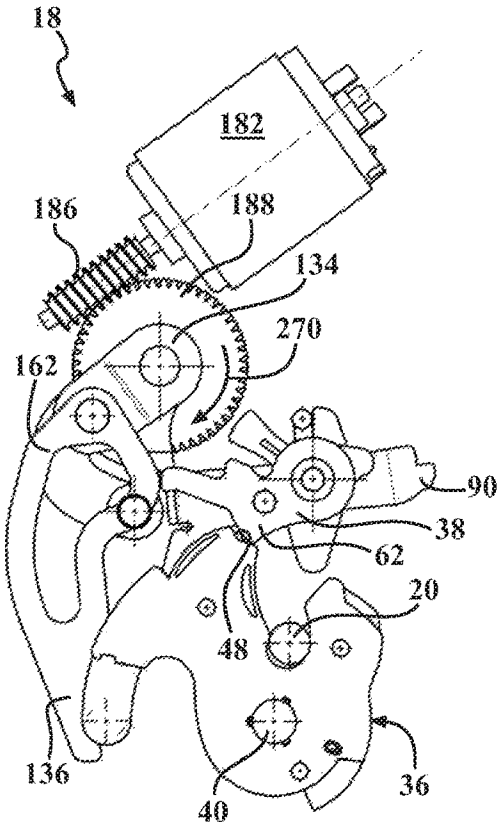
Figure 16L:
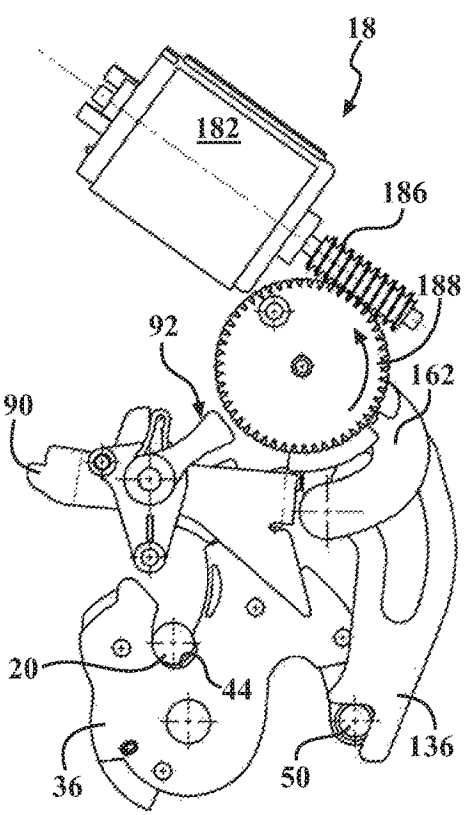
Figure 15L:
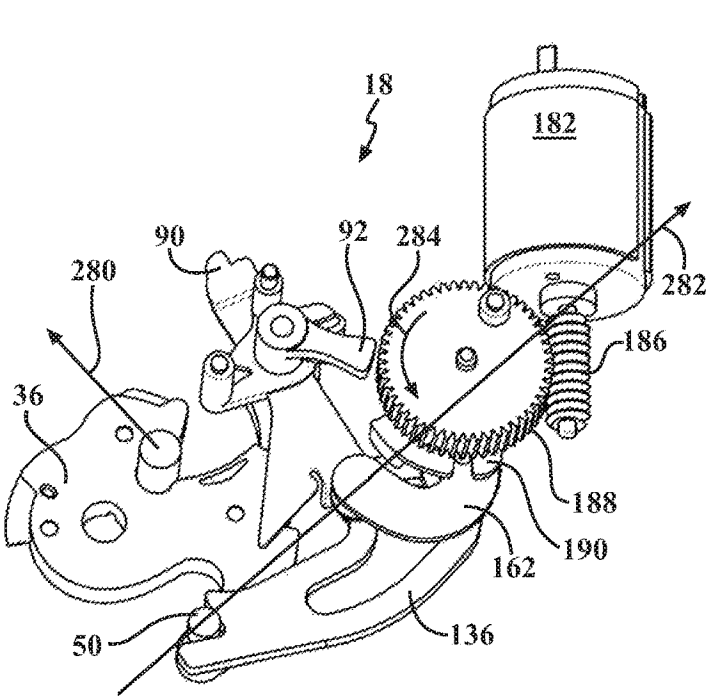
Figure 23:
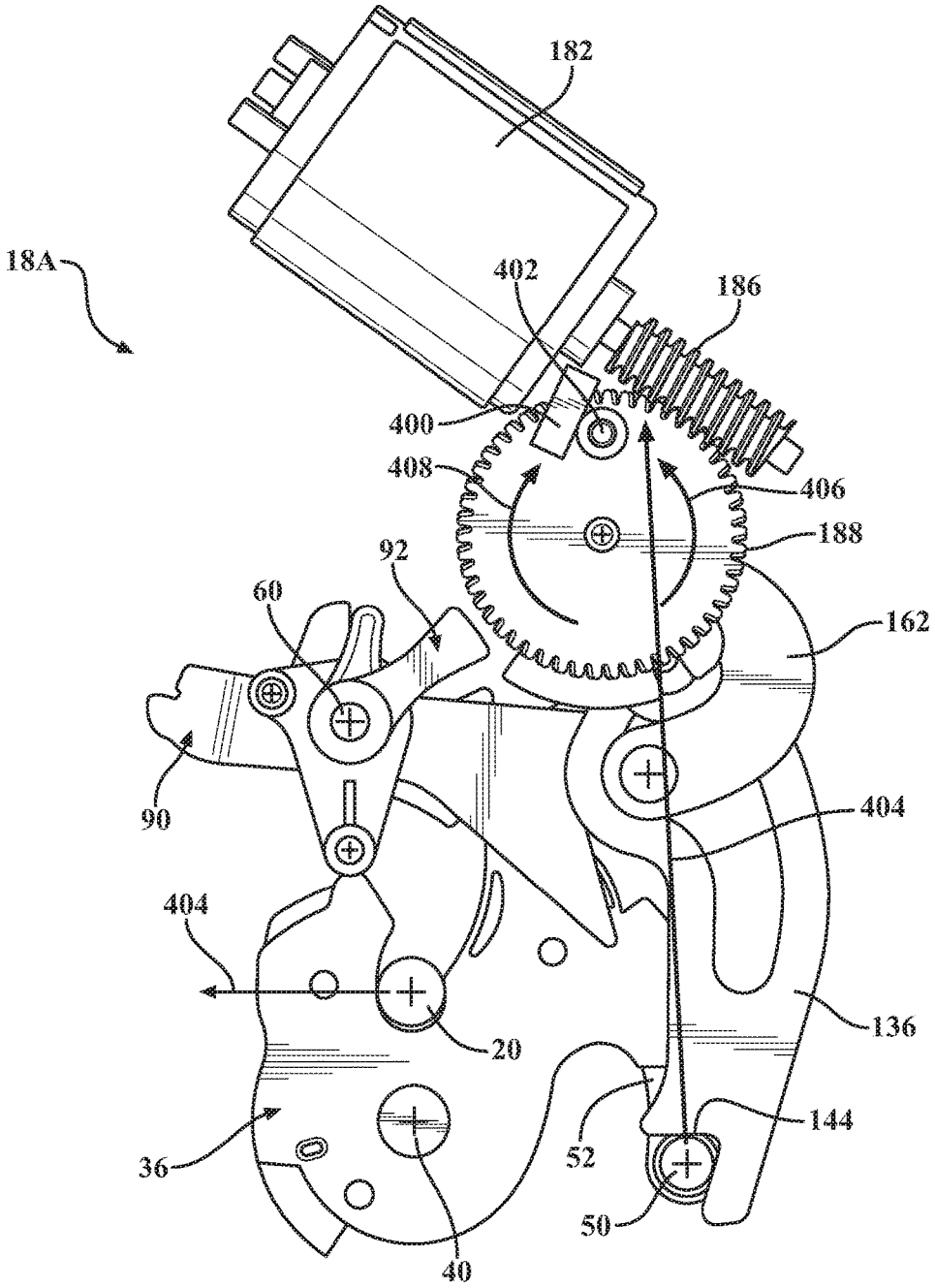
Figure 24:
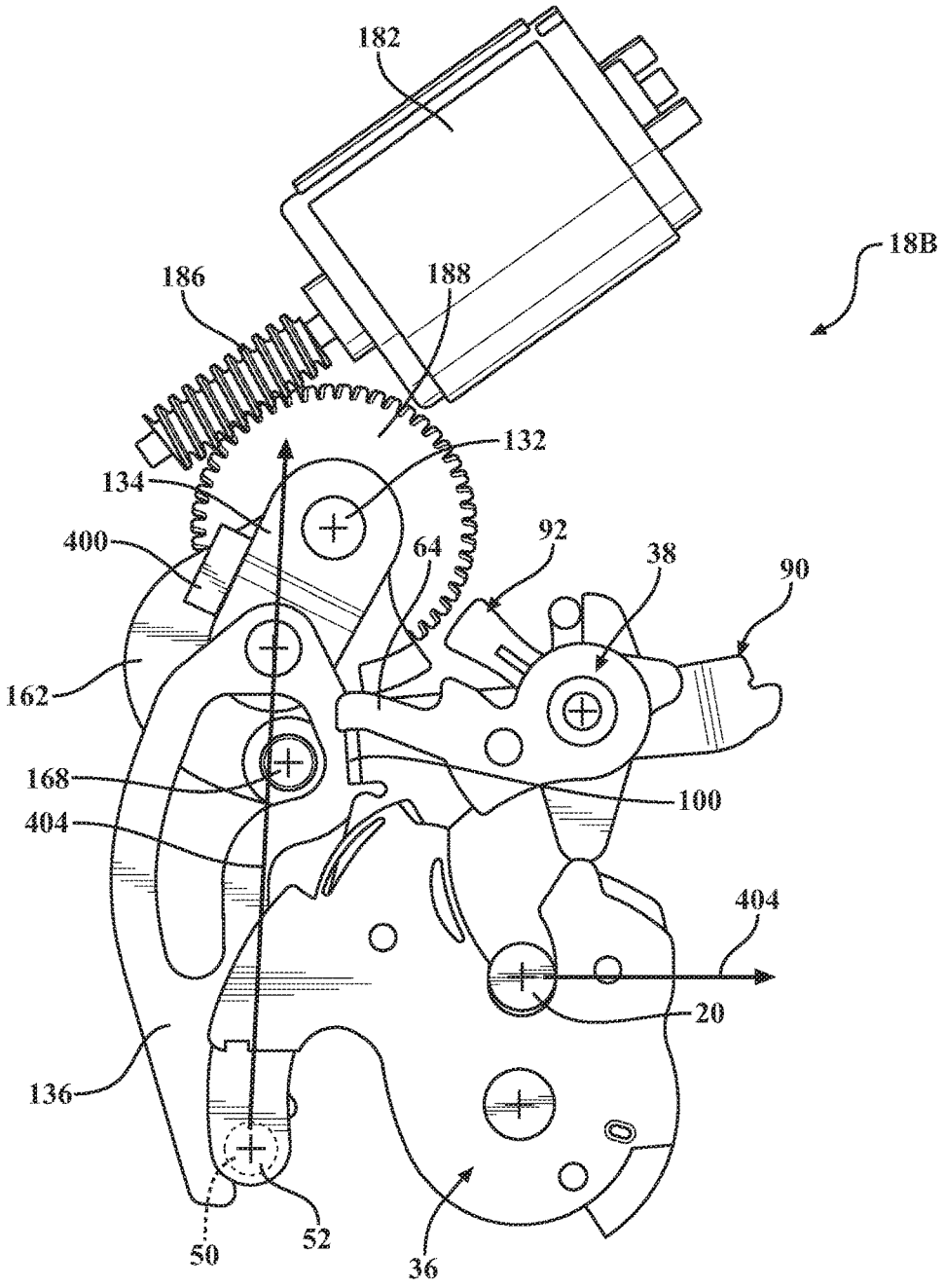
Figure 25:
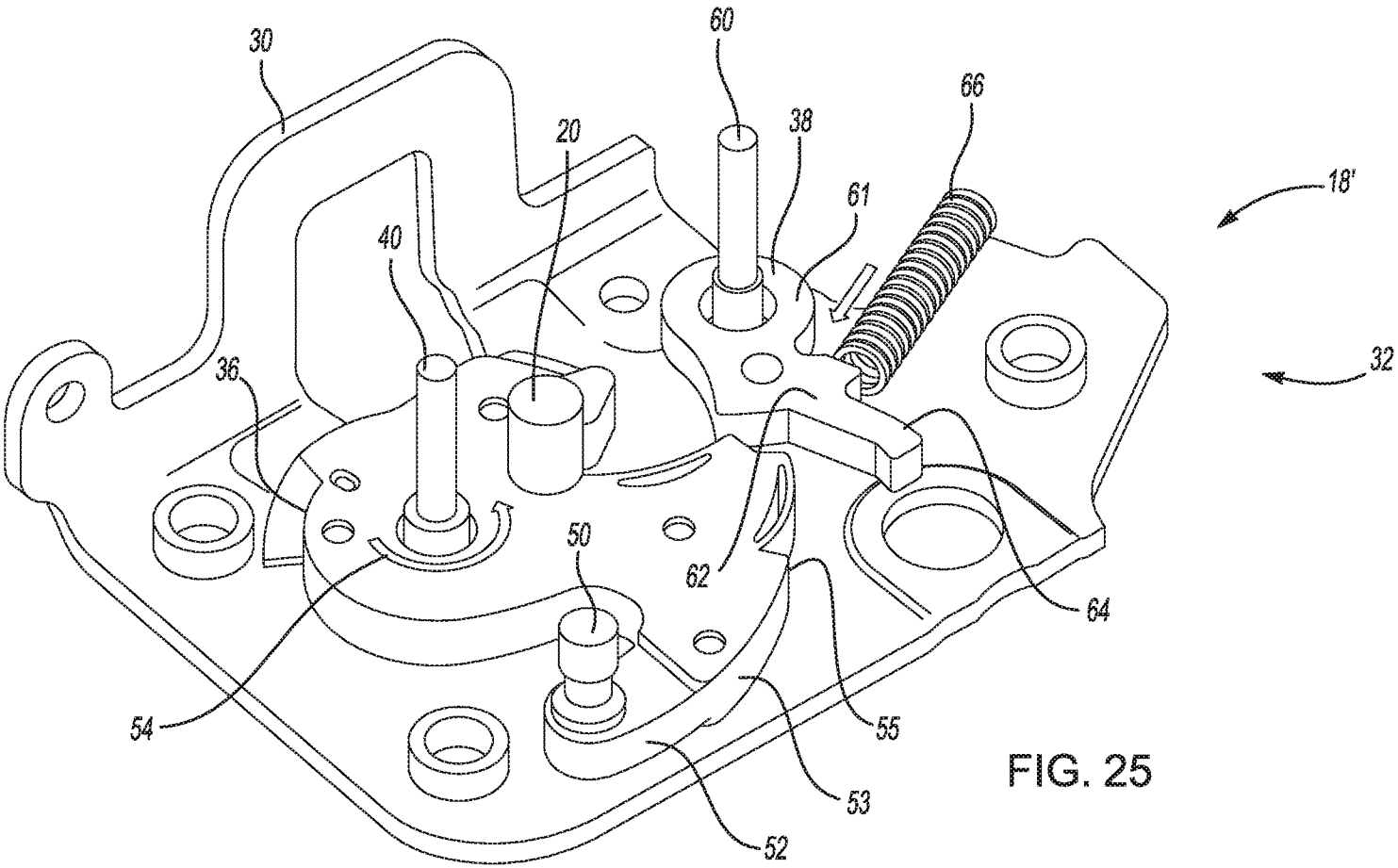
Figure 26:
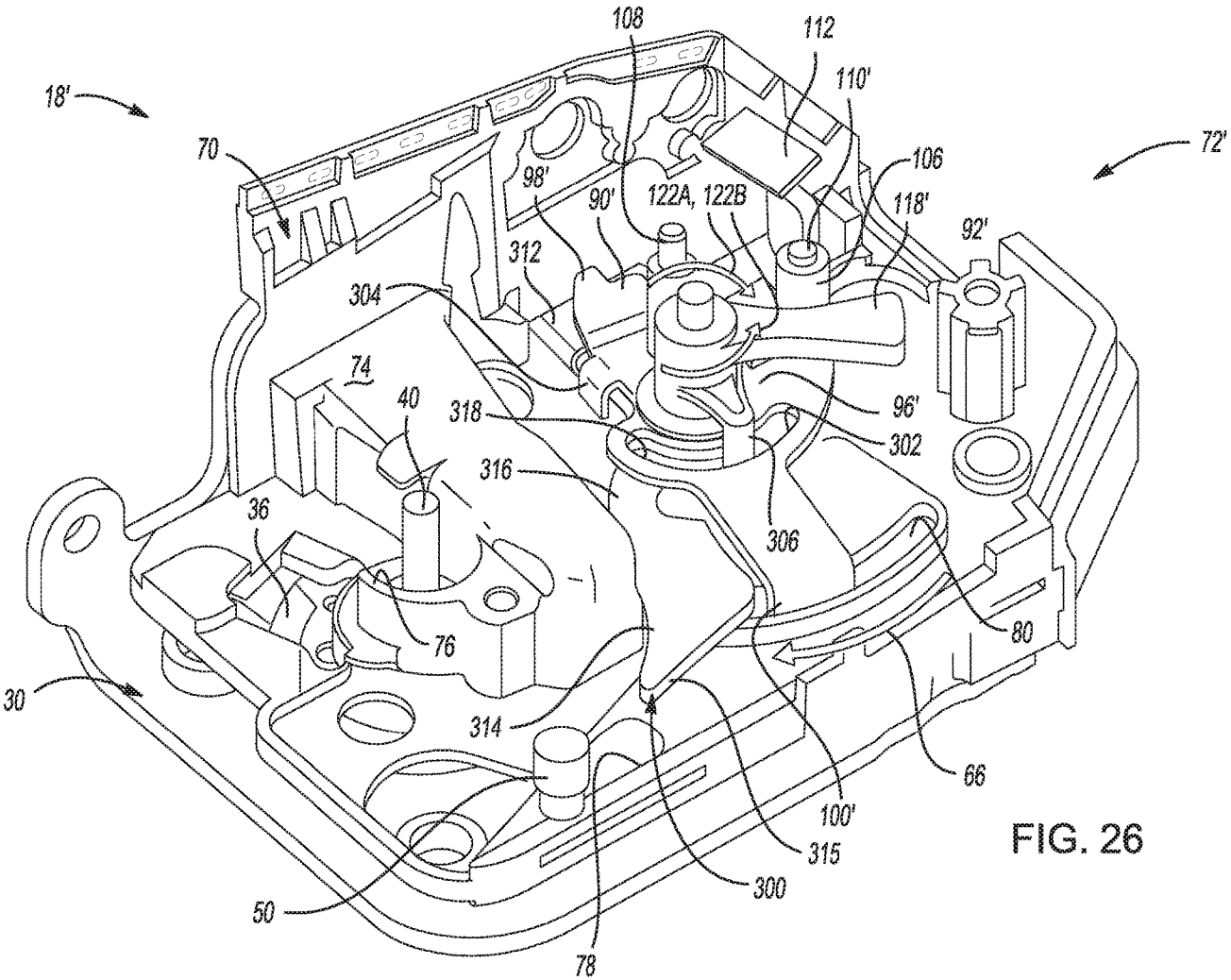
Figure 27:
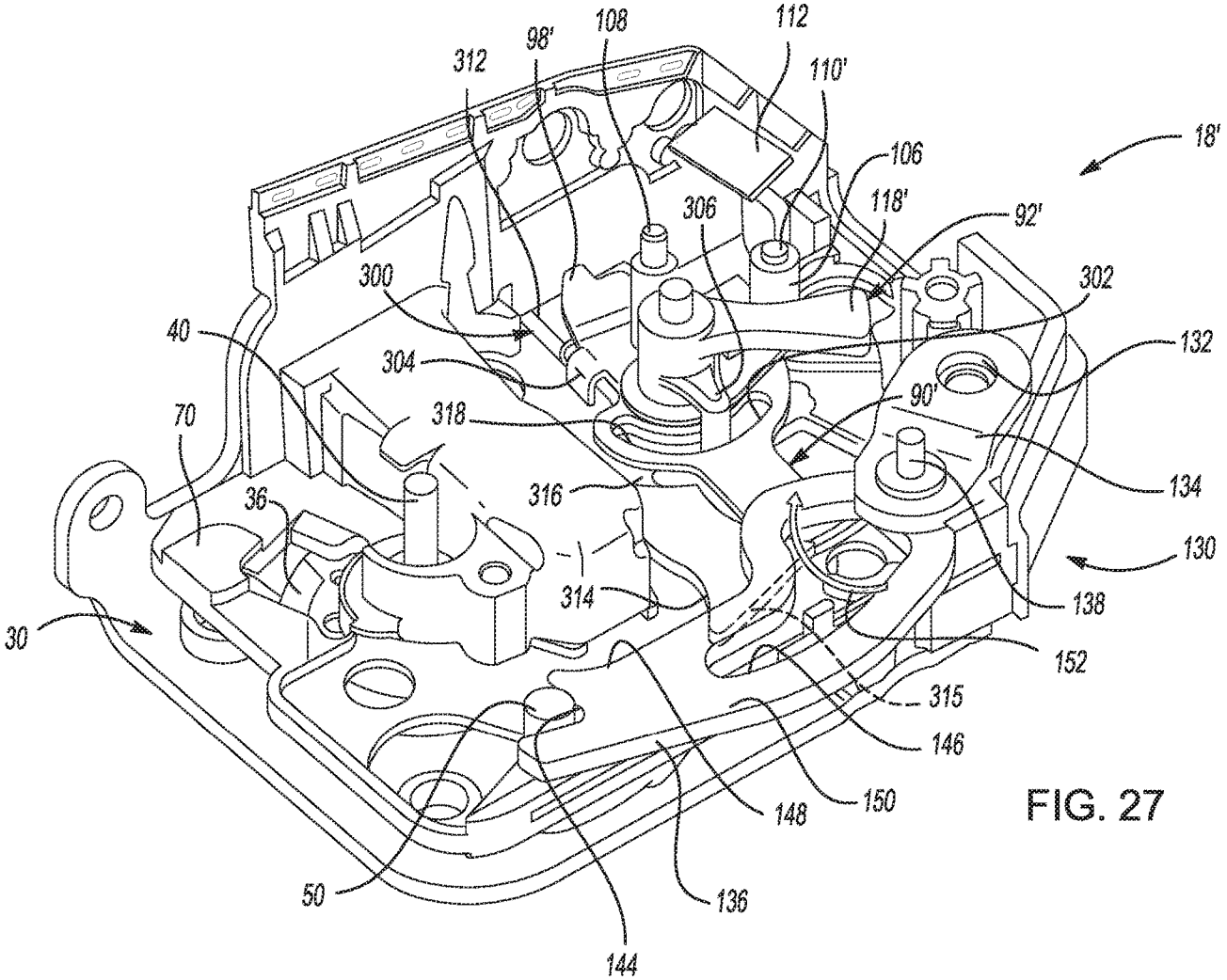
Figure 28:
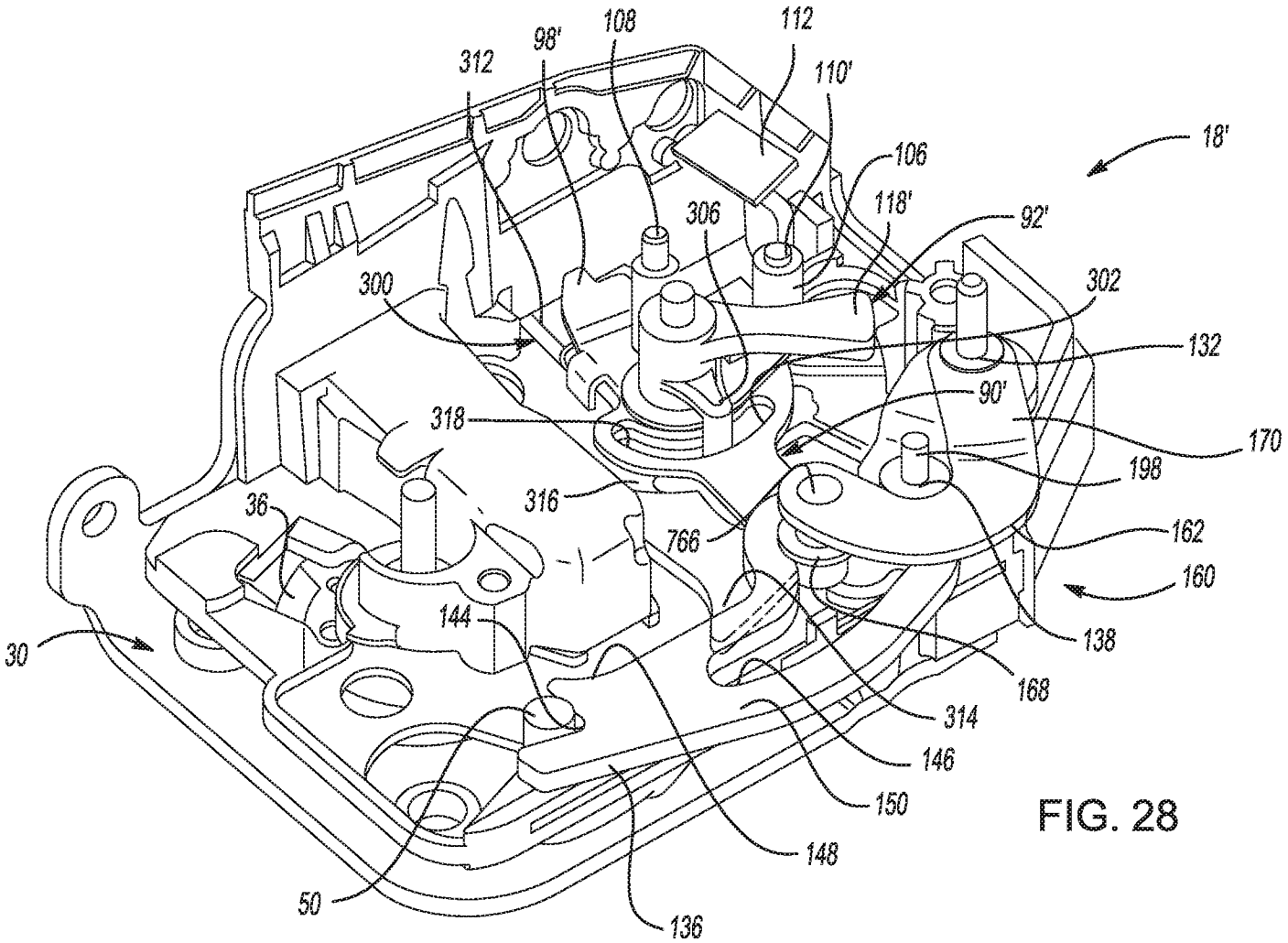
Figure 29:
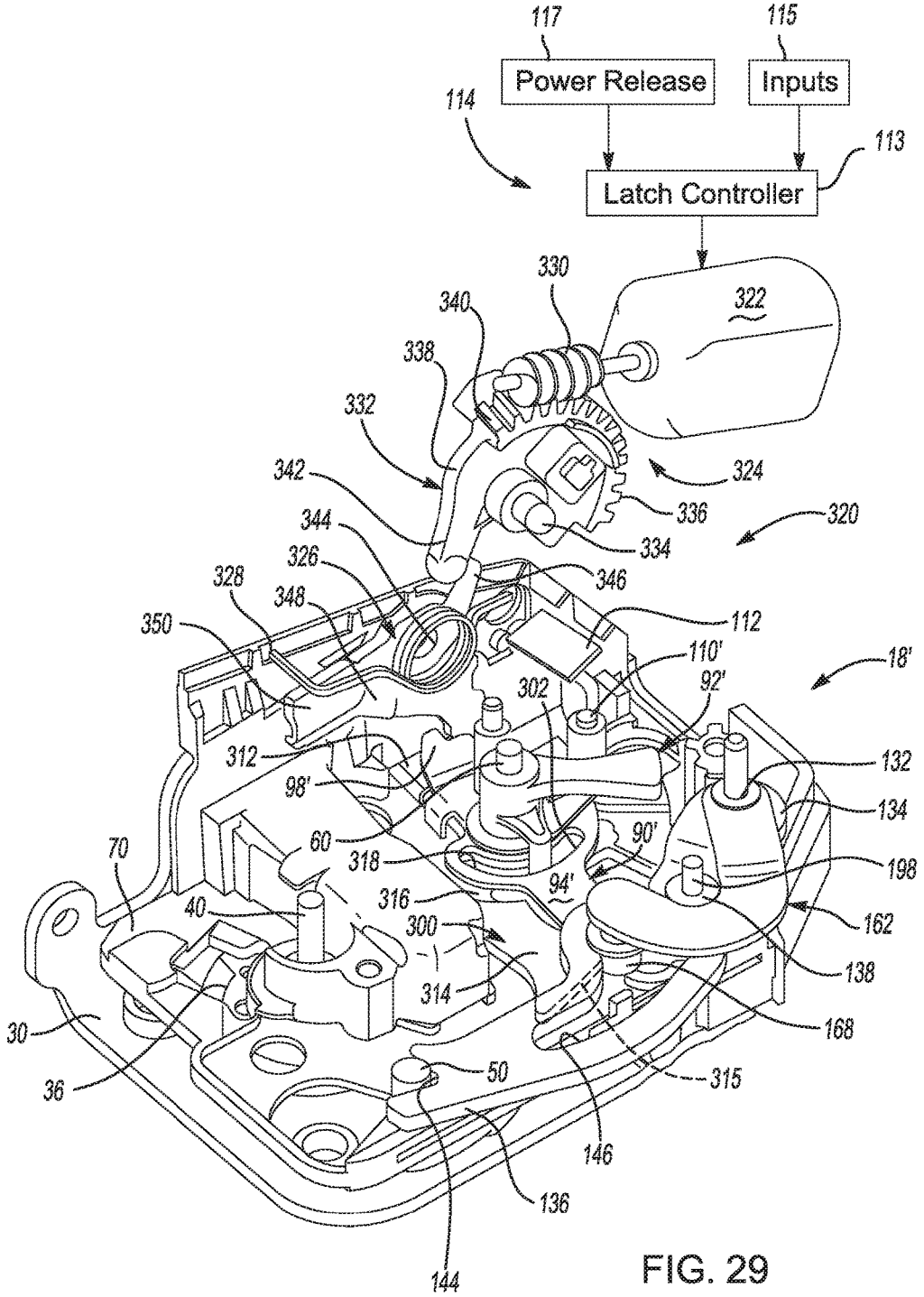
Figure 30:
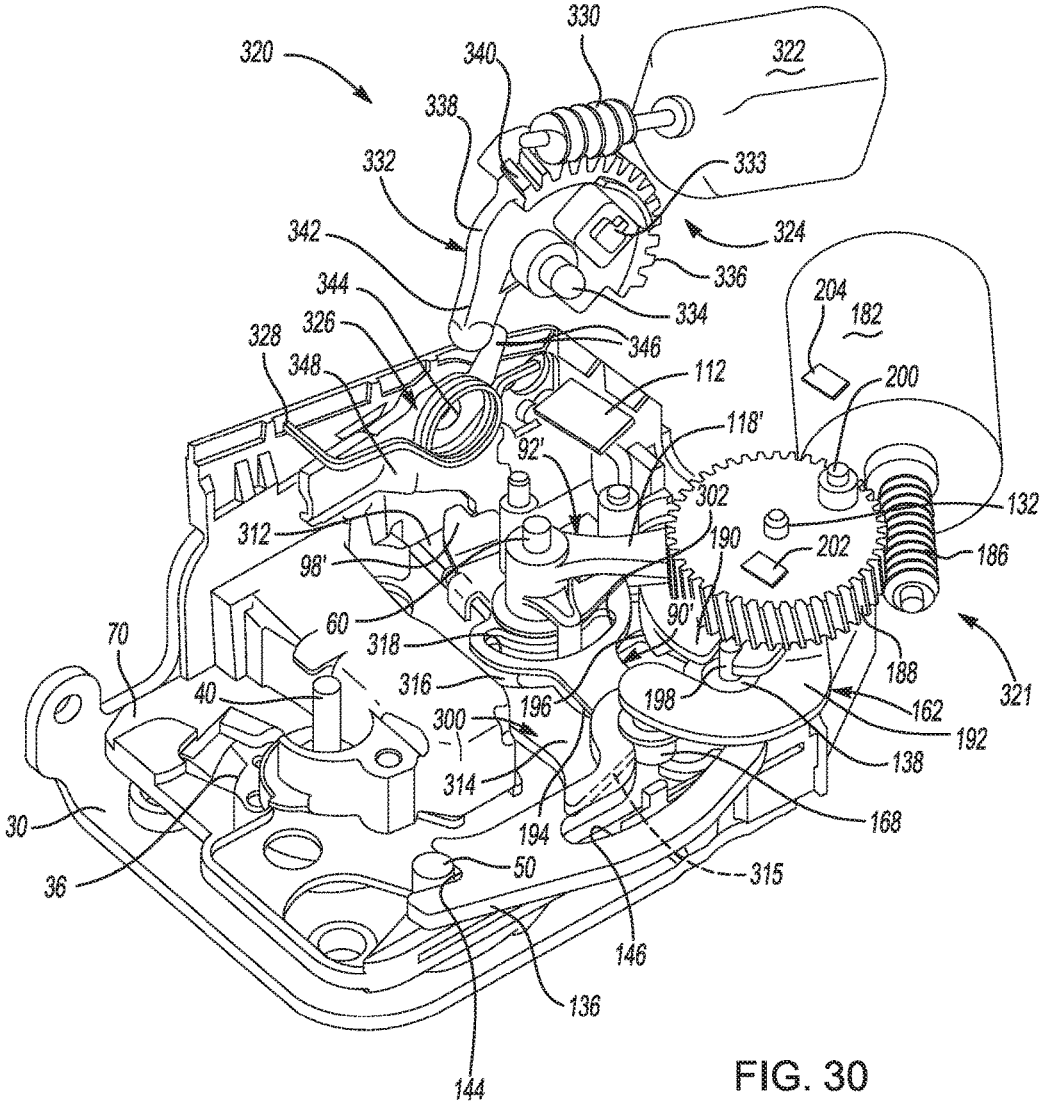
Figure 31:
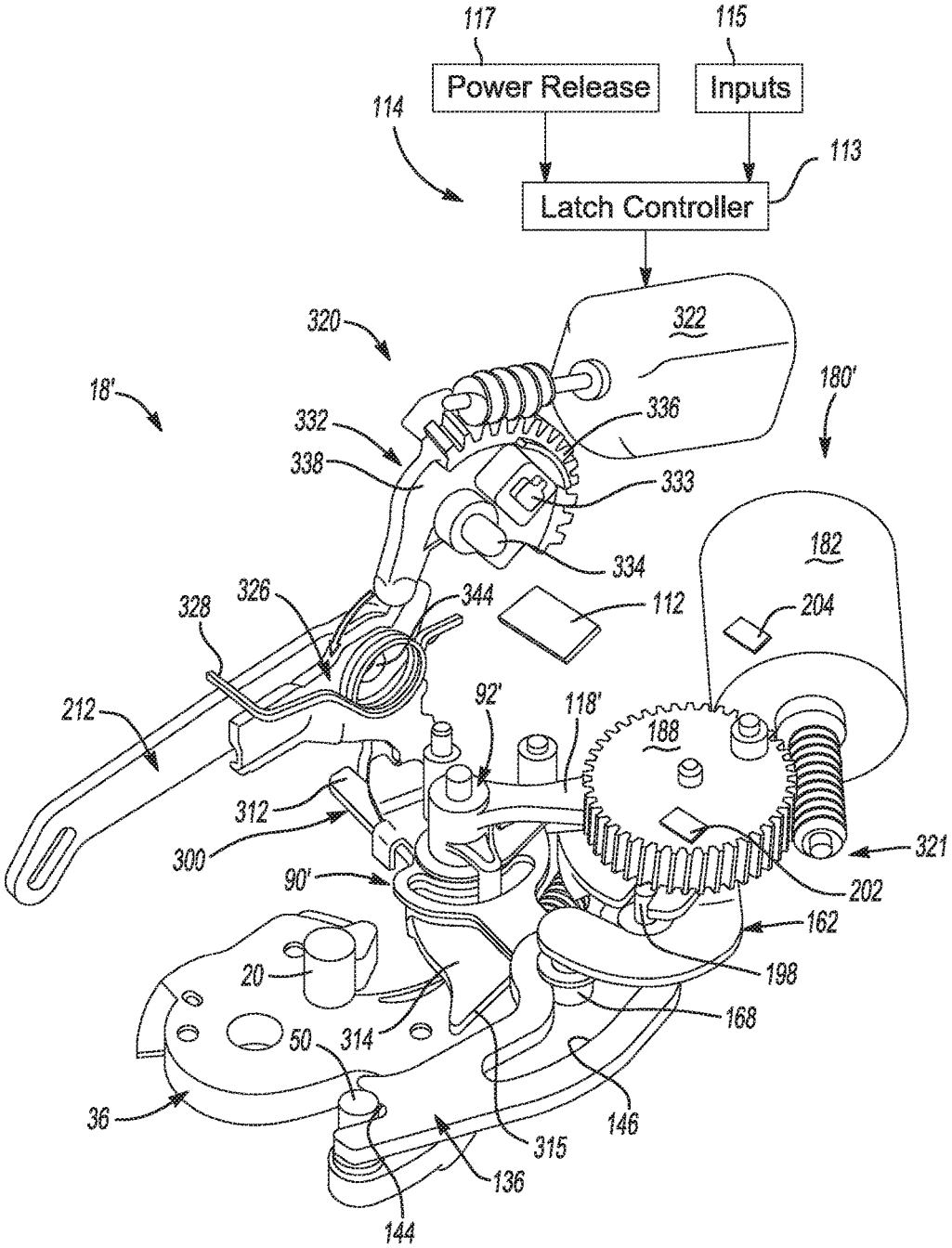

FIGS. 13A through 13C respectively illustrate orientations of the ratchet and pawl components of the latch mechanism for establishing the first, second and third closed positions of the closure panel;

FIGS. 14A and 14B illustrate different orientations of the ratchet and pawl components of the latch mechanism and the cinch lever and cinch link lever components of the latch cinch mechanism during a power cinching operation of the power latch assembly causing movement of the closure panel from its first closed position into its third closed position (FIG. 14A) and from its second closed position into its third closed position (FIG. 14B);

FIGS. 15A through 15K illustrate a series of sequential isometric views showing the interaction and relative movement of various components of the one-motor power latch assembly upon movement of the closure panel from its open position into its third closed position via operation of a power cinching feature in accordance with the present disclosure;

FIGS. 16A through 16K are a series of sequential top elevational views of the one-motor power latch assembly which correspond to FIGS. 15A through 15K and which further illustrate the power cinching feature;

FIGS. 17A through 17K are a series of sequential bottom elevational views of the one-motor power latch assembly which also correspond to FIGS. 15A through 15K and which further illustrate the power cinching feature;

FIGS. 15L, 16L and 17L are an isometric view and top and bottom elevational views of the one-motor power latch assembly illustrating a safety latching feature provided during a vehicular collision event;

FIGS. 18A through 18G illustrate a series of sequential isometric views showing the interaction and relative movement of the components of the one-motor power latch assembly upon movement of the closure panel from its third closed position into its open position via operation of a power release feature and which provides a soft open function in accordance with the present disclosure;

FIGS. 19A through 19G illustrate a series of sequential top elevational views corresponding to FIGS. 18A through 18G to further illustrate the soft open function provided by the power release feature of the one-motor power latch assembly;

FIGS. 20A through 20G illustrate a series of sequential bottom elevational views also corresponding to FIGS. 18A through 18G to further illustrate the soft open function provided by the power release feature;

FIGS. 21A through 21E illustrate a series of sequential isometric views showing the interaction and relative movement of various components of the one-motor power latch assembly upon mechanical actuation of an inside latch release mechanism for moving the closure panel from its third closed position to its open position to provide an inside release feature in accordance with the present disclosure;

FIGS. 22A through 22E illustrate a series of sequential isometric views showing the interaction and relative movement of various components of the one-motor power latch assembly upon mechanical actuation of the outside latch release mechanism for moving the closure panel from its third closed position to its door open position to provide an outside release feature in accordance with the present disclosure;

FIG. 23 is an isometric view of an alternative version of the one-motor power latch assembly constructed in accordance with a second embodiment of the present disclosure and showing the components thereof positioned when the closure panel is located in its third or cinched closed position;

FIG. 24 is an isometric view of another alternative version of the one-motor power latch assembly constructed in accordance with a third embodiment of the present disclosure showing the position of its components when the closure panel is located in its third or cinched closed position;

FIG. 25 is an isometric view showing components of a pawl and ratchet latch mechanism associated with a two-motor power latch assembly constructed in accordance with a fourth embodiment of the present disclosure;

FIG. 26 is an isometric view showing components of a latch release mechanism associated with the two-motor power latch assembly of the present disclosure;

FIG. 27 is an isometric view showing components of a latch cinch mechanism associated with the two-motor power latch assembly of the present disclosure;

FIG. 28 is an isometric view showing components of a cinch disengage mechanism associated with the two-motor power latch assembly of the present disclosure;

FIG. 29 is an isometric view showing components of a power release actuator mechanism associated with the two-motor power latch assembly of the present disclosure;

FIG. 30 is an isometric view showing components of a power cinch actuator mechanism associated with the two-motor power latch assembly of the present disclosure;

FIG. 31 is an isometric view showing components of an inside release mechanism associated with the two-motor power latch assembly of the present disclosure;

FIGS. 32A through 32F illustrate a series of sequential isometric views showing the interaction and relative movement of various components of the two-motor power latch assembly upon movement of the closure panel from its third closed position into its open position via operation of the power release feature providing the soft open function in accordance with the present disclosure;

FIGS. 33A through 33F illustrate a series of sequential bottom elevational views of the two-motor power latch assembly which correspond to FIGS. 32A through 32F to better illustrate the power release feature; and FIGS. 34A through 34E illustrate a series of sequential isometric views showing the interaction and relative movement of various components of the two-motor power latch assembly upon mechanical actuation of the inside release mechanism for permitting movement of the closure member from its third closed position to its open position to provide the inside release feature.

Corresponding reference numerals are used to indicate corresponding components throughout the several views of the drawings.

DETAILED DESCRIPTION

Example embodiments will now be described more fully with reference to the accompanying drawings. To this end, the example embodiments are provided so that this disclosure will be thorough, and will fully convey its intended scope to those who are skilled in the art. Accordingly, numerous specific details are set forth such as examples of specific components, devices, and methods, to provide a thorough understanding of embodiments of the present disclosure. However, it will be apparent to those skilled in the art that specific details need not be employed, that example embodiments may be embodied in many different forms, and that neither should be construed to limit the scope of the present disclosure. In some example embodiments, well-known processes, well-known device structures, and well-known technologies are not described in detail.

In the following detailed description, the expression "power latch assembly" will be used to generally indicate any power-operated latch device adapted for use with a vehicle closure panel to provide a power cinch feature in combination with a soft opening function with or without a power release feature. Additionally, the expression "closure panel" will be used to indicate any element moveable between an open position and at least one closed position, respectively opening and closing an access to an inner compartment of a motor vehicle and therefore includes, without limitations, decklids, tailgates, liftgates, bonnet lids, and sunroofs in addition to the sliding or pivoting side passenger doors of a motor vehicle to which the following description will make explicit reference, purely by way of example.

Figure 1:
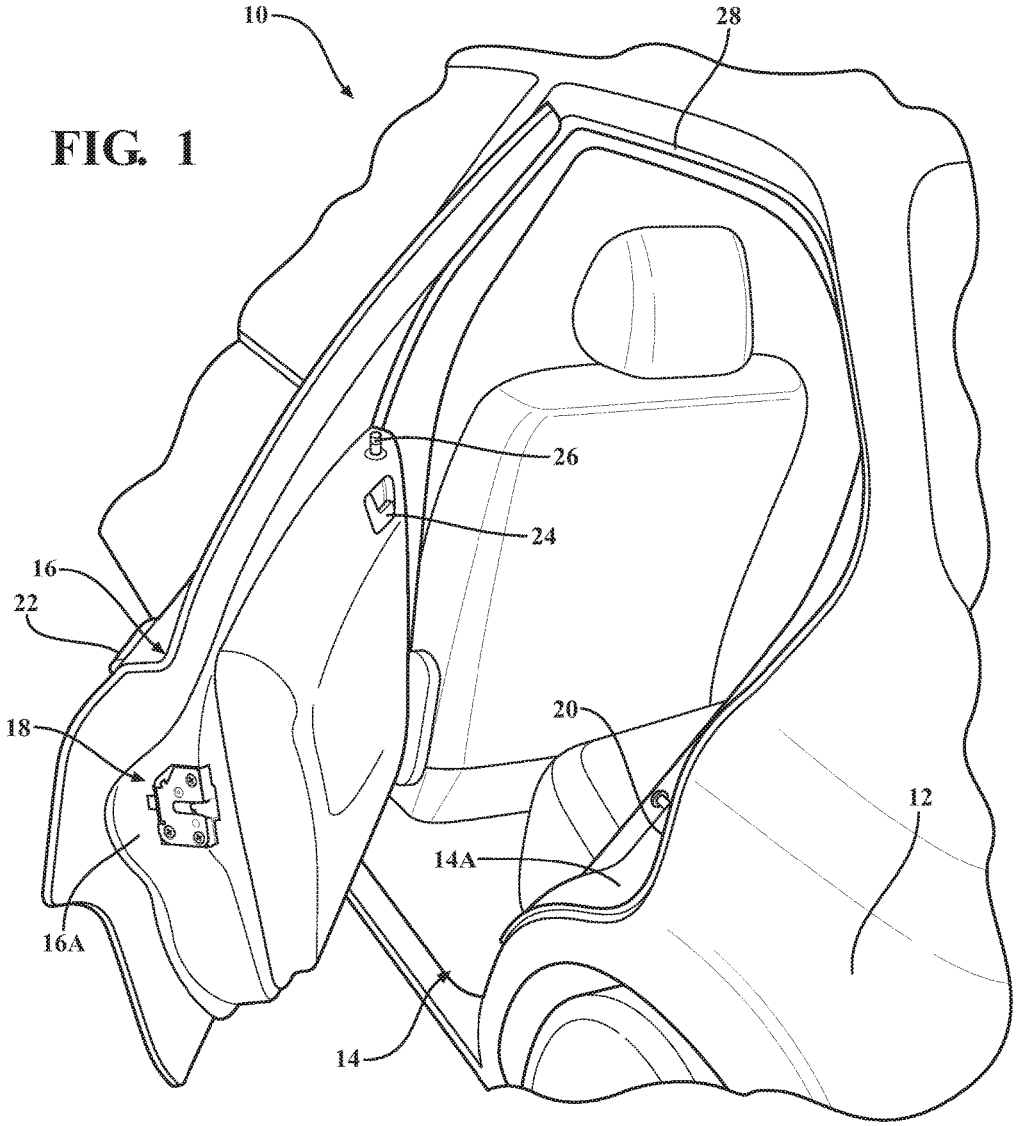
FIG. 1 is a partial perspective view of a motor vehicle having a closure panel equipped with a power latch assembly that is constructed in accordance with the teachings of the present disclosure.

Referring initially to FIG. 1 of the drawings, a motor vehicle 10 is shown to include a vehicle body 12 defining an opening 14 to an interior passenger compartment. A closure panel 16 is pivotably mounted to body 12 for movement between an open position (shown) and a fully closed position to respectively open and close opening 14. A power latch assembly 18 is rigidly secured to closure panel 16 adjacent to an edge portion 16A thereof and is releasably engageable with a striker 20 that is fixedly secured to a recessed edge portion 14A of opening 14. As will be detailed, power latch assembly 18 is operable to engage striker 20 and releaseably move closure panel 16 into its fully closed position. An outside handle 22 and an inside handle 24 are provided for actuating power latch assembly 18 to release striker 20 and permit subsequent movement of closure panel 16 to its open position. An optional lock knob 26 is shown which provides a visual indication of the locked state of latch assembly 18 and which may also be operable to mechanically change the locked state of latch assembly 18. A weather seal 28 is mounted on edge portion 14A of opening 14 in vehicle body 12 and is adapted to be resiliently compressed upon engagement with a mating sealing surface of closure panel 16 when closure panel 16 is held by latch assembly 18 in its closed position so as to provide a sealed interface therebetween which is configured to prevent entry of rain and dirt into the passenger compartment while minimizing audible wind noise. For purpose of clarity and functional association with motor vehicle 10, the closure panel is hereinafter referred to as passenger door 16.

Figure 8:
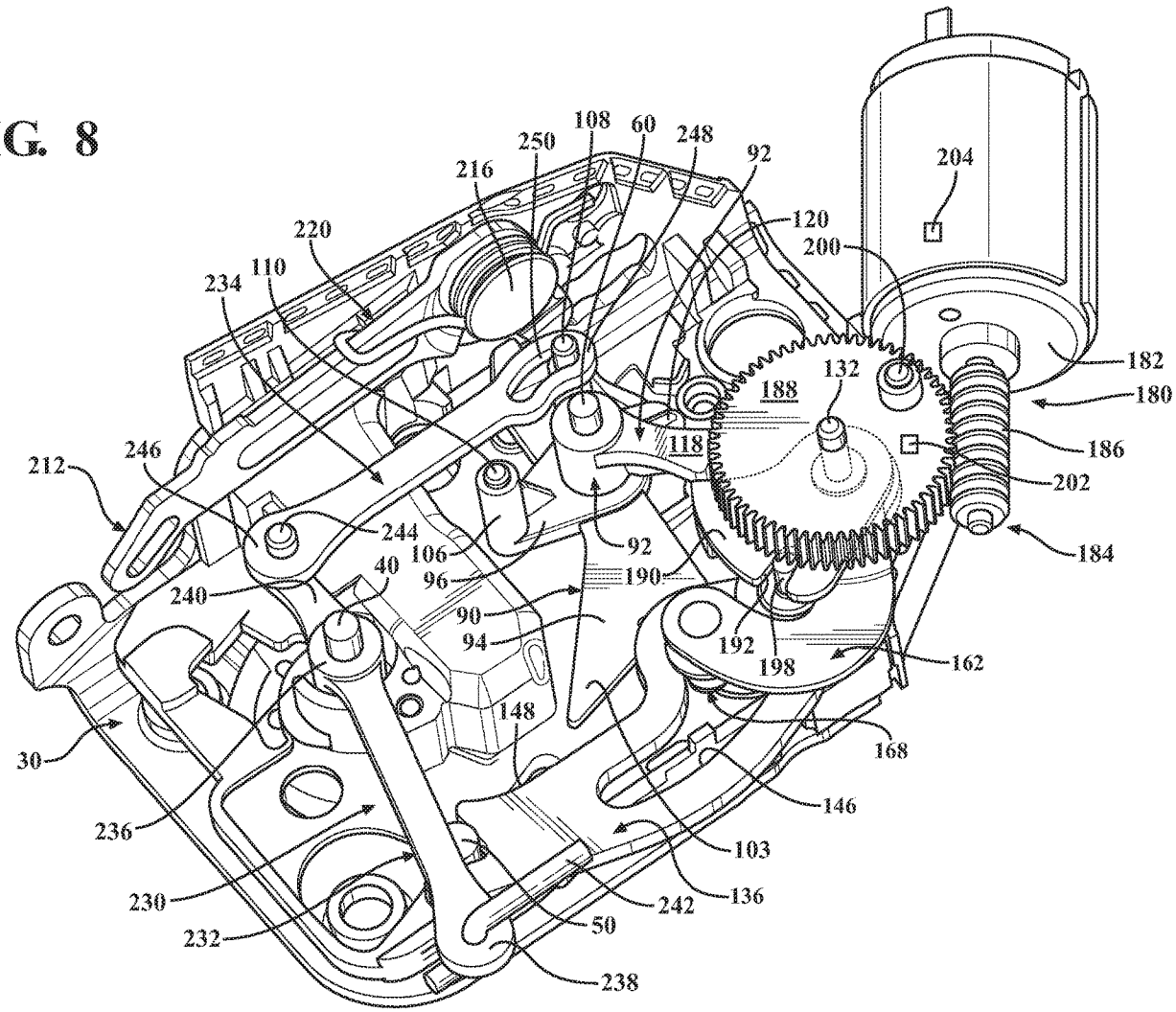
FIG. 8 is another isometric view of the one-motor power latch assembly showing various components of an outside release mechanism operably associated with the latch release mechanism of FIG. 3.
Figure 9B:
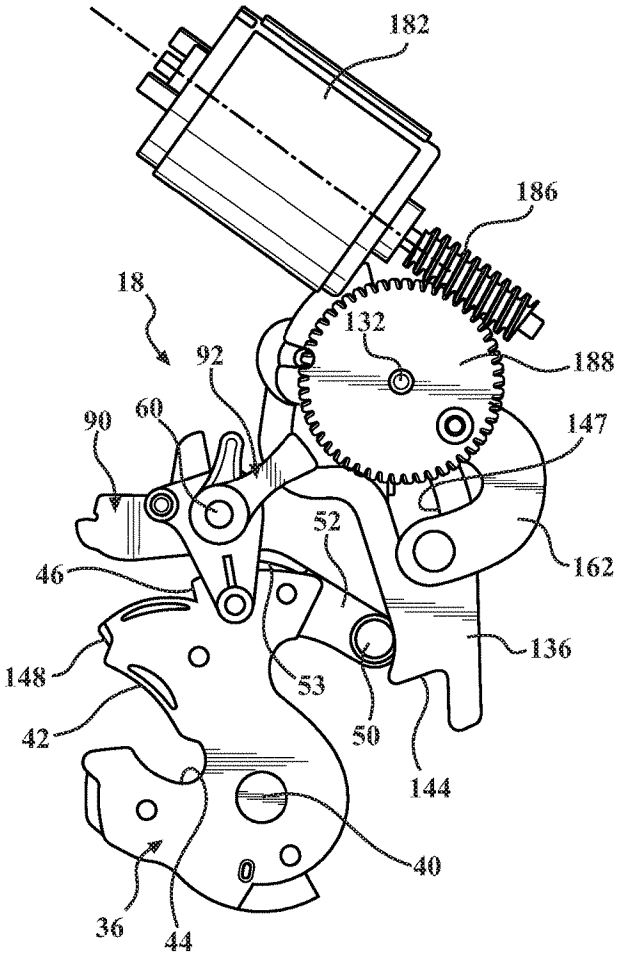
FIGS. 9A and 9B are views of the one-motor power latch assembly showing the position of its various components when the closure panel is located in an open position.
Figure 9A:
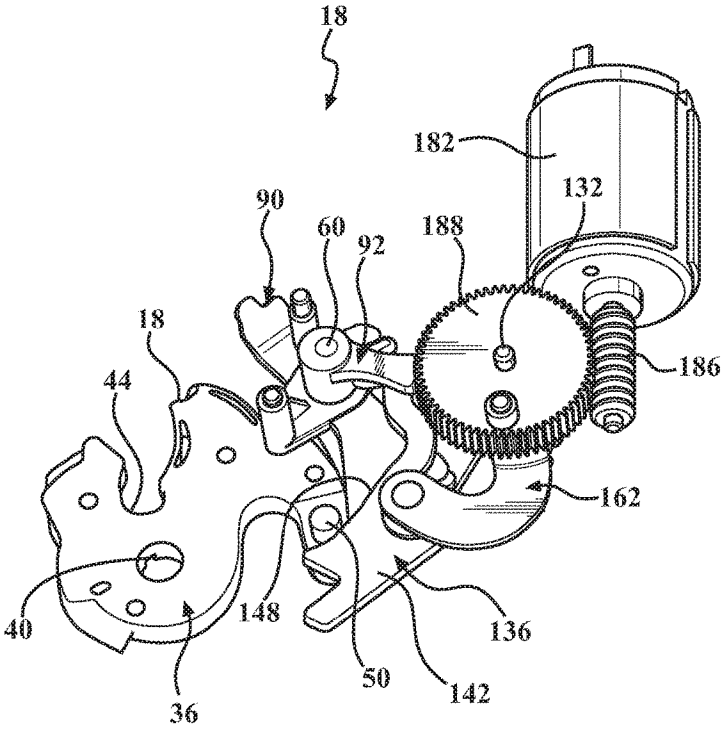
Figure 10B:
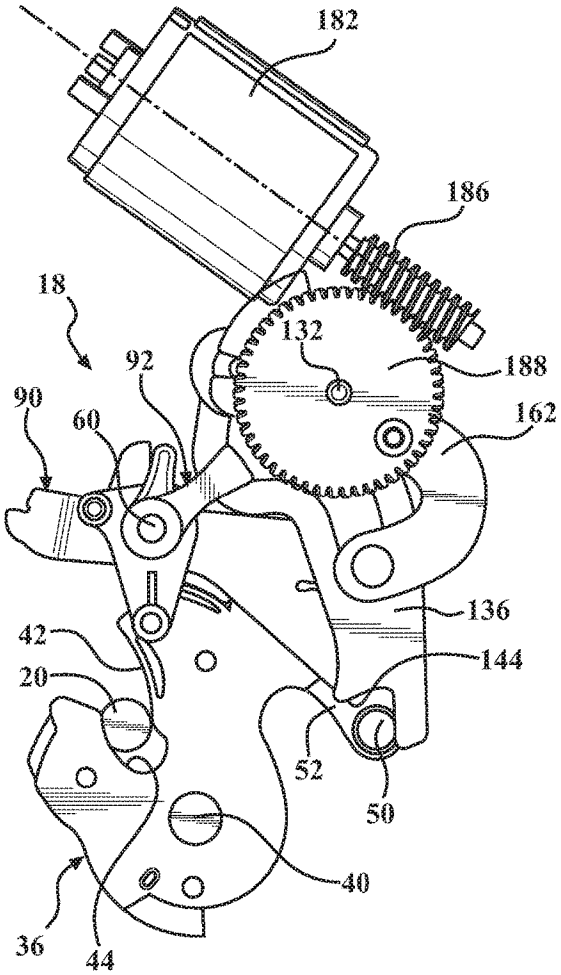
FIGS. 10A and 10B are views of the one-motor power latch assembly showing the position of its various components when the closure panel has moved from the open position into a first or "soft" closed position.
Figure 10A:
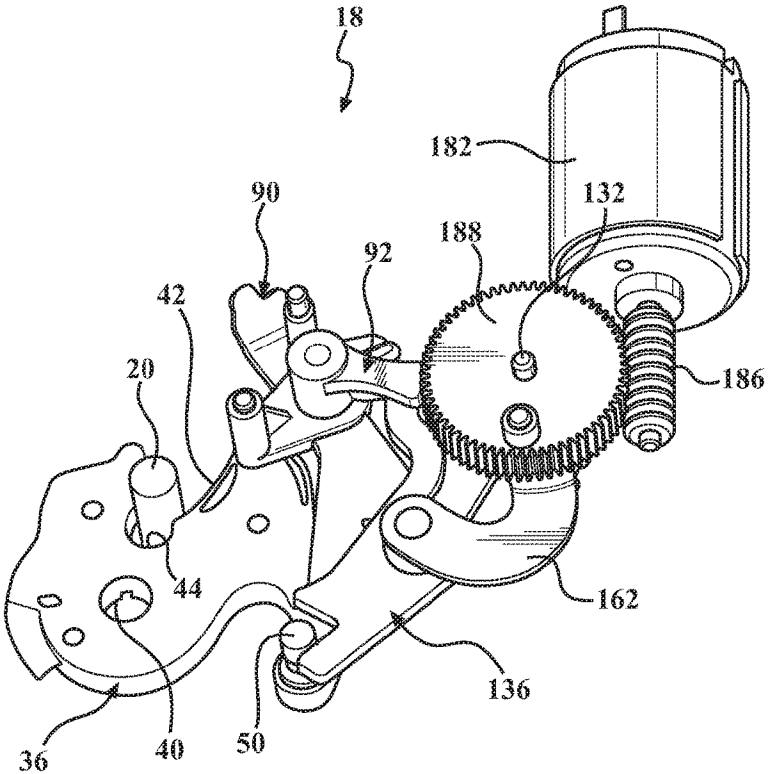
Figure 11B:
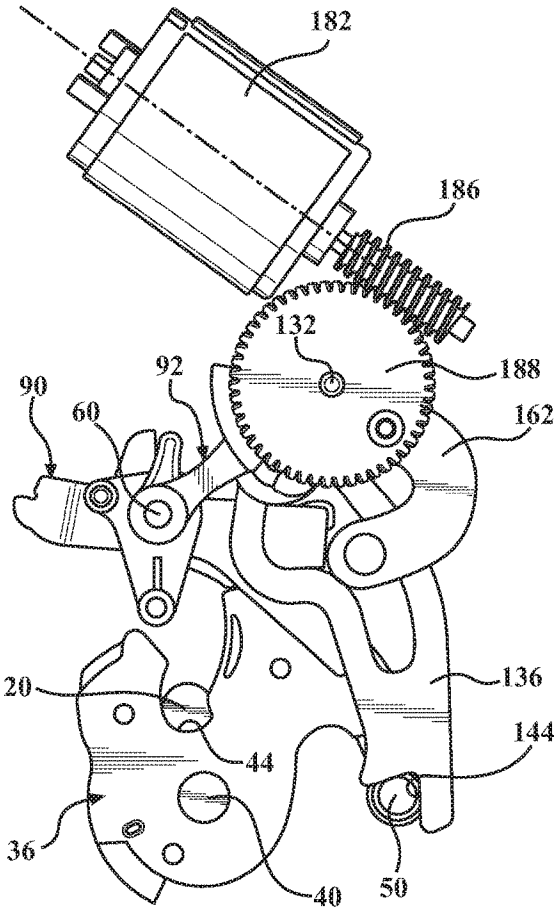
FIGS. 11A and 11B are views of the one-motor power latch assembly showing the position of its various components when the closure panel has moved from the first closed position into a second or "hard" closed position.
Figure 11A:
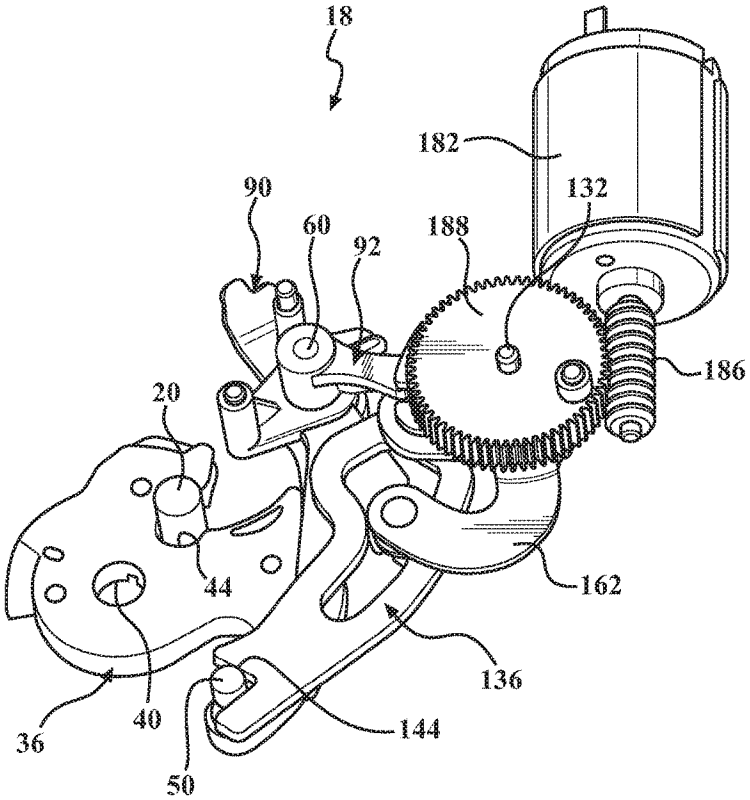
Figure 12B:
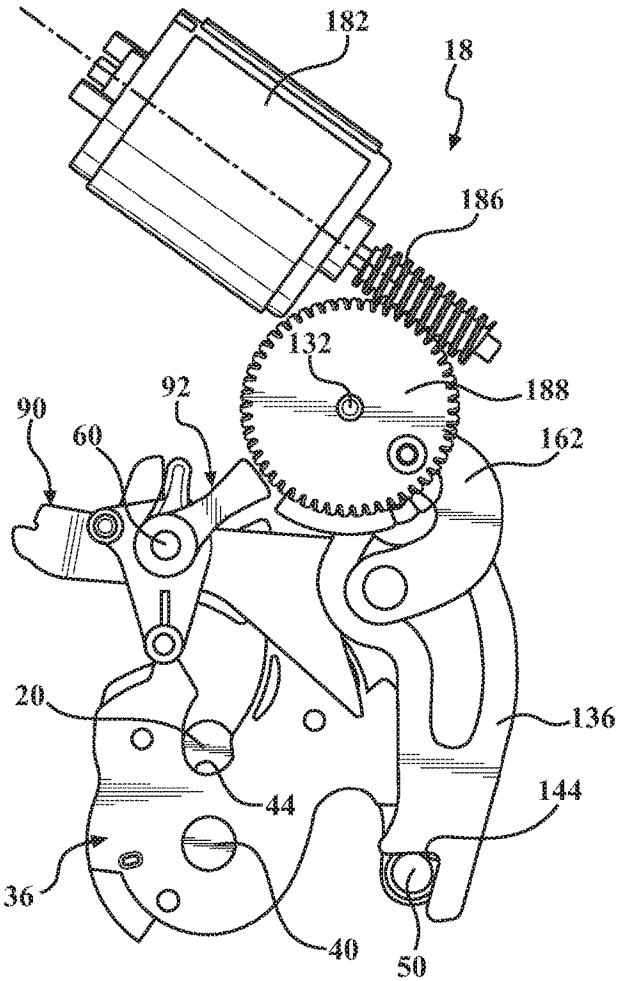
FIGS. 12A and 12B are views of the one-motor power latch assembly showing the position of its various components when the closure panel has moved from the second closed position into a third or "cinch" closed position.
Figure 12A:
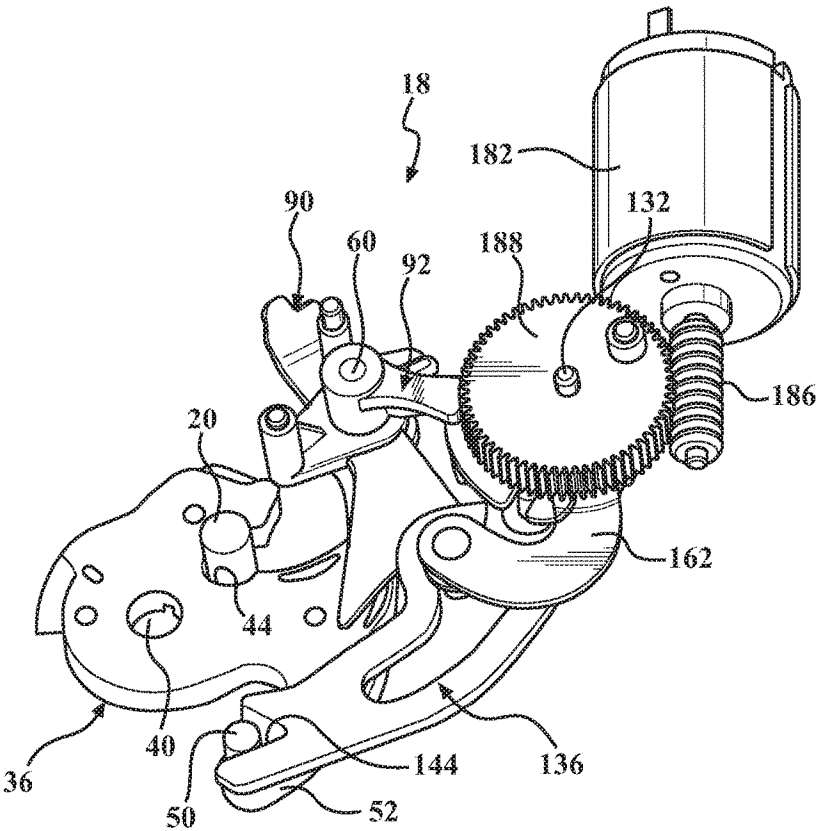

A detailed description of non-limiting embodiments of a single-motor power latch assembly 18, constructed in accordance with the teaching of the present disclosure, will now be provided. In general, FIGS. 2 through 8 illustrate a series of similar views sequentially showing a "built-up" construction of power latch assembly 18 comprising: a latch mechanism 32 (FIG. 2); a latch release mechanism 72 (FIG. 3); a latch cinch mechanism 130 (FIG. 4); a cinch disengage mechanism 160 (FIG. 5); an actuator mechanism 180 (FIG. 6); an inside release mechanism 210 (FIG. 7); and an outside release mechanism 230 (FIG. 8). FIGS. 9A and 9B illustrate various components of power latch assembly 18 oriented to establish a "released" mode when door 16 is located in an open position. FIGS. 10A and 10B illustrate various components of power latch assembly 18 oriented to establish a "first safety latched" mode when door 16 is located in a first or soft closed position. FIGS. 11A and 11B illustrate various components of power latch assembly 18 oriented to establish a "second safety latched" mode when door 16 is located in a second or hard closed position. Finally, FIGS. 12A and 12B illustrate various components of power latch assembly 18 oriented to establish a "cinch latched" mode when door 16 is located in a third or cinched closed position.

FIGS. 15A through 15K, FIGS. 16A through 16K and FIGS. 17A through 17K provide a coordinated series of sequential views which clearly illustrate the relative movement of various components associated with power latch assembly 18 to provide a "power cinch" feature and establish the cinch latched mode. Additionally, FIGS. 15L, 16L and 17L illustrate various components of power latch assembly 18 oriented to provide a mechanical latching feature upon motor vehicle 10 experiencing a collision impact for establishing a "blocking safety latched" mode. Similarly, FIGS. 18A through 18G, FIGS. 19A through 19G and FIGS. 20A through 20G provide a coordinated series of sequential views illustrating the relative movement of various components associated with power latch assembly 18 to provide a "power release" feature and establish the released mode. As will be detailed, FIGS. 18A-18C, FIGS. 19A-19C and FIGS. 20A-20C also illustrate the various components of power latch assembly 18 positioned for shifting from the cinch latched mode into a "cinch released" mode as part of an uncinching/soft opening function provided by the power release feature. FIGS. 21A through 21E provide a series of sequential views illustrating actuation of inside release mechanism 210 for opening door 16 using inside door handle 24 during certain non-powered conditions. Finally, FIGS. 22A through 22E provide a series of sequential views illustrating actuation of outside release unit 230 for opening door 16 using outside door handle 22 during certain non-powered conditions.

Figure 2:
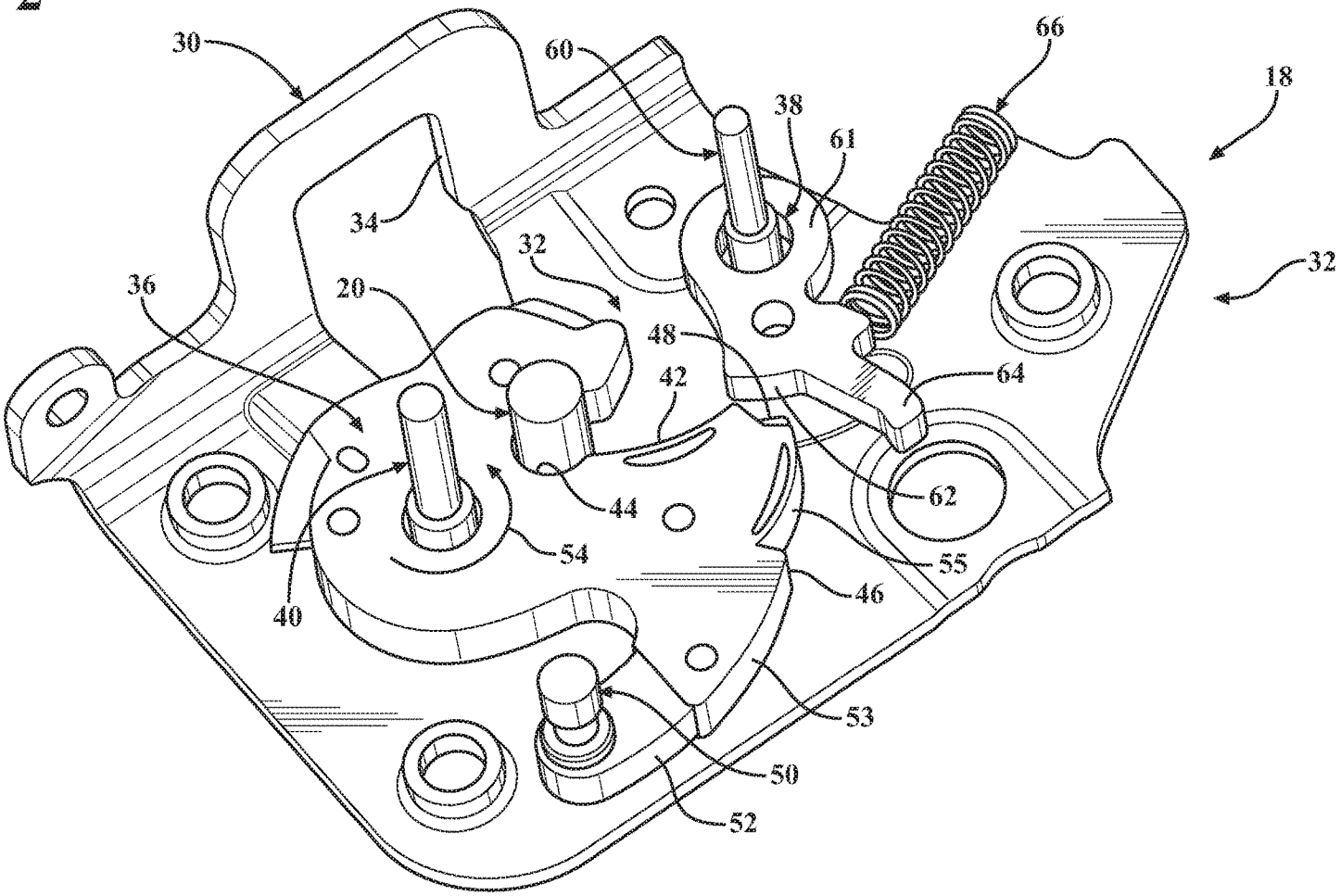
FIG. 2 is an isometric view of a one-motor power latch assembly constructed in accordance with a first embodiment of the present disclosure and showing various components associated with a pawl and ratchet type of latch mechanism.

Referring now to FIG. 2, the one-motor version of power latch assembly 18 is shown to include a frame plate 30 and latch mechanism 32. Frame plate 30 is a rigid component configured to be fixedly secured to edge portion 16A of door 16 and defines an entry aperture 34 through which striker 20 travels upon movement of door 16 toward and away from its closed positions. Latch mechanism 32 is shown, in this non-limiting example, as a single pawl arrangement generally including a ratchet 36 and a pawl 38. Ratchet 36 is supported for pivotal movement on a ratchet pivot pin 40 extending outwardly from frame plate 30. Ratchet 36 is configured to include a contoured guide channel 42 which terminates in a striker capture pocket 44, a first safety latch surface 46 and a second safety latch surface 48. A projection, such as an upstanding ratchet lug or rivet 50, extends outwardly from a leg segment 52 of ratchet 36. Ratchet 36 is further configured to include a first cam edge surface 53 formed between leg segment 52 and first safety latch surface 46, and a second cam edge surface 55 formed between first safety latch surface 46 and second safety latch surface 48. A ratchet biasing member, schematically shown by arrow 54, is adapted to normally bias ratchet 36 to rotate in a first or releasing direction (counterclockwise in FIG. 2). Ratchet 36 is shown in FIG. 2 rotated and held in a second or latching direction such that striker 20 is retained in capture pocket 44 and prevented from release through guide channel 42. As will be detailed, ratchet 36 is pivotably moveable between a plurality of distinct positions including a striker release position (FIGS. 9A and 9B), a first or "soft close" striker capture position (FIGS. 10A and 10B), a second or "hard close" striker capture position (FIGS. 11A and 11B), and a third or "cinched" striker capture position (FIGS. 12A and 12B).

Pawl 38 is supported for pivotal movement on a pawl pivot pin 60 which extends outwardly from frame plate 30. Pawl 38 is configured to include a body segment 61 having an engagement surface 62 adapted, under certain conditions, to selectively and releaseably engage one of first safety surface 46 and second safety latch surface 48 of ratchet 36. Pawl 38 further includes a leg segment 64 extending outwardly from body segment 61. A pawl biasing member, such as coil spring 66, is provided for normally biasing pawl 38 in a first rotary direction (clockwise in FIG. 2) toward a ratchet checking position. Pawl 38 is shown located in its ratchet checking position in FIG. 2 while pawl 38 is shown in FIGS. 9A and 9B rotated in a second rotary direction into a ratchet release position.

Figure 3:
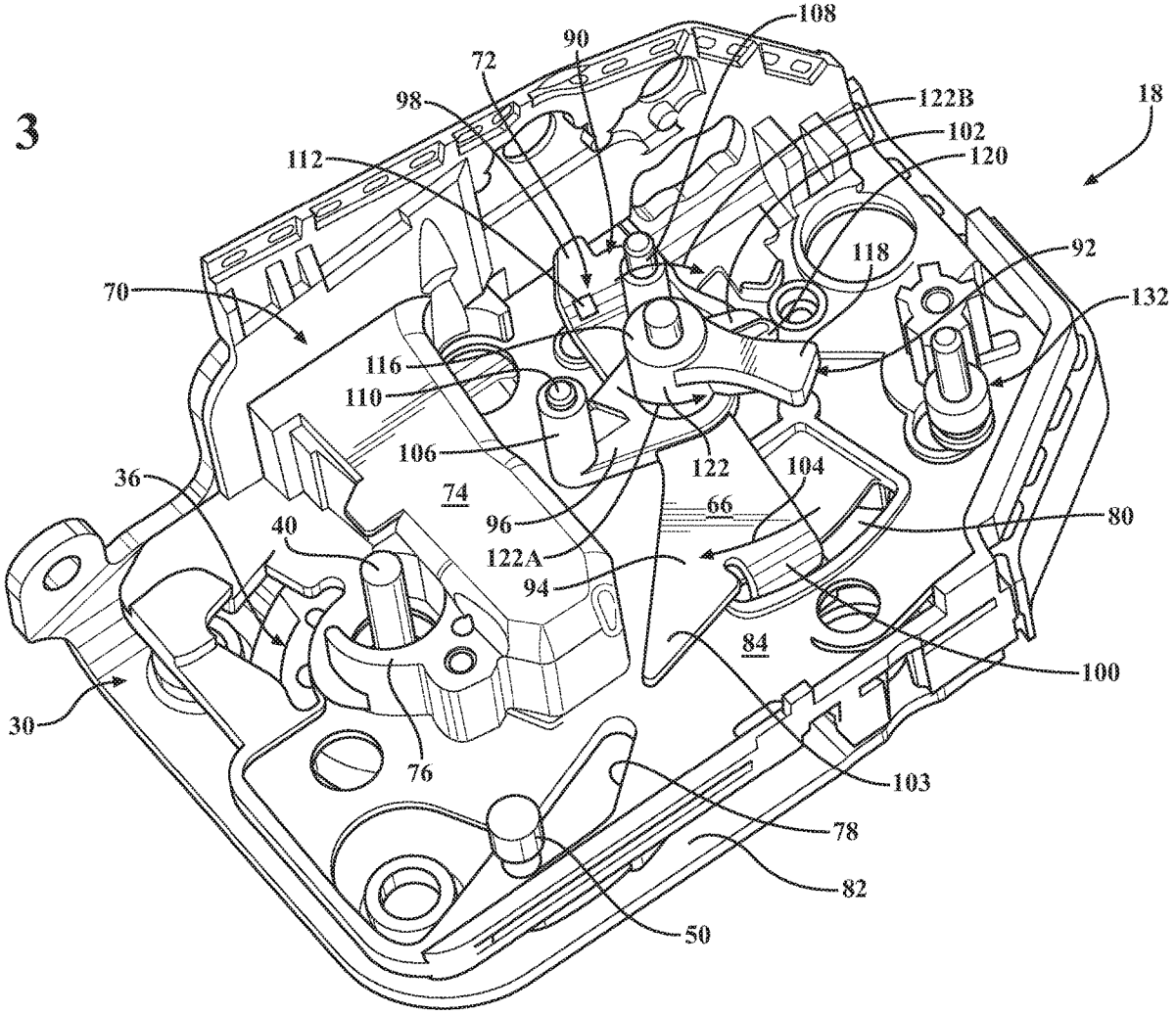
FIG. 3 is another isometric view of the one-motor power latch assembly showing various components of a latch release mechanism operably associated with the latch mechanism of FIG. 2.

FIG. 3 is generally similar to FIG. 2, but further illustrates power latch assembly 18 to include a latch housing 70 and a latch release mechanism 72 installed on frame plate 30. Latch housing 70 is configured to define a raised tunnel section 74 which overlies guide channel 42, a first boss section 76 through which ratchet pivot pin 40 extends, a second boss section (not shown) through which pawl pivot pin 60 extends, a first guide slot 78 through which ratchet rivet 50 extends, and a second guide slot 80. Latch housing 70 is adapted to be secured to frame plate 30 and is configured to locate latch mechanism 32 between a plate segment 82 of frame plate 30 and a plate segment 84 of latch housing 70.

Latch release mechanism 72 is best shown in FIG. 3 for engaging pawl 38 and being operable in a first latch release mode for locating pawl 38 in its ratchet checking position and in a second latch release mode for locating pawl 38 in its ratchet release position. To provide these two modes of operation, latch release mechanism 72 is shown to include a pawl lever 90 and a release lever 92, both of which are mounted for independent pivotal movement on pawl pivot pin 60. Pawl lever 90 includes an elongate plate segment 94 and a flange segment 96 which each define a common pivot bore (not shown) through which pawl pivot pin 60 extends. Plate segment 94 and flange segment 96 are either formed integrally or can be fixedly secured together for common pivotal movement about pawl pivot pin 60. Plate segment 94 is configured to have a first bent end segment 98, a second bent end segment 100, an intermediate lug segment 102, and a tapered cam segment 103. Second bent end segment 100 extends through second guide slot 80 of latch housing 70 and directly engages leg segment 64 of pawl 38. Arrow 104 indicates that pawl biasing member 66 acts to also normally bias pawl lever 90 in a first (clockwise) rotary direction based on direct engagement of leg segment 64 of panel 38 with end segment 100 of pawl lever 90. As will be detailed, pawl lever 90 is pivotable through a range of motion defined between a first pawl lever position and a second pawl lever position. Specifically, the first pawl lever position is established when pawl 38 is located in its ratchet checking position (FIG. 2) while the second pawl lever position is established when pawl 38 is located in its ratchet release position. A pair of upstanding lugs 106 and 108 are shown formed on flange segment 96 of pawl lever 90, with a position sensing device, such as a magnet 110, being mounted on first lug 106. Magnet 110 and a pawl position sensor 112 work in conjunction with a controller 113 associated with a latch control system 114 (FIG. 6) to detect and coordinate movement of pawl 38 and pawl lever 90, as will be detailed hereinafter with greater specificity.

Release lever 92 is shown in FIG. 3 to include a tubular body segment 116 pivotably supported on pawl pivot pin 60, a first drive arm segment 118 and a second drive arm segment 120. Arrows 122A and 122B schematically illustrate an over-center biasing member configured to normally bias release lever 92 to a "centered" non-actuated position (shown) with intermediate lug segment 102 of pawl lever 90 engaging second drive arm segment 120 of release lever 92. As will be detailed, release lever 92 can be rotated in a first rotary direction (clockwise in FIG. 3) from its central non-actuated position into a first actuated position and can be rotated in a second rotary direction (counterclockwise) to a second actuated position, both in opposition to the biasing of over-center biasing member 122.

Figure 4:
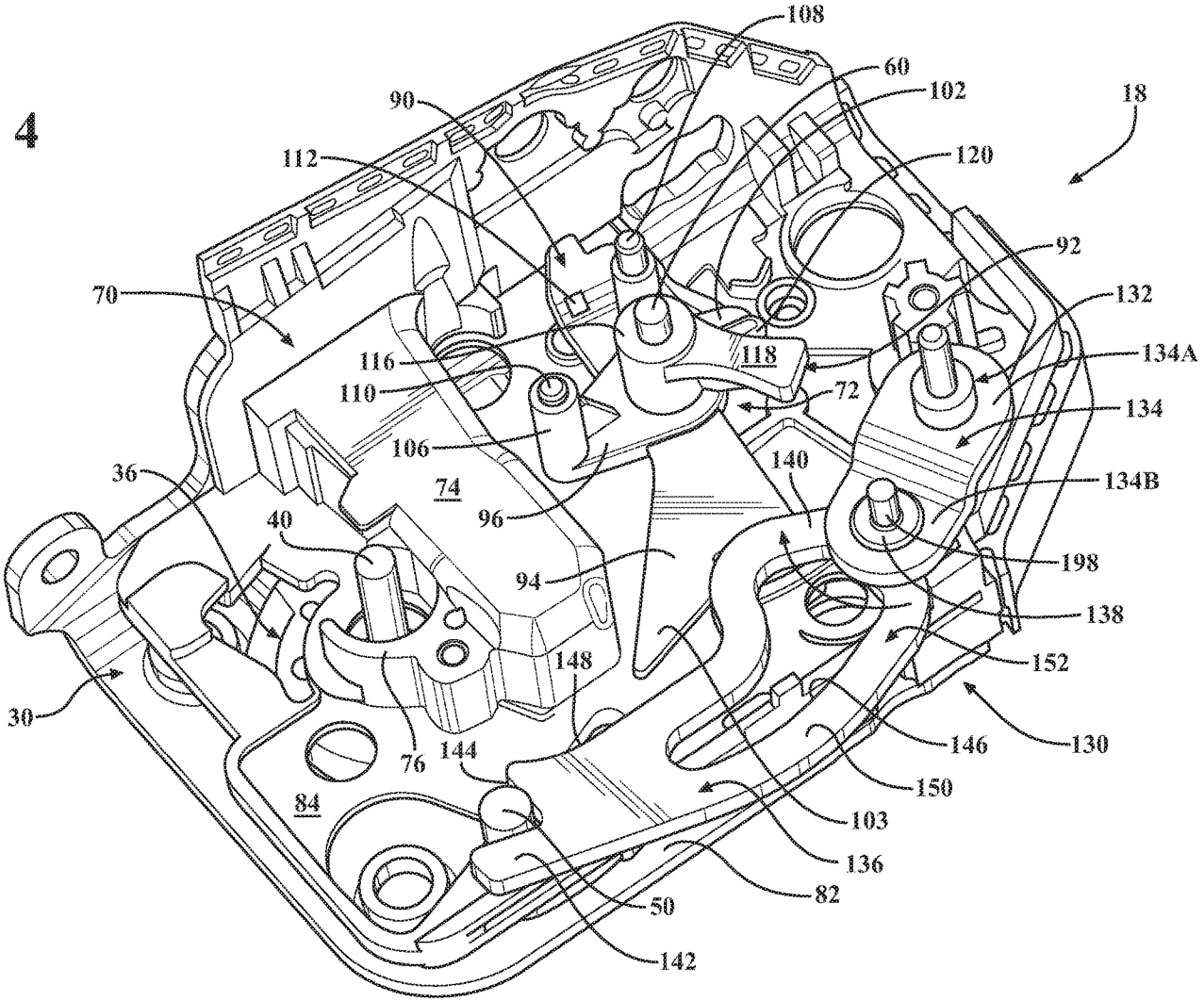
FIG. 4 is another isometric view of the one-motor power latch assembly showing various components of a latch cinch mechanism operably associated with the latch release mechanism of FIG. 3 and the latch mechanism of FIG. 2.

FIG. 4 is generally similar to FIG. 3, but shows power latch assembly 18 to further include the addition of latch cinch mechanism 130 in association with latch release mechanism 72 and latch mechanism 32. To this end, cinch mechanism 130 is shown to generally include a cinch pivot pin 132, a cinch lever 134, and a cinch link lever 136. Cinch lever 134 is shown to include a first segment 134A pivotably mounted on cinch pivot pin 132. A cinch lever pivot pin 138 pivotably interconnects a second segment 134B of cinch lever 134 to a first end segment 140 of cinch link lever 136. A second end segment 142 of cinch link lever 136 is configured to include an engagement shoulder 144 that is shown to be in engagement with ratchet rivet 50 for retaining ratchet 36 in its cinched striker capture position. A contoured follower slot 146 and an external cam surface 148 are formed on an intermediate segment 150 of cinch link lever 136. Intermediate segment 150 of cinch link lever 136 is shown to generally overlie second bent end segment 100 and cam segment 103 of pawl lever 90. Arrow 152 schematically represents a cinch link lever biasing member which, in FIG. 4, is shown to normally bias cinch link lever 136 in a first (clockwise) rotary direction. Pivot pin 132 can be rigidly mounted to latch housing 70 or a cover member (not shown).

Figure 5:
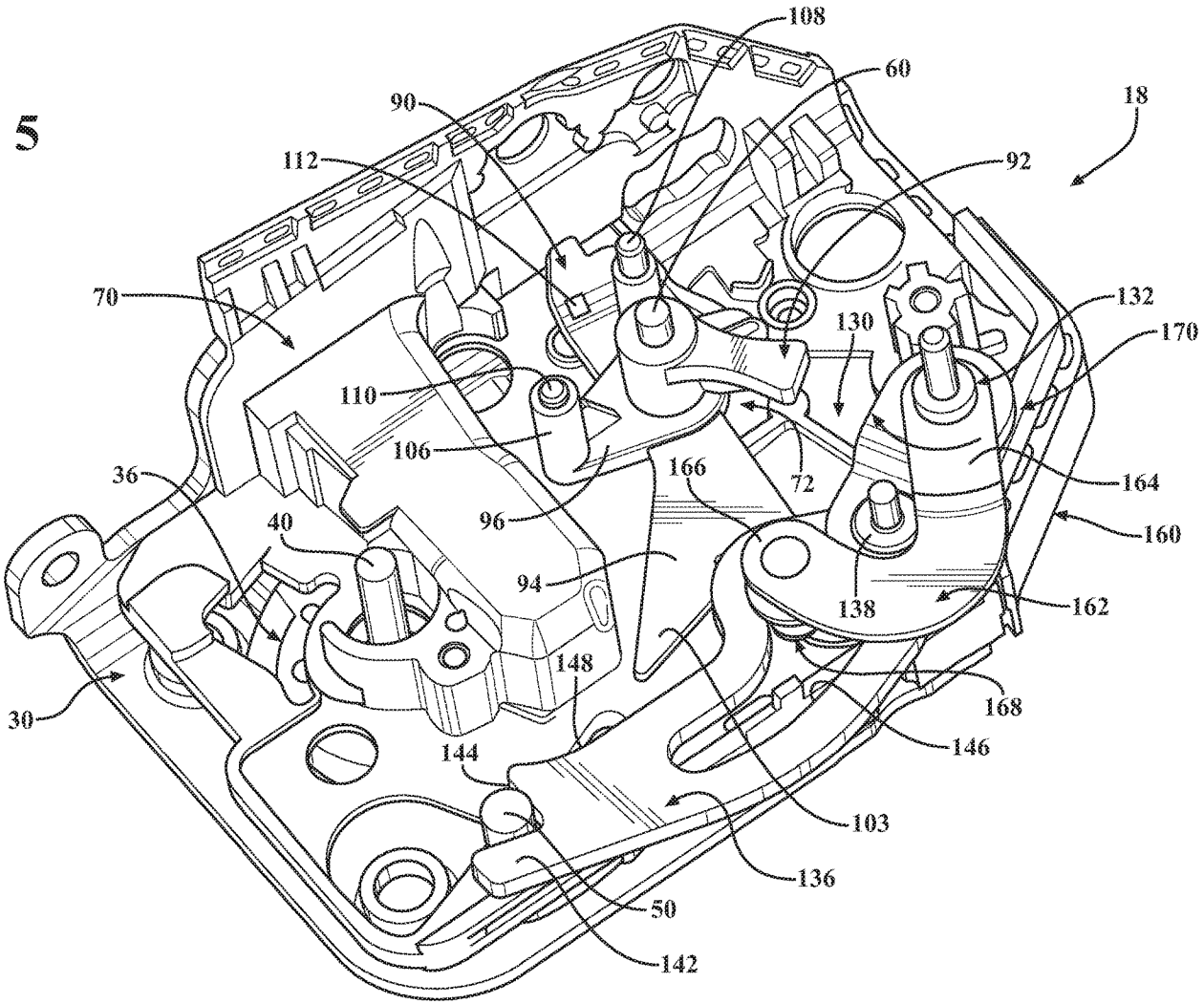
FIG. 5 is another isometric view of the one-motor power latch assembly showing various components of a cinch disengage mechanism operably associated with the latch cinch mechanism of FIG. 4.

Referring now to FIG. 5, power latch assembly 18 is shown to further include cinch disengage mechanism 160 that is operably associated with latch cinch mechanism 130 and has a J-shaped disengage lever 162. A first end segment 164 of disengage lever 162 is supported for pivotal movement on cinch pivot pin 132. A second end segment 166 of disengage lever 162 has a follower 168 that is located within and selectively engages edge portions of follower slot 146 in cinch link lever 136. A disengage lever biasing member, schematically identified by arrow 170, is configured to normally bias disengage lever 162 in a first (clockwise) rotary direction.

Figure 6:
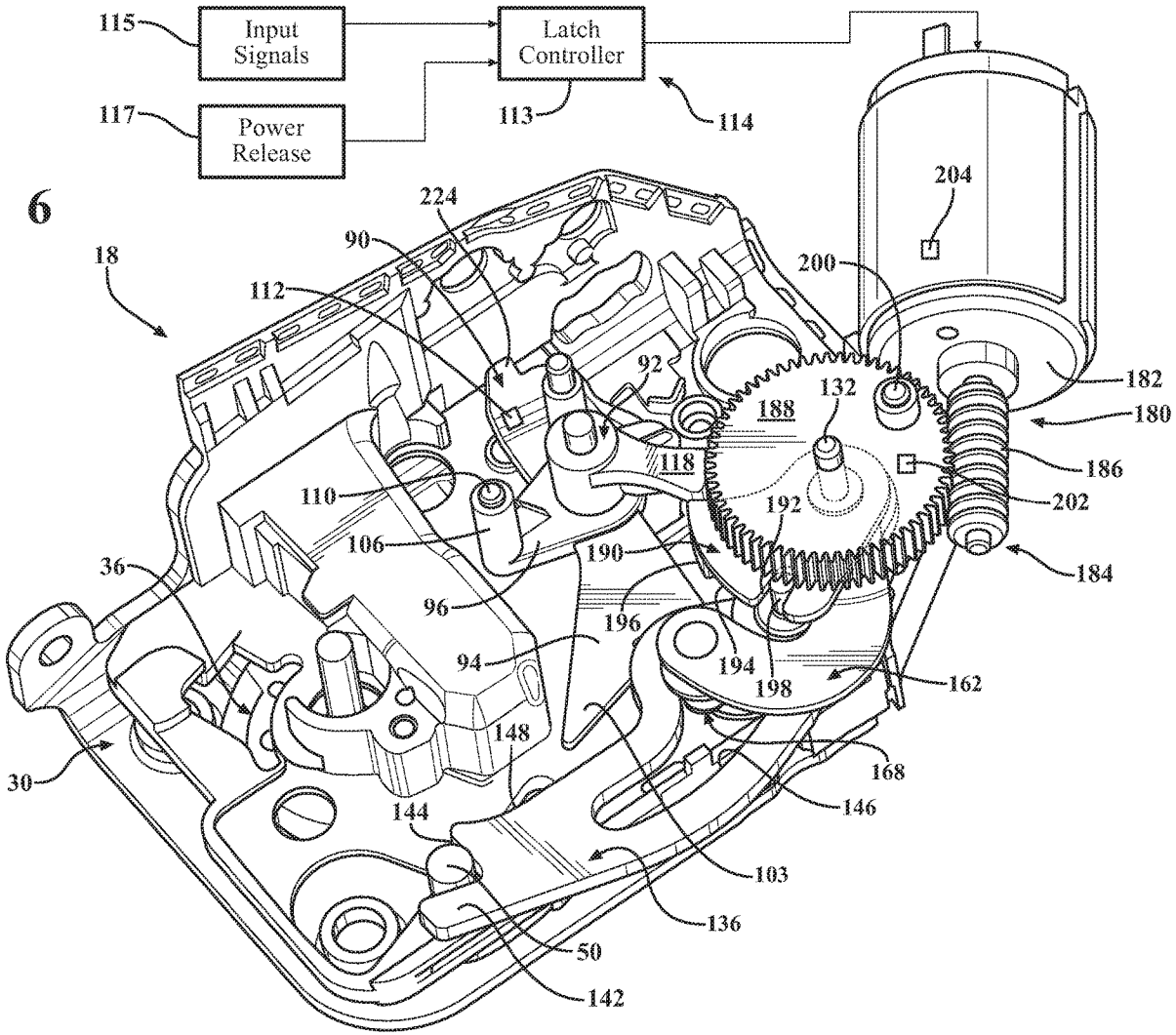
FIG. 6 is another isometric view of the one-motor power latch assembly showing various components of an actuator mechanism operably associated with the latch cinch mechanism of FIG. 4 and the latch release mechanism of FIG. 3.

Power latch assembly 18 is shown in FIG. 6 to further include actuator mechanism 180 having an electric motor 182 and a gearset 184. Gearset 184 is shown, in this non-limiting example, to include a worm 186 driven by a rotary output shaft of electric motor 182, and a worm gear 188 in constant meshed engagement with worm 186. Gear 188 is shown to be rotatably mounted on cinch pivot pin 132. A cam flange 190 is fixed to, or formed integrally with, gear 188 so as to rotate in common therewith. Cam flange 190 has an edge portion configured to define a radial drive slot 192, a recessed segment 194 and a cam segment 196. A drive post 198, extending outwardly from cinch lever pivot pin 138, is retained within drive slot 192 so as to coordinate movement of cinch lever 134 and cinch link lever 136 with rotation of gear 188. As will also be detailed, first drive arm segment 118 of release lever 92 is configured to be selectively retained within recessed segment 194 or engaged with cam segment 196 of cam flange 190 to coordinate pivotal movement of release lever 92 between its first and second actuated position with rotation of gear 188. Rotation of worm 186 in a first rotary direction caused by actuation of electric motor 182 will cause rotation of gear 188 in a first or "cinching" direction (counterclockwise in FIG. 6) while rotation of worm 186 in a second rotary direction causes rotation of gear 188 in a second or "releasing" direction (clockwise in FIG. 6). A position detecting device, such as a magnet 200, is mounted on worm gear 188 and functions in cooperation with a first cinch sensor 202 and a second cinch sensor 204 to provide controller 113 of latch control system 114 with signals indicative of the rotated position of gear 188. Generally speaking, latch control system 114 is adapted to receive sensor input signals from pawl position sensor 112 and cinch sensors 202, 204 (cumulatively identified as input signals 115) and control actuation of electric motor 182 in response thereto.

Figure 7:
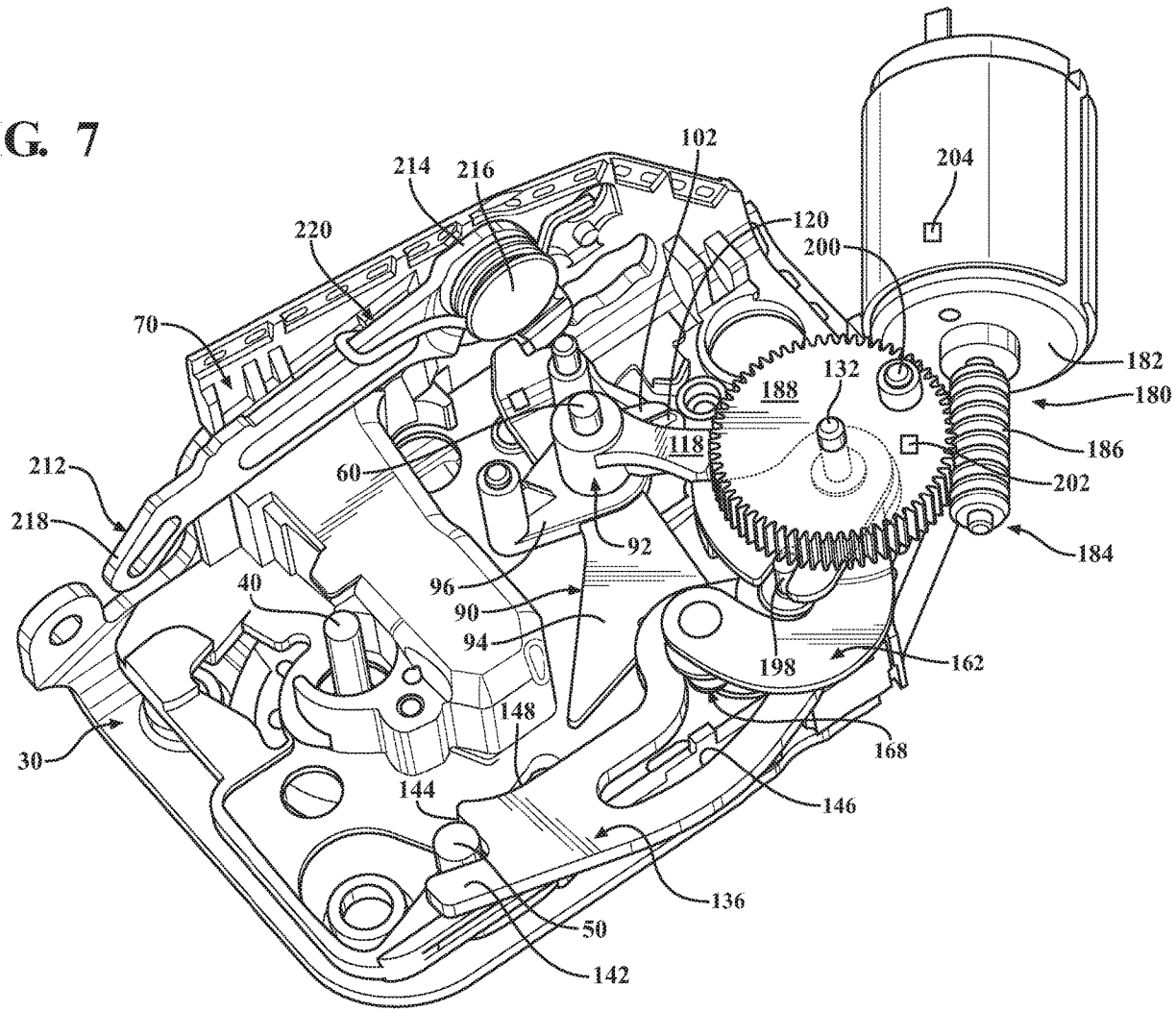
FIG. 7 is another isometric view of the one-motor power latch assembly showing various components of an inside release mechanism operably associated with the latch release mechanism of FIG. 3.

Referring primarily to FIG. 7, power latch assembly 18 is additionally equipped with inside release mechanism 210 to provide a mechanical back-up release system operable for moving pawl 38 from its ratchet checking position into its ratchet release position so as to allow ratchet 36 to rotate to its striker released position for permitting door 16 to be manually opened. Inside release mechanism 210 is shown to include an inside release lever 212 having a first end segment 214 pivotably attached to latch housing 70 via a pivot pin 216 and a second end segment 218 adapted to be mechanically interconnected to inside handle 24 via a suitable inside connection mechanism (not shown). An inside release lever biasing device, such as spring 220, acts between inside release lever 212 and housing 70 to normally bias inside release lever 212 in a first rotary direction (counterclockwise in FIG. 7) toward a non-actuated position (shown). With inside release lever 212 in its non-actuated position, a drive tab 222 on first end segment 214 is disengaged from an engagement lug 224 formed on first bent end segment 98 of plate segment 94 of pawl lever 90. Rotation of inside release lever 212 in a second rotary direction (clockwise in FIG. 7) toward an actuated position (not shown) causes drive tab 222 to engage engagement lug 224 and forcibly pivot pawl lever 90 in a counterclockwise direction from its first pawl lever position into its second pawl lever position which, in turn, causes pawl 38 to be forcibly pivoted from its ratchet checking position into its ratchet release position due to second bent end segment 100 of pawl lever 90 engaging leg segment 64 of pawl 38, and in opposition to the biasing of pawl spring 66.

Referring now to FIG. 8, power latch assembly 18 is shown to further include outside release mechanism 230 operable to provide a mechanical backup release system for moving pawl from its ratchet checking position into its ratchet release position so as to allow ratchet 36 to rotate from its striker capture positions into its striker release position for permitting door 16 to be manually released and opened. Outside release mechanism 230 is shown to include an outside backup lever 232 and an outside backup link 234. Lever 232 includes an intermediate boss segment 236 and first and second leg segments 238, 240 extending outwardly from boss segment 236. Boss segment 236 includes an aperture through which ratchet pivot pin 40 extends so as to support outside backup lever 232 for pivotal movement. First leg segment 238 of lever 232 is interconnected via a rod 242 (and possibly other linkage components) to outside door handle 22 while second leg segment 240 includes a pivot post 244. A first end segment 246 of outside backup link 234 is pivotably mounted on pivot post 244. A second end segment 248 of outside backup link 234 includes a lost motion slot 250 within which lug 108 on flange segment 96 of pawl lever 90 extends. When pawl 38 is located in its ratchet checking position, lug 108 engages a first end of lost motion slot 250 (as shown in FIG. 8). Actuation of lever 232 via outside door handle 22 causes lever 232 to rotate in a first (counterclockwise) direction such that link 234 causes pawl lever 90 to be forcibly pivoted in the counterclockwise direction which, in turn, causes pawl 38 to be forcibly pivoted from its ratchet checking position into its ratchet release position, again due to second bent segment 100 of pawl lever 90 engaging leg segment 64 of pawl 38. It will be understood that the biasing applied by pawl spring 66 on pawl 38 and pawl lever 90 also functions to bias outside back lever 232 and outside backup link 234 to be located in the non-actuated positions shown in FIG. 8.

Another feature of the present disclosure that will be evident from the drawings and this detailed description is that a power cinching operation is employed to rotate ratchet 36 from either of the "low energy" soft close striker capture position (FIGS. 10A, 10B and 13A) and the "high energy" hard close striker capture position (FIGS. 11A, 11B and 13B) into its fully closed/cinched striker capture position (FIGS. 12A, 12B and 13C). This power cinching operation is an advancement over conventional power cinching latch assemblies which only function to cinch the striker by rotating the ratchet from its initial striker capture position (equivalent to the soft close strike capture position herein) into its primary striker capture position (equivalent to the hard close striker capture position herein). Thus, power latch assembly 18 always functions to provide some perceptible amount of cinching, otherwise referred to as "perceived" cinch, that is recognizable to the vehicle operator. In this regard, FIG. 14A illustrates the angular travel of ratchet 36 required by the power cinching operation of power latch assembly 18 to rotate ratchet 36 from its low energy/soft close striker capture position (hard lines) to its fully closed/cinched striker capture position (phantom lines). This amount of ratchet rotation, referred to as "soft close cinch perception" is identified in FIG. 14A as angle "A." Similarly, FIG. 14B illustrates the angular travel of ratchet 36 required by the power cinching operation to rotate ratchet 36 from its high energy/hard close striker capture position (hard lines) to the fully closed/cinched strike capture position (phantom lines). This lesser amount of ratchet rotation or the "hard close cinch perception" is identified in FIG. 14B as angle "B." As noted in the Background section, conventional power cinching latch assemblies rely on the pawl to retain the ratchet in the primary striker capture position and must be configured to reset the cinching mechanism to a stand-by condition. In contrast, power latch assembly 18 of the present disclosure is configured to employ latch cinch mechanism 130 to mechanically retain ratchet 36 in its fully closed/cinched striker capture position while pawl 38 is displaced from engagement with ratchet 36.

FIGS. 9A and 9B provide elevational views of various components of power latch assembly 18 oriented to establish the released mode when door 16 is located in its open position. Specifically, ratchet 36 is shown located in its striker release position due to the normal biasing of ratchet biasing member 54. With ratchet 36 located in its striker release position, pawl 38 is biased toward its ratchet checking position by pawl spring 66 such that pawl engagement surface 62 is in engagement with first cam edge surface 53 of ratchet 36. In the striker release position of ratchet 36, it is also shown that ratchet rivet 50 on arm segment 52 of ratchet 36 is in close proximity to or engages cam surface 148 on cinch link lever 136. The coordinated biasing of ratchet biasing member 54, cinch link lever biasing member 152, and disengage lever biasing member 170 act to assist in maintaining engagement of ratchet rivet 50 with cam surface 148. Also, follower 168 of disengage lever 162 is shown positioned within a dwell segment 147 of contoured follower slot 146 in cinch link lever 136.

FIGS. 10A and 10B, FIG. 13A and FIG. 14A illustrate various components of power latch assembly 18 positioned to establish the first safety latched mode when door 16 located in its first closed position. This mode is established when door 16 has been closed with a low energy closing force such that striker 20 engages an edge surface within guide channel 42 and forcibly rotates ratchet 36 from its striker release position into its first/soft close striker capture position. In this ratchet position, pawl 38 is biased into its ratchet checking position such that its engagement surface 62 engages first safety latch surface 46 of ratchet 36, thereby preventing striker 20 from being released from capture pocket 44. In addition, such initial rotation of ratchet 36 caused by engagement with striker 20 causes ratchet rivet 50 on ratchet 36 to move into engagement with engagement shoulder 144 of cinch link lever 136. As will be detailed, actuation of the power cinching feature can now be initiated to cause further rotation of ratchet 36 in its latching direction for moving ratchet 36 from its first/soft close striker capture position through its second/hard close striker capture position and finally into its third/cinched striker capture position for moving door 16 from its first closed position into its third closed position. This power cinching function is operable to compress weather seal 28 from a first or soft compression state (associated with door 16 located in its first closed position) into a third or cinched compression state (associated with door 16 located in its third closed position) upon powered cinching of door 16 from its first closed position into its third closed position. FIG. 13A illustrates the positioning of striker 20, ratchet 36 and pawl 38 for establishing the first safety latched mode of power latch assembly 18 when door 16 is located in its first closed position for applying a first or low compression force on weather seal 28. Likewise, FIG. 14A illustrates the relative movement of the latch components from the first safety latched mode (hard lines) to the cinch latched mode (phantom lines) to illustrate the angular movement of ratchet 36 through the angle "A" associated with this power cinching operation.

Referring now to FIGS. 11A and 11B, FIG. 13B and FIG. 14B, the components of power latch assembly 18 are shown positioned to establish the second safety latched mode with door 16 located in its second closed position. This mode is established when door 16 has been closed with a high energy closing force such that striker 20 forcibly rotates ratchet 36 from its striker release position into its second/hard close striker capture position. In this ratchet position, pawl 38 is biased into its ratchet checking position such that its engagement surface 62 engages second safety latch surface 48 of ratchet 36 after riding along first and second cam edge surfaces 53 and 55 of ratchet 36 due to the forced rotation of ratchet 36. Obviously, such rotation of ratchet 36 again results in ratchet rivet 50 moving into engagement with engagement shoulder 144 on cinch link lever 136. As will be detailed, the power cinching function can now be initiated to cause latch cinch mechanism 130 to rotate ratchet 36 from its second/hard close striker capture position into its third/cinched striker capture position to move door 16 from its second closed position into its third closed position. This power cinching function is operable to compress weather seal 28 from a second or hard compression state (associated with door 16 in its second closed position) into its cinched compression state upon power cinching of door 16 from its second closed position into its third fully closed position. FIG. 13B illustrates the positioning of striker 20, ratchet 36 and pawl 38 for establishing the second safety latched mode of latch assembly 18 when door 16 is located in its second closed position and as it applies a second or high compression force on weather seal 28. Likewise, FIG. 14B illustrates the relative movement of the components from the second safety latched mode (hard lines) to the cinch latched mode (phantom lines) to illustrate the angular travel of ratchet 36 through angle "B" associated with this power cinching operation.

FIGS. 12A and 12B and FIG. 13C provide various views of the components of power latch assembly 18 oriented to establish the cinch latched mode with door 16 located in its third, fully closed position. Specifically, ratchet 36 is located and held in its third/cinched striker capture position while pawl 36 is located in its ratchet checking position. As best seen in FIGS. 12B and 13C, rotation of ratchet 36 to its third/cinched striker capture position (via the power cinching operation) acts to disengage ratchet 36 from mechanical engagement with pawl 38. As noted, rotation of ratchet 36 from either of its first/soft close striker capture position (FIG. 13A) or its second/hard close striker capture position (FIG. 13B) into its third/cinched striker capture position (FIG. 13C) is accomplished solely via the power cinching function of latch assembly 18. Thus, the first safety latched mode shown in FIG. 13A provides a first mechanical latching in the event that power is lost and no power cinching function is available with door 16 located in its first closed position. In such case, door 16 can be mechanically opened via inside latch release mechanism 210 or outside latch release mechanism 230 and subsequently re-closed with higher energy to place door 16 in its second closed position.

In accordance with the present disclosure, when the power cinching feature of power latch assembly 18 is available, the soft closed position established by low energy closure of door 16 is not intended to define a first mechanically latched position, but rather establishes a first door closure position from which the power cinching operation can be initiated. Similarly, the hard closed position of FIG. 13B established by high energy (i.e., slamming) closure of door 16 is not intended to define a second mechanically latched position, but rather establishes a second door closure position from which the power cinching operation can also be initiated. FIG. 13C illustrates the relationship of pawl 38 and ratchet 36 upon conclusion of the power cinching operation. As will be detailed, components other than pawl 38, such as latch cinch mechanism 130, are used to retain ratchet 36 in its third/cinched striker capture position of FIG. 13C. However, retention of pawl 38 in its ratchet checking position when ratchet 36 is located in its cinched striker capture position provides a mechanical failsafe or the "blocking safety latching" mode since rotation of ratchet 36 in its releasing direction from its third/cinched striker capture position toward its second/hard striker capture position, in response to a vehicle collision for example, will result in mechanical (i.e., "blocking" engagement of ratchet 36 with pawl 38, thereby preventing door 16 from being unintentionally opened.

Referring now to FIGS. 15 through 17, each provides a coordinated series of sequential views for illustrating the relative movement of components of power latch assembly 18 associated with the power cinching function for moving door 16 from its first closed position to its third fully closed position. In particular, FIGS. 15A-15K are isometric views while FIGS. 16A-16K and FIGS. 17A-17K are corresponding top and bottom elevational views of the components of power latch assembly 18. The following description is intended to provide sufficient details, when considered in conjunction with these figures, to clearly disclose the interaction of components and movement thereof associated with power latch assembly 18 to provide the power cinching function.

Starting initially with FIGS. 15A, 16A and 17A, the components of power latch assembly 18 are shown to establish the released mode when door 16 is opened such that ratchet 36 is biased into its striker release position and pawl 38 is held in its ratchet release position via engagement of pawl engagement surface 62 with ratchet edge surface 53. It should also be noted that ratchet rivet 50 can be maintained in engagement with cam surface 148 on cinch link lever 136 and gear 188 is located in a "cinch start" position with magnet 200 offset from first cinch sensor 202. With pawl 38 located in its ratchet release position, release lever 92 is maintained in its centered non-actuated position such that lug segment 102 on pivot pawl 90 is disengaged from second drive arm segment 120 of release lever 92.

FIGS. 15B-15D, FIGS. 16B-16D, and FIGS. 17B-17D illustrate initial mechanical rotation of ratchet 36 due to engagement with striker 20 as door 16 moves from its open position into it first closed position (FIGS. 15D, 16D, 17D) whereat engagement surface 62 of pawl 38 disengages first cam edge surface 53 and engages first safety latch surface 46 of ratchet 36 such that pawl 38 is subsequently biased into its ratchet checking position. Ratchet 36 is shown located in its first/soft close striker capture position such that ratchet rivet 50 has also moved off of cam surface 148 and is now positioned against and retained by engagement shoulder 144 of cinch link lever 136. Cinch link lever spring 152 assists in maintaining rivet 50 within engagement shoulder 144. Movement of pawl 38 into its ratchet checking position causes concurrent clockwise rotation of pawl lever 90 such that its lug segment 120 is again engaging second drive leg segment 120 of release lever 92. Movement of pawl 38 into its ratchet checking position also causes magnet 110 on pawl lever 90 to overlie and cooperate with pawl sensor 112 for providing an input signal to latch controller unit 113 associated with latch control system 114 that is indicative of the pawl's position and to initiate the power cinching function. Specifically, latch controller unit 113 energizes electric motor 182 and causes gear 188 to be driven in the first direction (counterclockwise) from its cinch start position. This action initiates a Cinch mode.

FIGS. 15E, 16E and 17E illustrate that this initial actuation of electric motor 182 causes gear 188 to be rotatably driven in the first rotary direction, as indicated by arrow 270, from its cinch start gear position (shown in FIG. 15D). In response to such gear rotation, cinch link lever 136 is caused to rotate clockwise such that it forcibly rotates ratchet 36 which, in turn, causes engagement surface 62 of pawl 38 to slide against second cam edge surface 55 on ratchet 36. Specifically, since drive post 198 is retained within drive slot 192 of cam flange 190, such rotation of gear 188 in the first direction from its cinch start position causes concurrent pivotal movement of cinch lever 134 about cinch pivot pin 132 which, in turn, causes pivotal and sliding movement of cinch link lever 136. Such movement of cinch link lever 136 causes engagement shoulder 144 to drivingly engage ratchet rivet 50 and forcibly rotate ratchet 36 from its first/soft close striker capture position toward its second/hard close striker capture position. As also seen in FIGS. 15F, 16F and 17F, first drive arm segment 118 of release lever 92 rides within recessed segment 194 of cam flange 190 so as to maintain release lever 92 in its centered position. As noted, arrow 270 indicates the rotation of gear 188 during the power cinching function.

FIGS. 15G, 16G and 17G illustrate continued rotation of gear 188 in its latching direction due to continued energization if electric motor 182 until ratchet 36 has been forcibly rotated into and then past its second/hard close striker capture position (See FIGS. 15H, 16H and 17H). These illustrations further show the continued rotation of cinch lever 134 about cinch pivot 132 due to the interaction between drive post 198 and drive slot 192 on cam flange 190. Release lever 92 is maintained in its centered non-actuated position with first drive arm segment 118 continuing to travel within recessed segment 194 of cam flange 190. As noted, contact between engagement shoulder 144 on cinch link lever 136 and ratchet rivet 50 causes the continued rotation of ratchet 36 from its first striker capture position (FIG. 17D) into its second striker capture position (See FIG. 11C) and then past its second striker capture position (FIG. 17H) due to the movement of cinch link lever 136 resulting from rotation of gear 188.

FIGS. 15I, 16I and 17I, as well as FIGS. 15J, 16J and 17J, illustrate continued rotation of gear 188 in its cinching direction as ratchet 36 is forcibly rotated past its second/hard close striker capture position and toward its third/cinched striker capture position. This continued rotation of gear 188 has now caused first drive arm segment 118 of release lever 92 to engage cam segment 196 of cam flange 190. Such engagement causes release lever 92 to be forcibly rotated in a clockwise direction (FIGS. 15I, 16I) from its central non-actuated position toward its first actuated position. Additionally, the pivotal and translational movement of cinch link lever 136 causes engagement shoulder 144 to continue to engage ratchet rivet 50 and cause the continued rotation of ratchet 36 while pawl 38 is maintained by pawl biasing member 66 in its ratchet checking position. In the ratchet position shown, pawl engagement surface 62 is disengaged from ratchet 36.

FIGS. 15K, 16K and 17K illustrate ratchet 36 completely rotated to its third/cinched striker capture position as gear 188 reaches its "cinch stop" position. As such, magnet 200 works in conjunction with second cinch sensor 204 to signal latch controller unit 113 of latch control system 114 that gear 188 has reached its cinch stop position. Latch controller unit 113 then deenergizes motor 182 and the power cinching function is completed and the Cinch mode has been established. Ratchet 36 is mechanically retained in its third/cinched striker capture position by latch cinch mechanism 130 due to engagement shoulder 144 of cinch link lever 136 engaging ratchet pin 50. Additionally, first drive arm 118 of release lever 92 has disengaged cam segment 196 of gear cam flange 190, thereby permitting release lever 92 to rotate from its first actuated position into its central non-actuated position. Additionally, a comparison of FIGS. 17H through 17K best illustrates cinch link lever 136 moving to an "over-center" position relative to cinch pivot post 132 and cinch lever 134. In addition, release lever 92 is permitted returned to its central non-actuated position as first drive arm segment 118 moves past and disengages cam segment 196 of cam flange 190.

As also noted, in the event of a collision, directional forces are applied to striker 20 (in a door opening direction), as indicated by arrow 280 and to ratchet 36 as indicated by arrow 282 in FIG. 15L. The line of force, indicated by arrow 282, acting through ratchet rivet 50 is oriented to forcibly rotate gear 188 in the cinching direction, as indicated by arrow 284, which in turn causes continued rotation of cinch lever 134. The resulting action between the linked components, particularly in view of the over-center relationship between cinch link lever 136 and cinch pivot 132 (See FIG. 17L), will eventually result in rotation of ratchet 36 in its releasing direction until its second safety latch surface 48 engages engagement surface 62 of pawl 38, thereby preventing unintentional opening of door 16. Thus, power latch assembly 18 provides a mechanical safety latched or "blocking" mode.

Referring now to FIGS. 18-20, a coordinated series of sequential views are shown from multiple orientations to illustrate the relative movement of various components of power latch assembly 18 associated with the power release function and which is configured to provide an "uncinching" or "soft open" feature. In general, this soft open feature is operable to slowly and progressively release the compression forces applied to weather seal 28 prior to releasing striker 20 from latched engagement with ratchet 36 so as to eliminate or significantly reduce the audible "pop" noise associated with conventional power latch release systems. As provided in the drawings, FIGS. 18A-18G illustrate a series of sequential isometric view provided to clearly show the interaction of the various components of power latch assembly 18 for facilitating movement of ratchet 36 from its cinched striker capture position into its striker release position in response to power latch assembly 18 being shifted from its cinched latched mode (door 16 located in its third closed position) into its latch released mode (door 16 in its open position). FIGS. 19A-19G and FIGS. 20A-20G are top and bottom elevational views corresponding to FIGS. 18A-18G so as to better illustrate movement of the components during the power release operation.

Figure 20A:
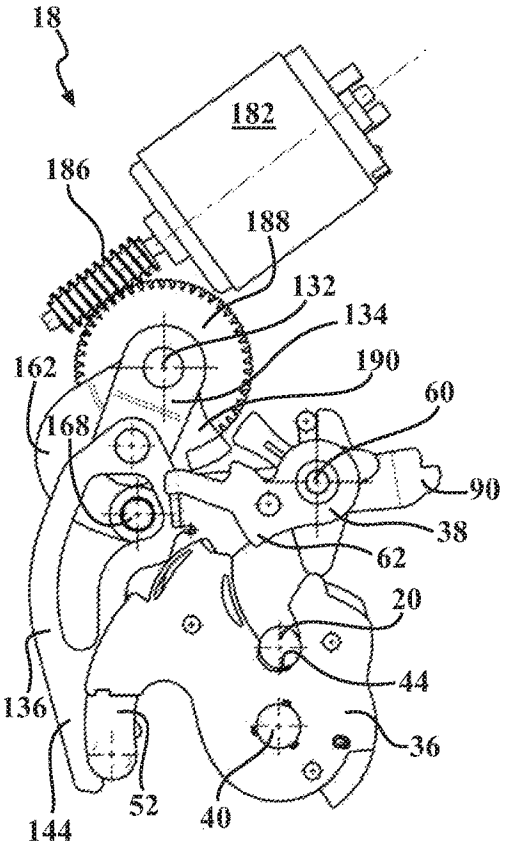
Figure 19A:
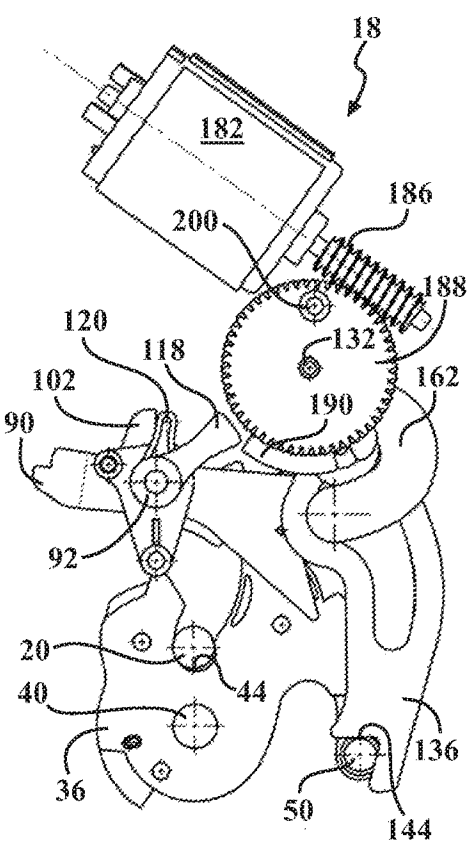
Figure 18A:
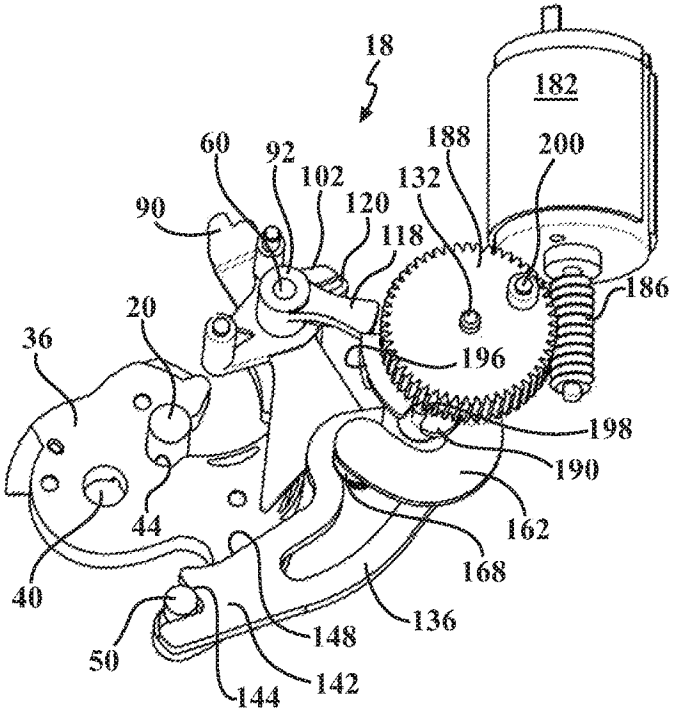
Figure 20B:
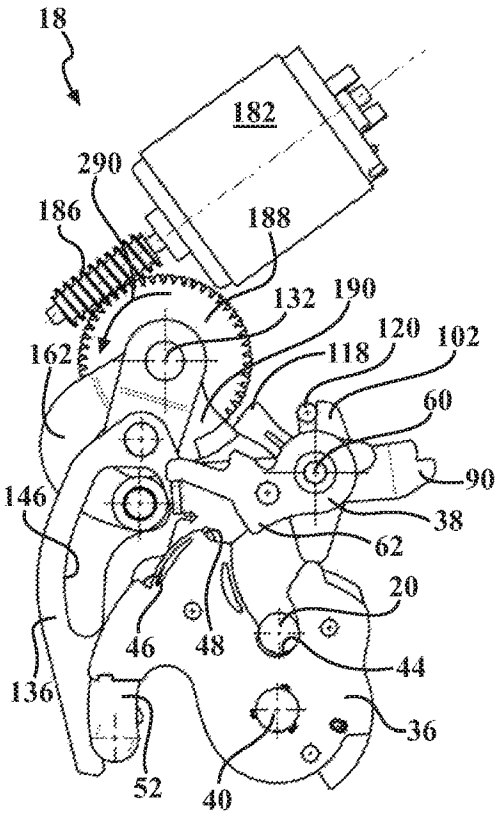
Figure 19B:
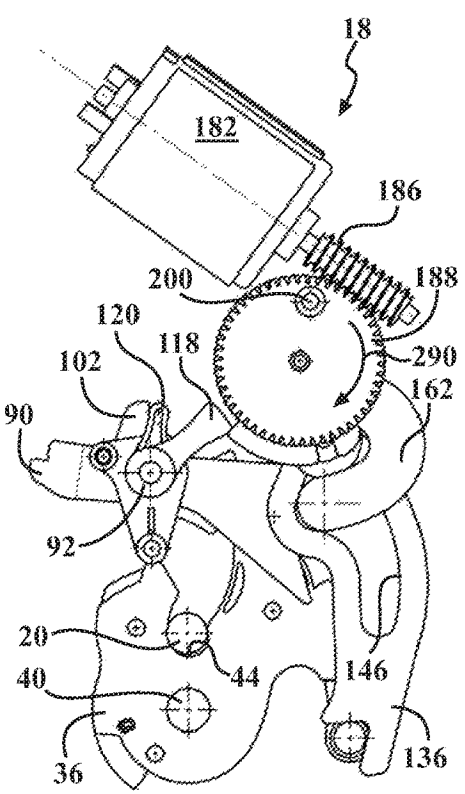
Figure 18B:
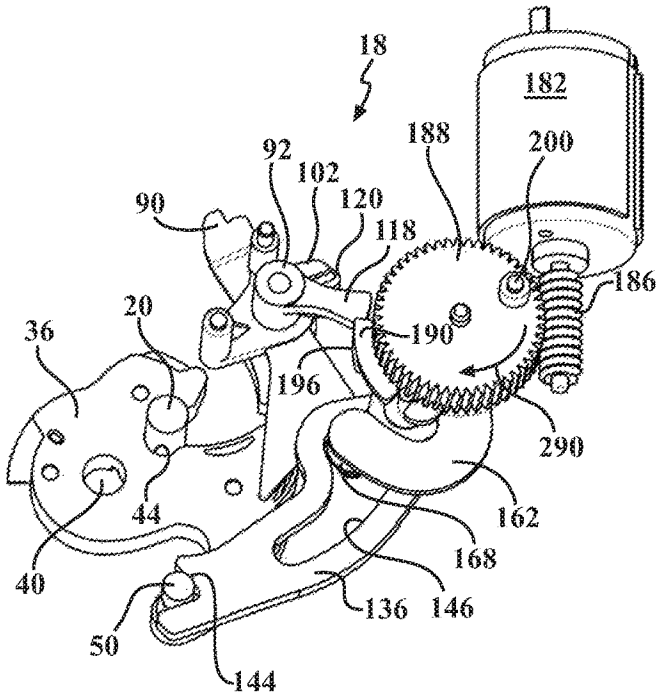
Figure 20C:
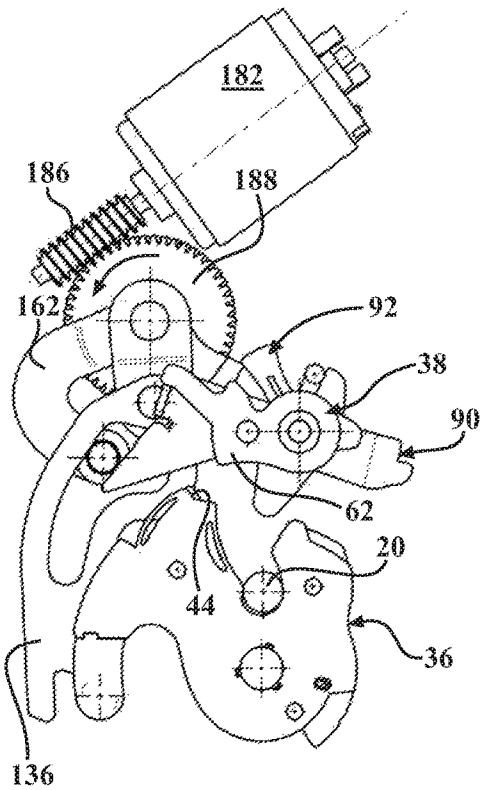
Figure 19C:
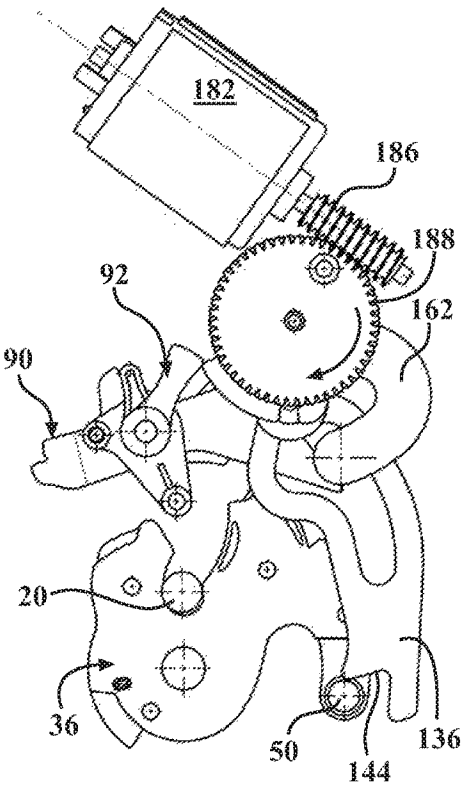
Figure 18C:
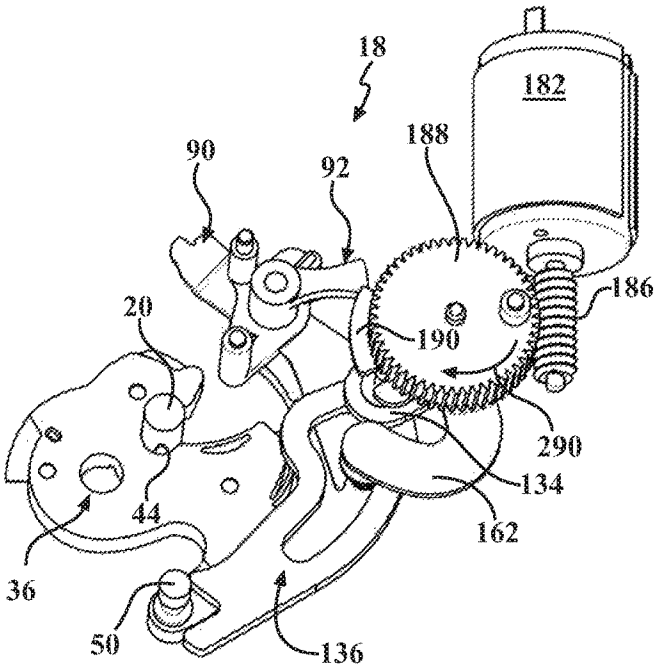

Starting with FIGS. 18A, 19A and 20A, the components of power latch assembly 18 are shown prior to actuation of a power release switch 117 (FIG. 6) with gear 188 located in its cinch stop position, ratchet 36 held in its cinched striker capture position by cinch link lever 136, and pawl 38 held in its ratchet checking position. Power release switch 117 can be, in accordance with non-limiting examples, associated with outside door handle 22 or a remote fob possessed by the vehicle operator. Upon actuation of power release switch 117, motor 182 is energized to rotate gear 188 in its second or releasing rotary direction, as indicated by arrow 290. This action initiates the "Uncinch/Release" mode. Initial rotation of gear 188 in the second direction causes cam segment 196 on drive flange 190 to engage first drive arm segment 118 of release lever 92 and begin rotating release lever 92 in a counterclockwise direction away from its central non-actuated position toward its second actuated position. Such rotation of release lever 92 causes its second drive arm segment 120 to engage lug segment 102 and forcibly pivot pawl lever 90 from its first pawl lever position toward its second pawl lever position which, in turn, forcibly pivots pawl 38 from its ratchet checking position toward its ratchet release position. FIGS. 18B, 19B and 20B illustrate the orientation of the components upon initial rotation of gear 188 in its releasing direction while FIGS. 18C, 19C and 20C illustrate the same components following continued rotation of gear 188 until pawl 38 is located in its ratchet release position. In addition, such pivotal movement of pawl lever 90 to its second pawl lever position results in its cam segment 103 engaging follower 168 and pivoting disengage lever 162 about cinch pivot pin 132 until follower 168 is in engagement with an edge portion of slot 142 in cinch link lever 136. This engagement, in combination with pivotal movement of cinch lever 134 about cinch pivot 132 in response to rotation of gear 188, begins to move engagement shoulder 144 on cinch link lever 136 out of engagement with ratchet rivet 50 and permits a limited amount of "uncinching" rotation of ratchet 36 out of its cinched striker capture position into a "cinch released" striker capture position, thereby establishing a "cinch released" mode for power latch assembly 18. This limited amount of uncinching rotation of ratchet 36, prior to complete release of ratchet rivet 50 from engagement shoulder 144, provides the soft opening feature and functions to partially unload weather seal 28.

Figure 20D:
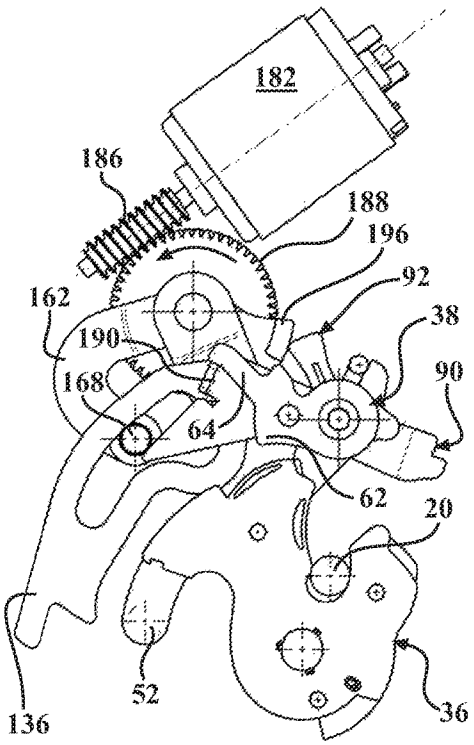
Figure 19D:
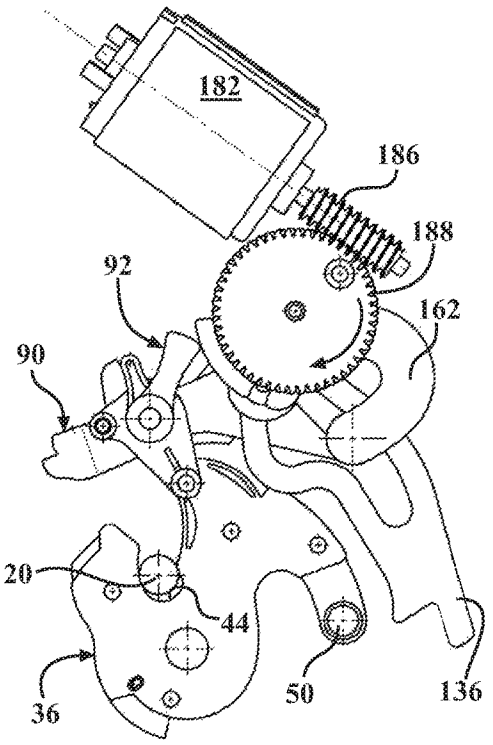
Figure 18D:
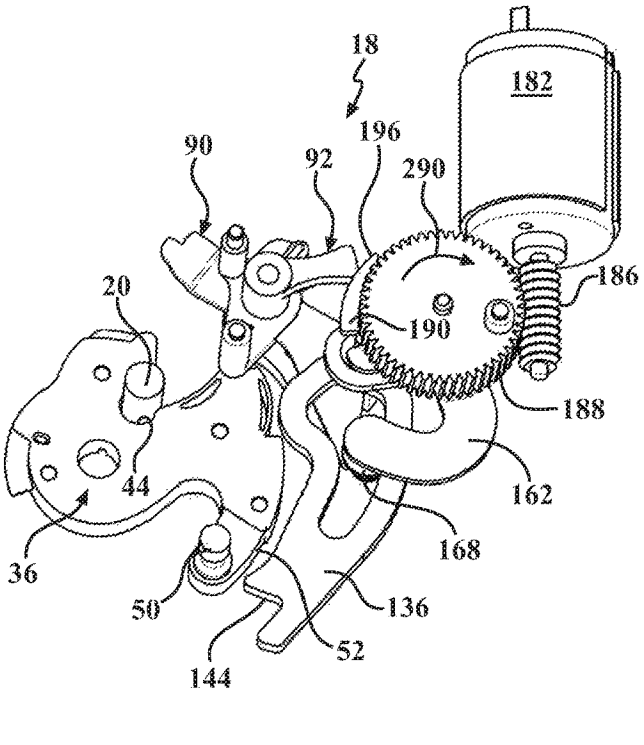
Figure 20E:
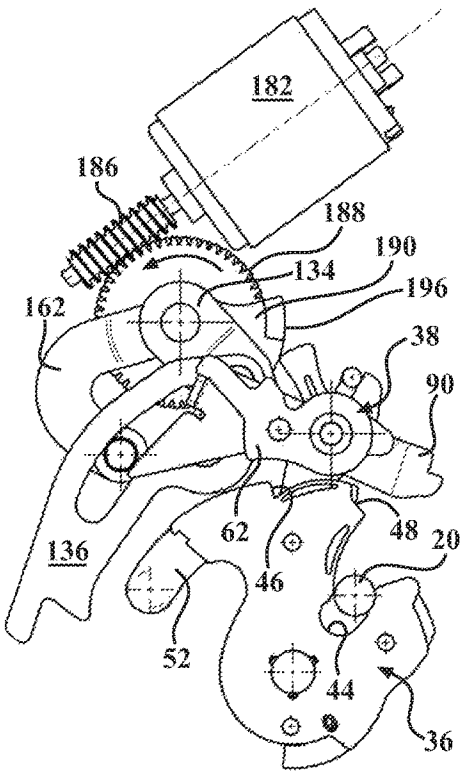
Figure 19E:
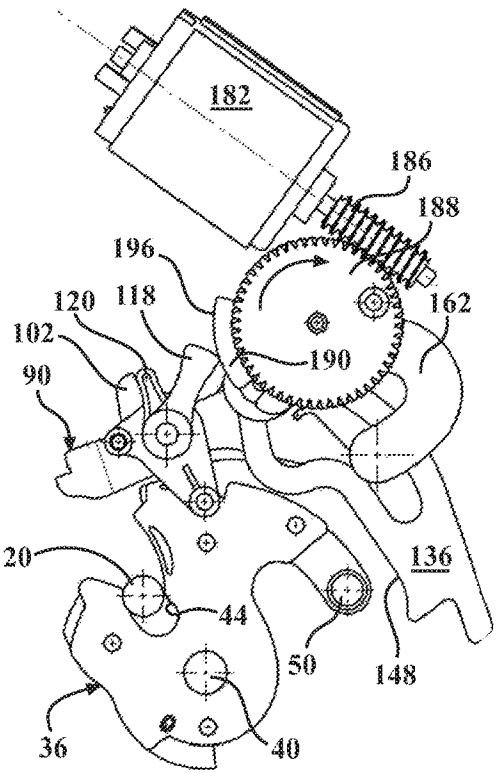
Figure 18E:
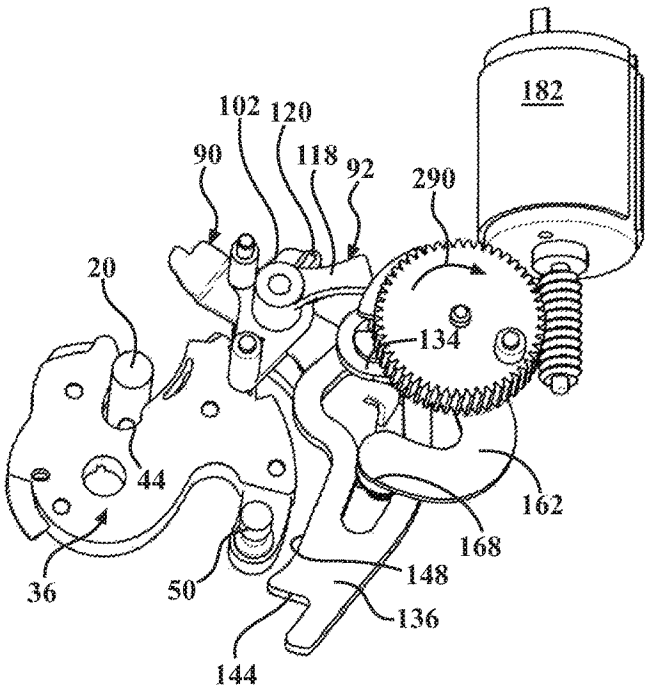
Figure 20F:
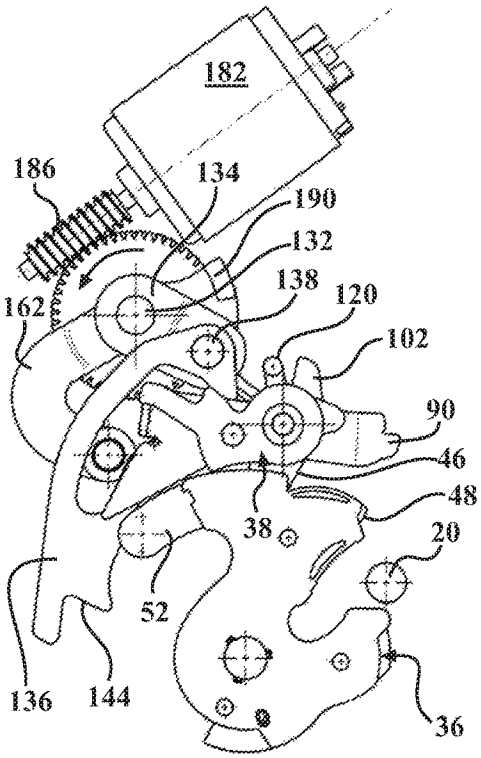
Figure 19F:
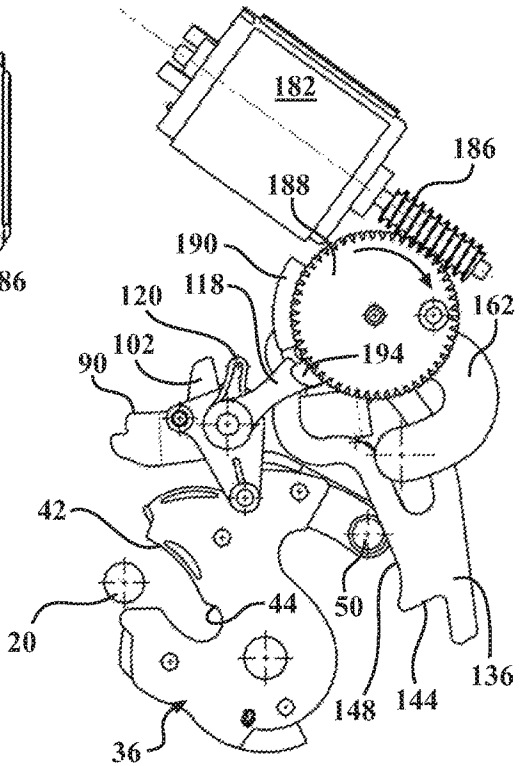
Figure 18F:
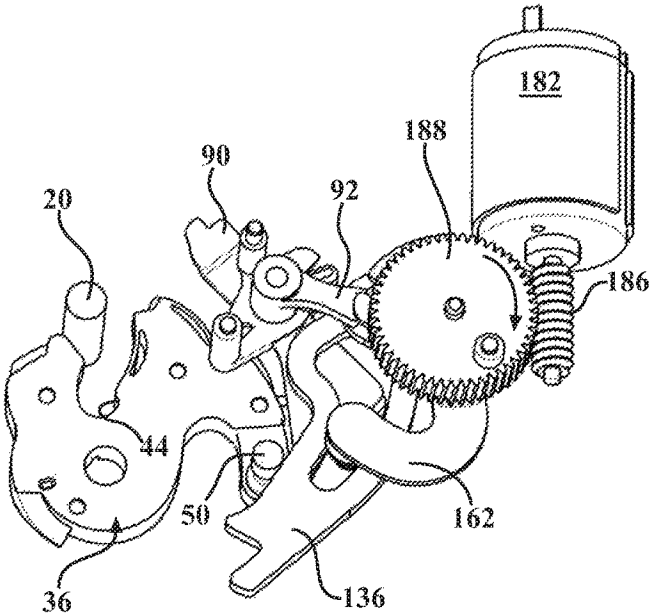
Figure 20G:
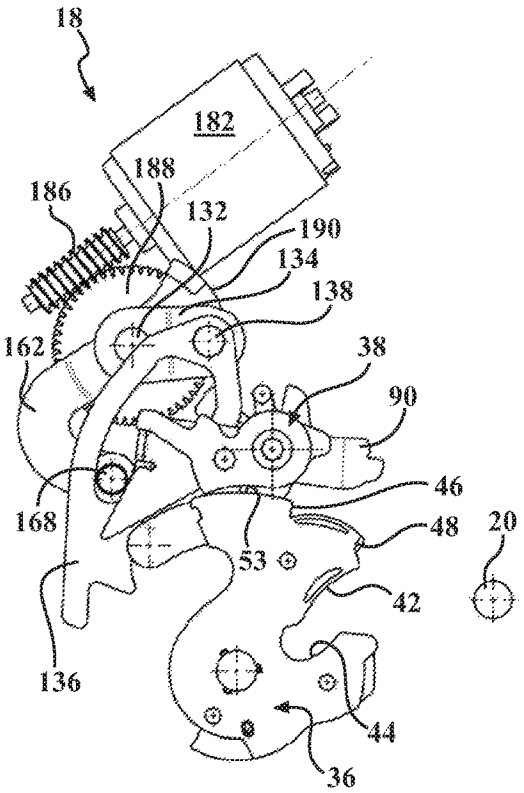
Figure 19G:
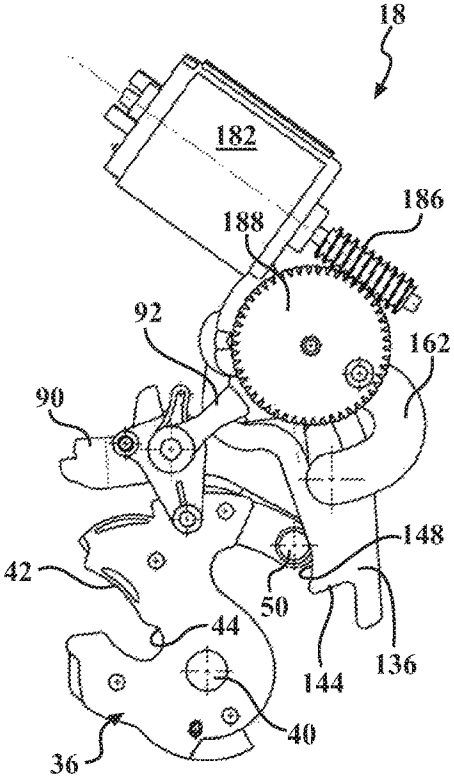
Figure 18G:
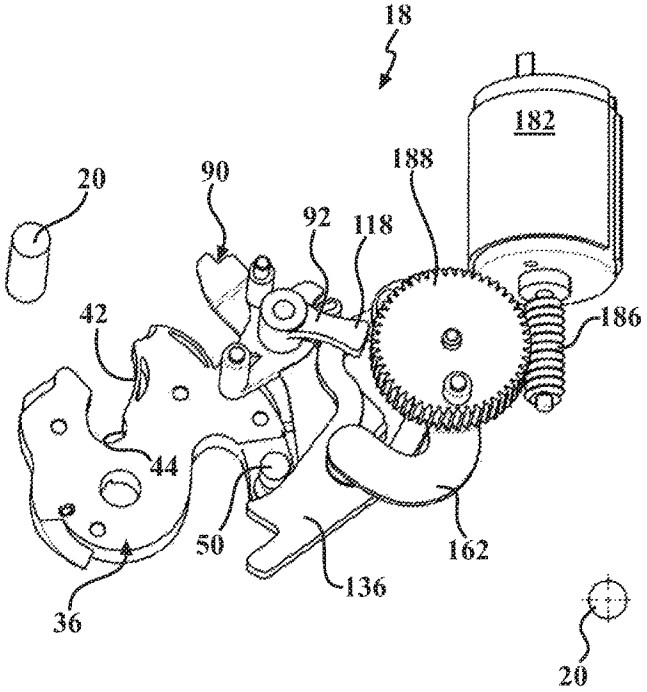

FIGS. 18D, 19D and 20D, illustrate that the continued rotation of gear 188 causes first drive arm segment 118 to continue to engage cam segment 196 and rotate release lever 92 such that second drive arm segment 120 forcibly engages lug 102 on pawl lever 90 for pivoting and holding pawl 38 (via engagement of bent end segment 100 of pawl lever 90 and pawl leg 64) in its ratchet release position while ratchet rivet 50 is shown released from engagement with engagement shoulder 144 on cinch link 136. In this position, ratchet 36 is located in a "ratchet released" position. As such, ratchet 36 is thereafter permitted to rotate from its ratchet released position into its striker release position due to ratchet biasing mechanism 54. Rotation of gear 188 is stopped upon it reaching its cinch start position shown in FIGS. 18G, 19G and 20G. As also shown in these views, drive arm segment 118 of release lever 92 has disengaged cam segment 196 and is permitted to return to its central non-actuated position. Also note that pawl 38 has been biased toward its ratchet checking position such that its engagement surface 62 is shown engaging edge surface 53 of ratchet 36.

Figure 21A:
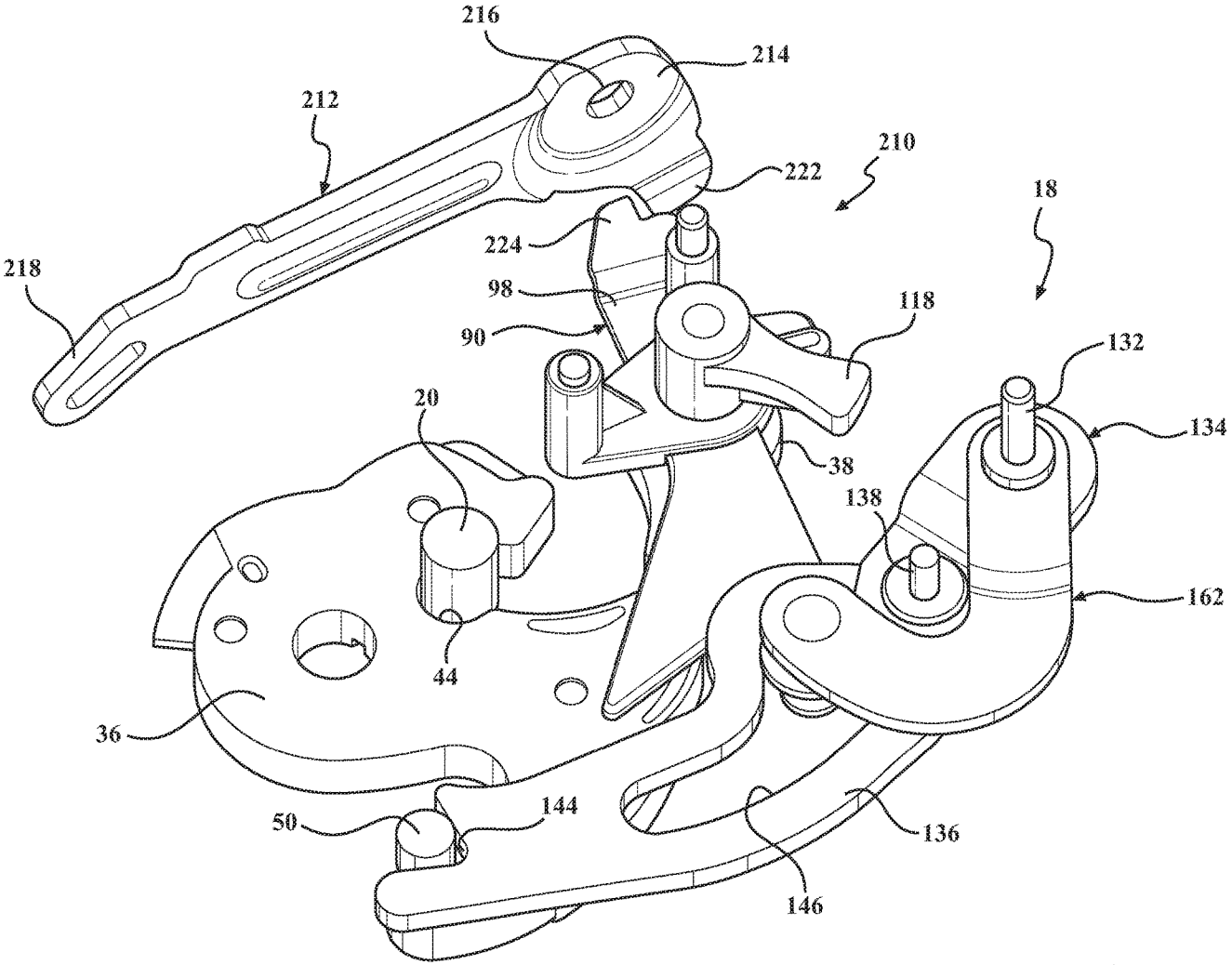
Figure 21B:
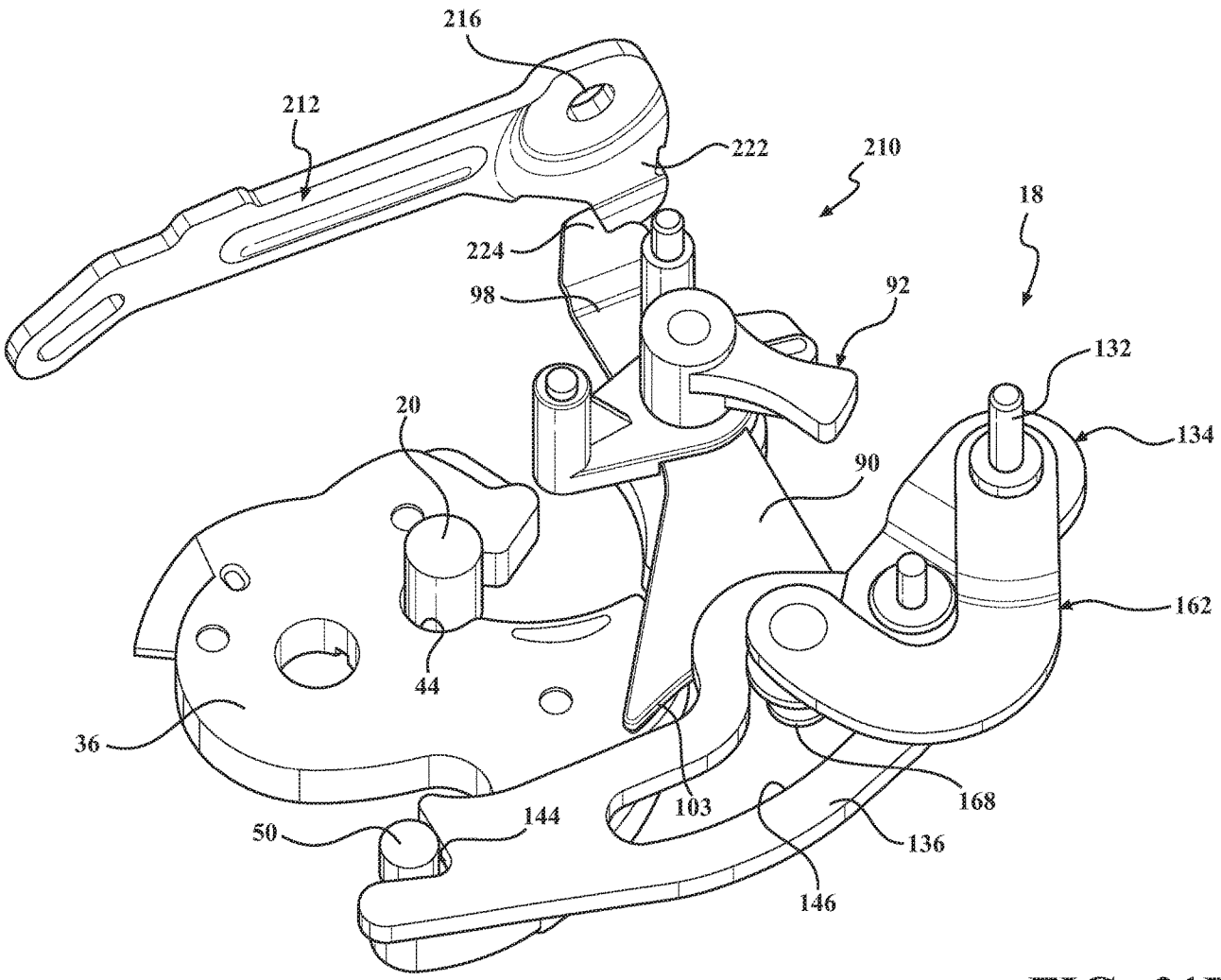
Figure 21C:
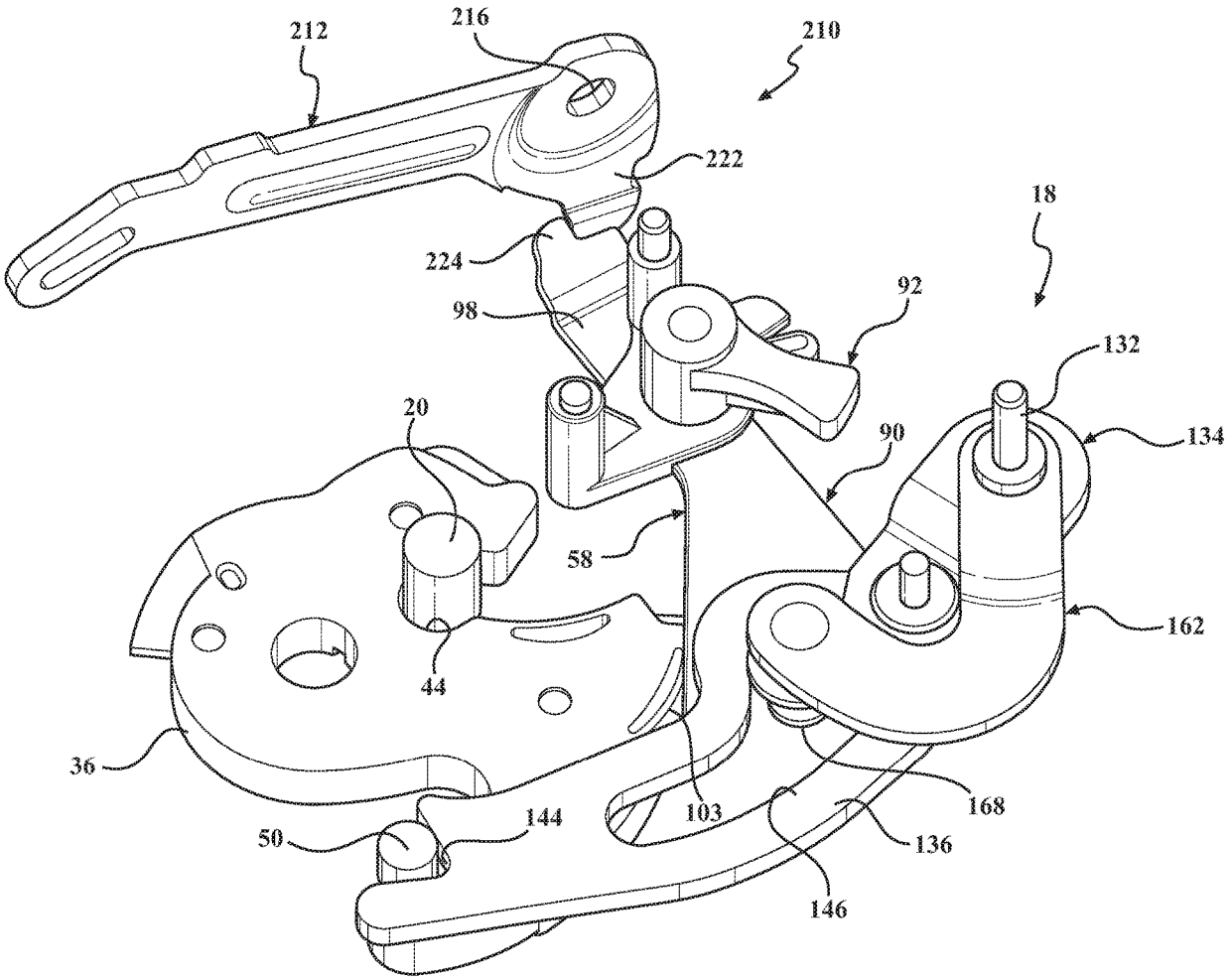
Figure 21D:
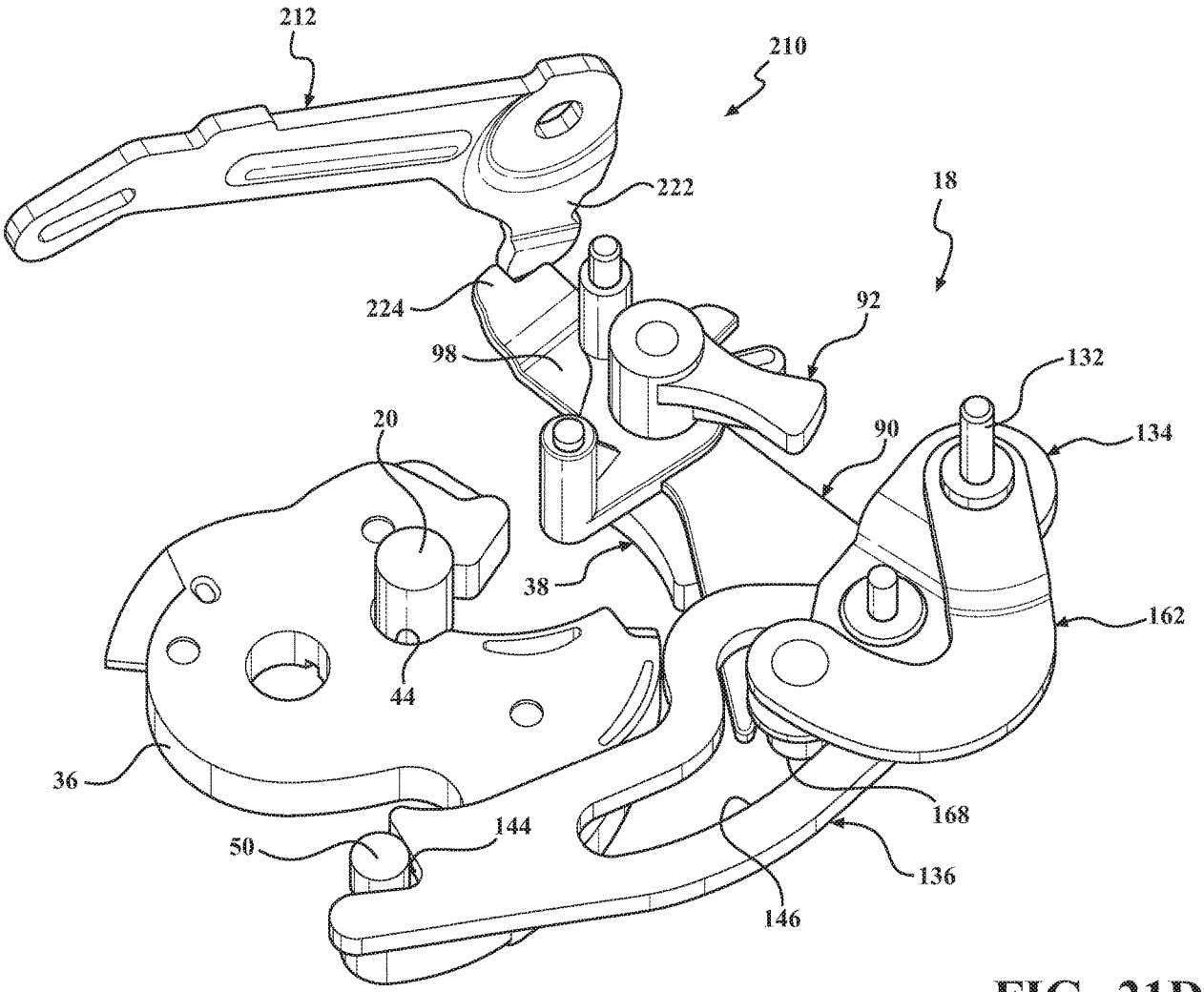
Figure 21E:
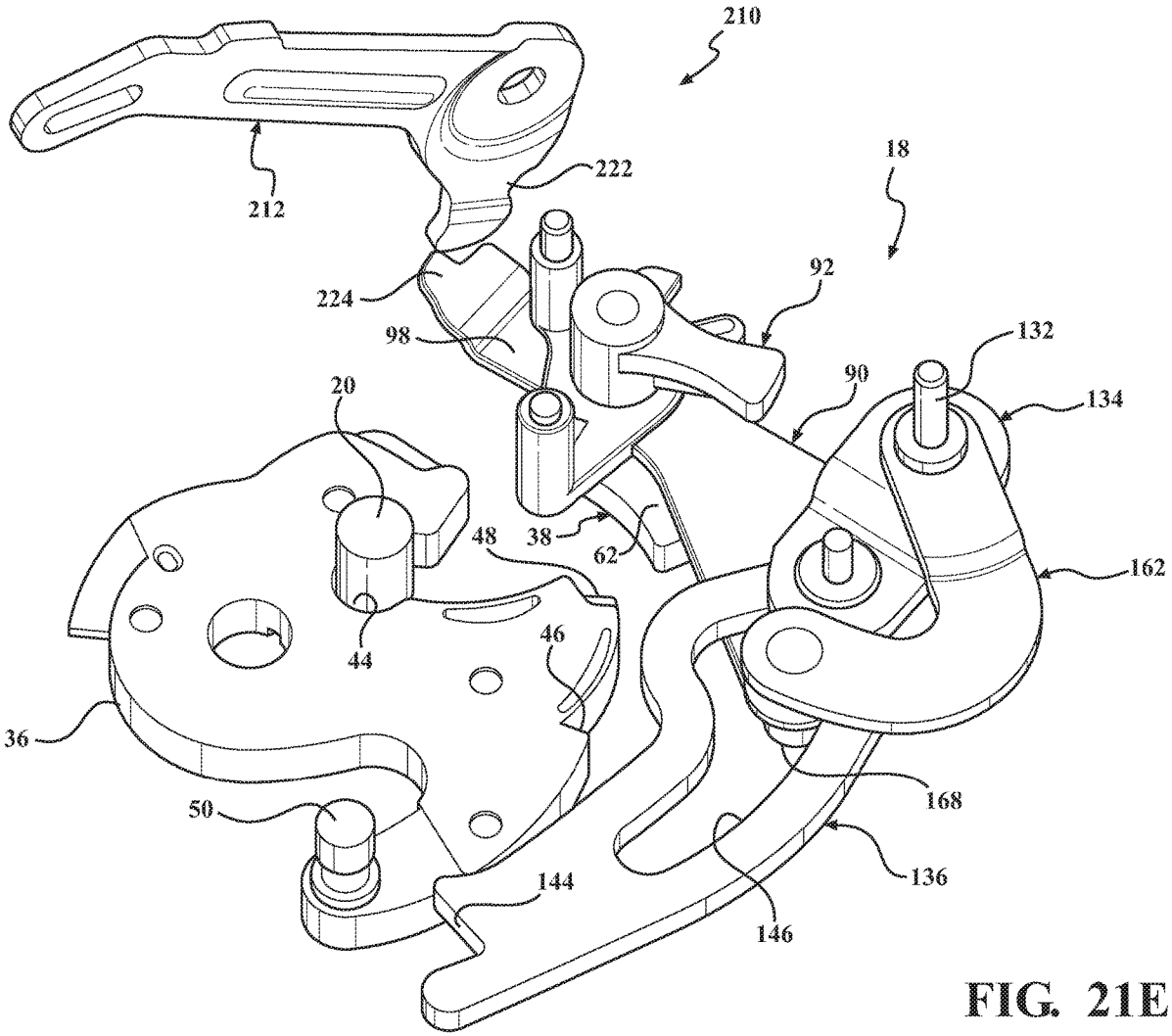

FIGS. 21A-21E illustrate a sequence of isometric views showing actuation of inside release mechanism 210 via pivotal movement of inside backup lever 212 from its non-actuated position (FIG. 21A) into its actuated position (FIG. 21E) which, in turn, causes pivotal movement of pawl lever 90 from its first pawl lever position (FIG. 21A) into its second pawl lever position (FIG. 21E). As previously noted, such movement of pawl lever 90 causes concurrent movement of pawl 38 from its ratchet checking position into its ratchet release position due to engagement of second bent end segment 100 with pawl leg 64. FIGS. 21D and 21E illustrate that such movement of pawl lever 90 also causes sliding and pivotal movement of cinch link lever 136 due to tapered cam segment 103 of pawl lever 90 acting on follower 168 of disengage lever 162. Specifically, follower 168 engages edges surface of slot 146 which forcibly moves cinch link lever 136. This movement of cinch link lever 136, in turn, results in the release of ratchet rivet 50 from engagement with shoulder 144 of cinch link lever 136 so as to subsequently permit rotation of ratchet 36 from its ratchet released position into its striker released position.

Figure 22A:
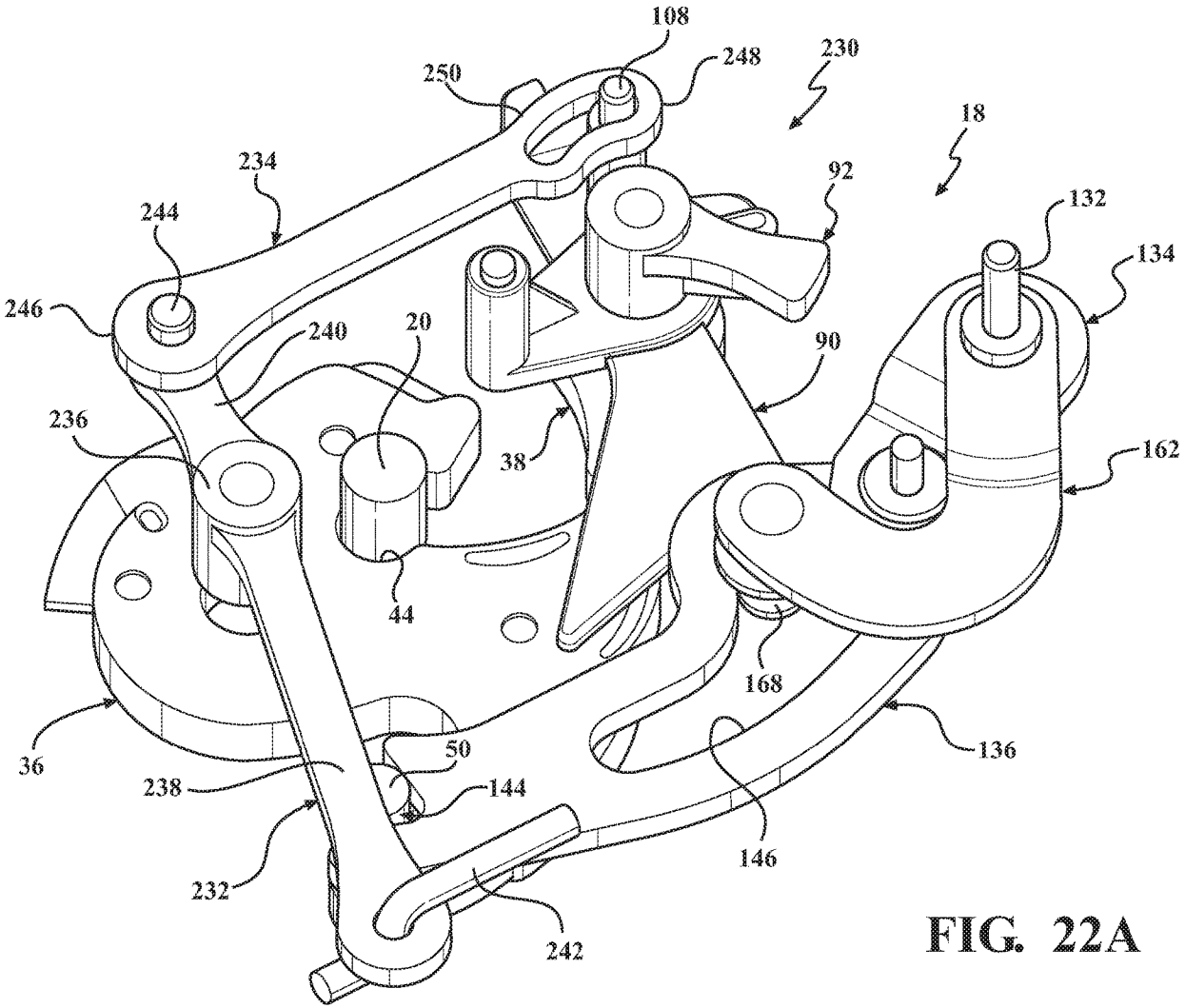
Figure 22B:
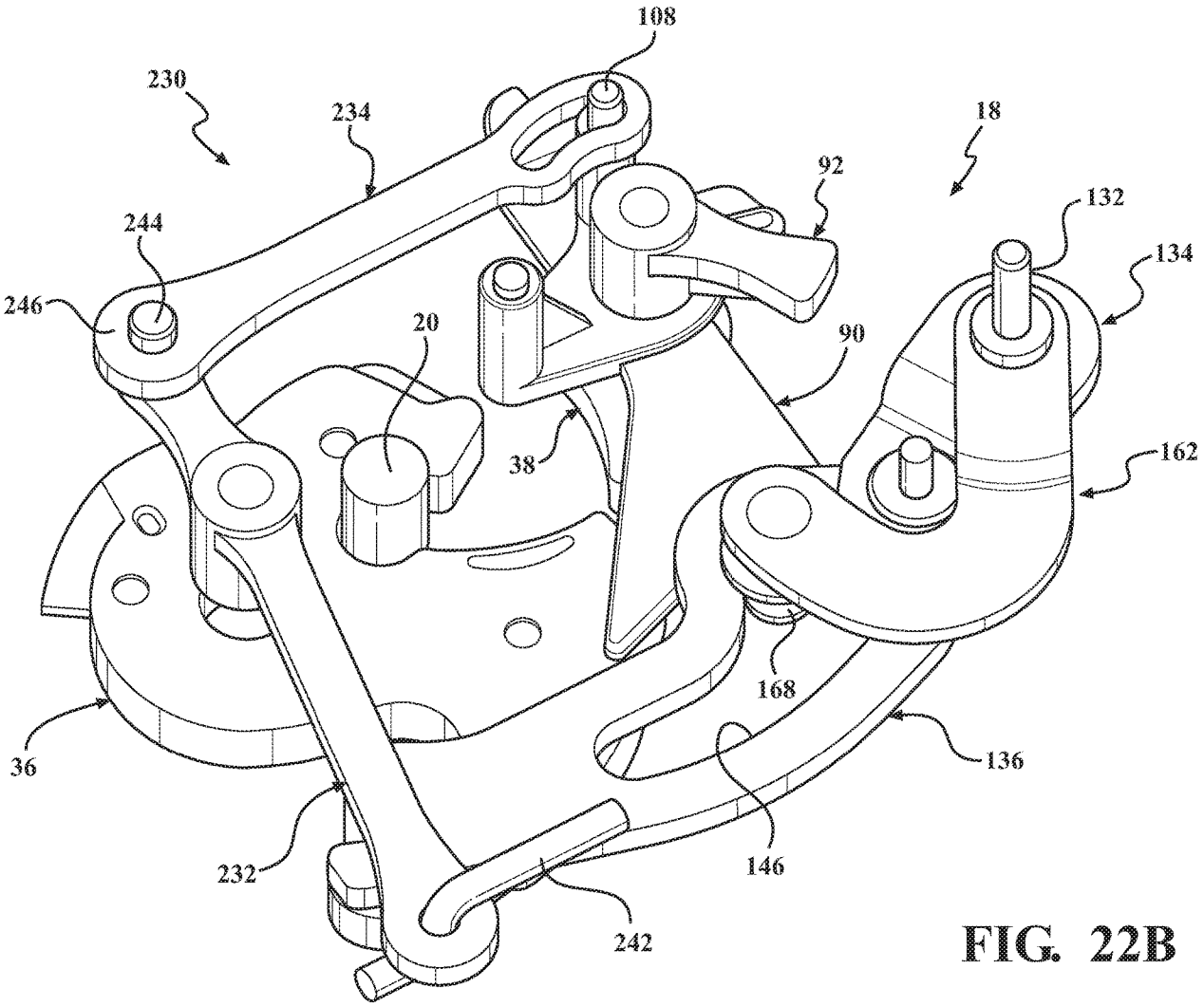
Figure 22C:
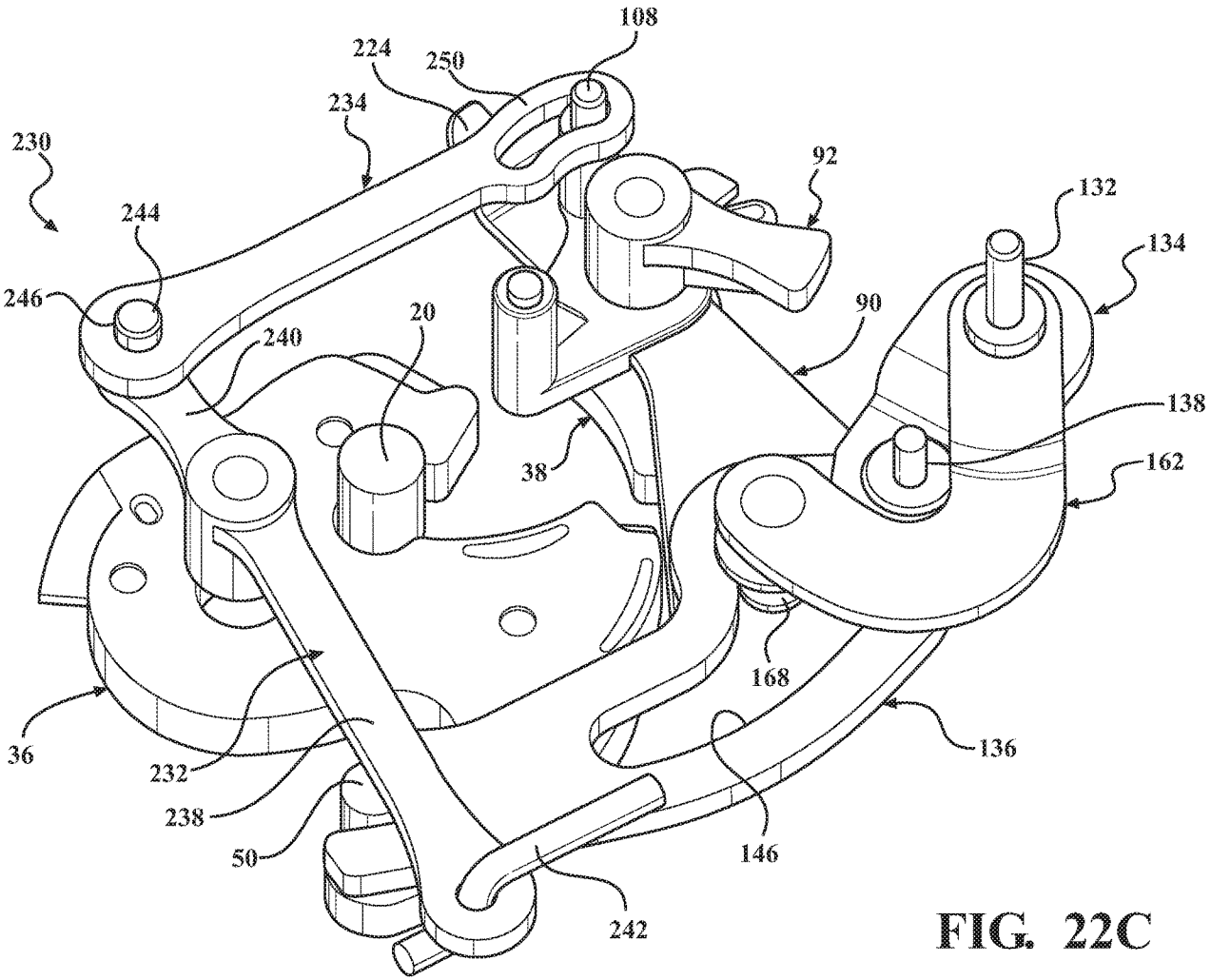
Figure 22D:
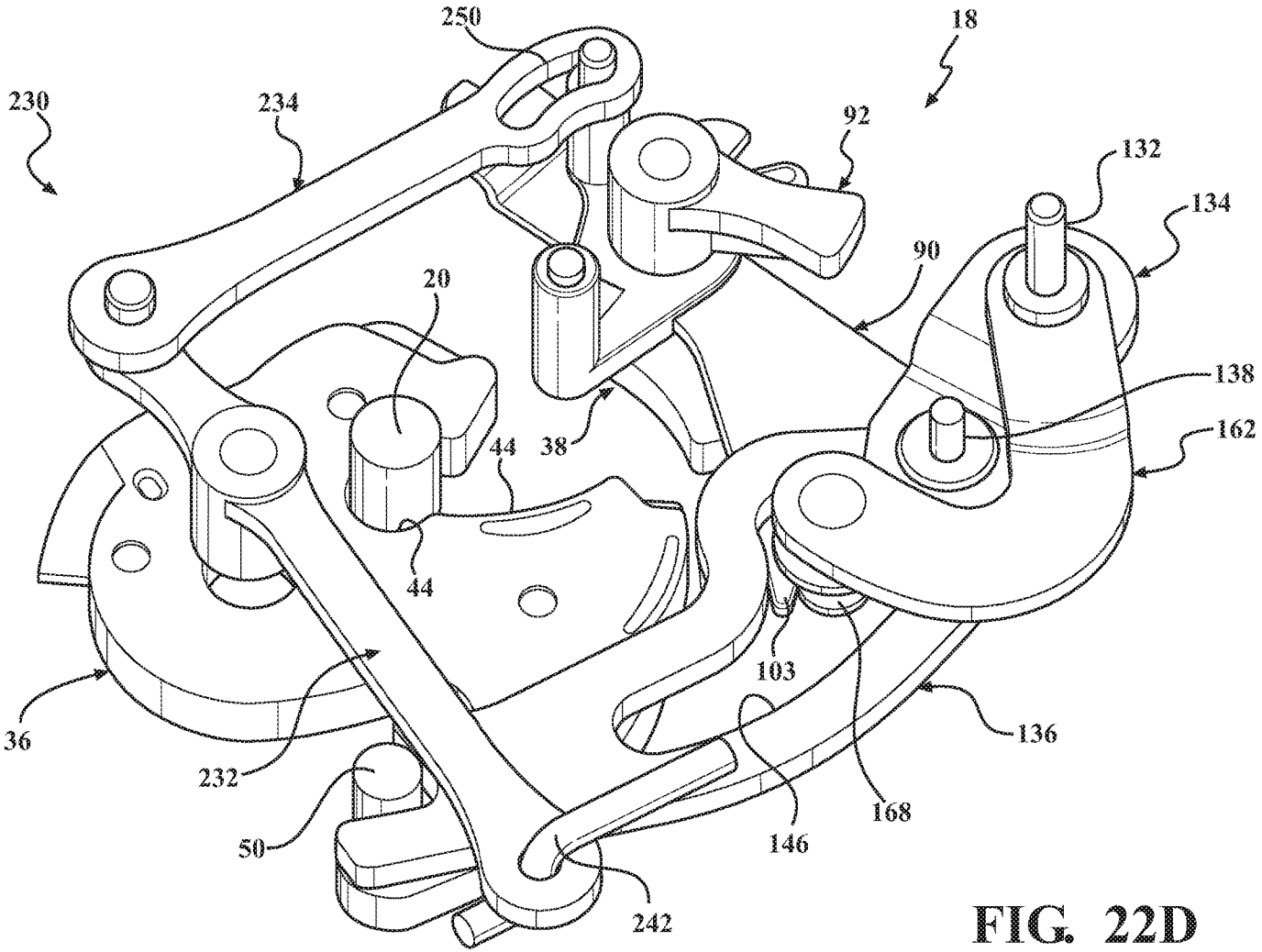
Figure 22E:
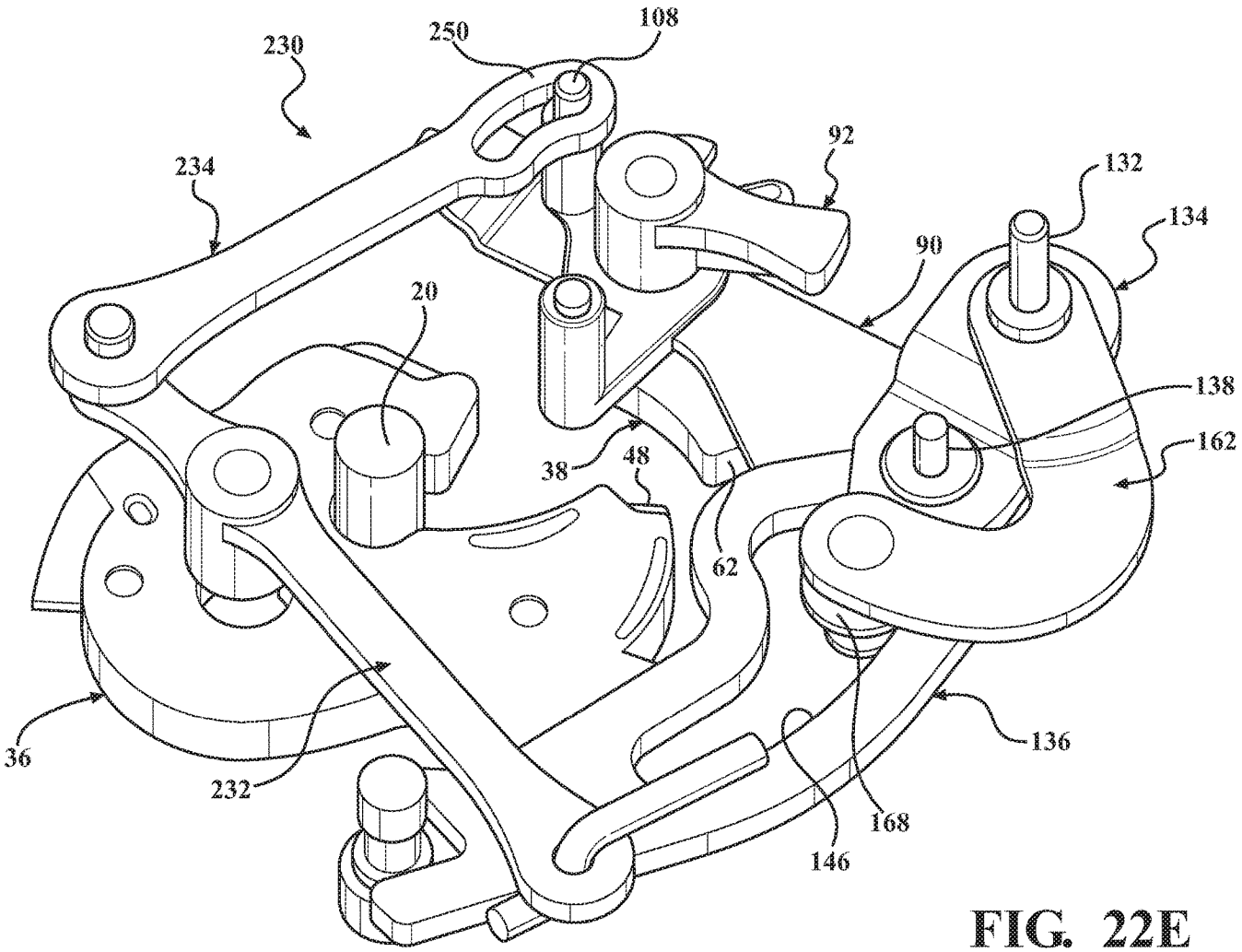

FIGS. 22A through 22E illustrate a sequence of isometric views showing actuation of outside release mechanism 230 via pivotal movement of outside backup lever 232 from its non-actuated position (FIG. 22A) into its actuated position (FIG. 22D) which, in turn, causes pivotal movement of pawl lever 90 from its first pawl lever position into its second pawl lever position. As seen, pivotal movement of backup lever 232 causes outside backup link 234 to pivot and slide such that engagement of lug 108 on pawl lever 90 with an edge of lost motion slot 250 results in coordinated movement of pawl lever 90 with backup lever 232. Again, such movement of pawl lever 90 results in movement of pawl 38 from its ratchet checking position (FIG. 22A) into its ratchet release position (FIG. 22E). Such movement of pawl lever 90 also causes its cam segment 103 to forcibly engage follower 168 and pivot disengage lever 162 to cause sufficient movement of cinch link lever 136 to release ratchet rivet 50, thereby releasing ratchet 36 for biased movement toward its striker release position.

Referring now to FIG. 23, a second embodiment of one-motor power latch assembly 18 is now generally identified as power latch assembly 18A. As is clear, the components of power latch assembly 18A are substantially similar to those shown for power latch assembly 18, and as specifically shown in FIG. 12A, to illustrate the cinch latched mode. To this end, ratchet 36 is held in its cinched striker capture position via latch cinch mechanism 130 while pawl 38 (not shown) is located in its ratchet checking position. Cinch gear 188 is shown located in its cinch stop position with motor 182 deenergized. As seen, a mechanical end stop 400, adapted to be rigidly secured to a structural frame portion of latch assembly 18A, is located in close proximity to a magnet hub 402 formed on gear 188. The force direction resulting from the seal loads or the strength condition, as indicated by arrows 404, attempts to rotate gear 188 in the cinching direction (indicated by arrow 406) in opposition to the releasing direction (indicated by arrow 408). This arrangement prevents gear 188 from rotating in the releasing direction in the event of a collision. Sensor 204 is again used to stop motor 182 for positively locating gear 188 in its cinch stop position such that gear hub 402 engages, or is slightly displaced from, end stop 400. Preferably, the cinch stop position is selected at a position where the forces and components create an "over-center" arrangement. This over-center arrangement and the mechanical end stop arrangement cumulatively assist in maintaining ratchet 36 in its cinched striker capture position without reliance on the gear geometry of gearset 184 or motor resistance. Those skilled in the art will recognize that this mechanical stop arrangement can likewise be integrated into power-operated cinch actuator arrangement 321 associated with two-motor power latch assembly 18'.

FIG. 24 illustrates another alternative version of one-motor power latch assembly 18, identified as power latch assembly 18B. This arrangement is generally similar to that shown in FIG. 23 for power latch assembly 18A with the exception that mechanical end stop 400 is now located to interact with cinch lever 134 instead of cinch gear 188 to provide the identical functions.

Referring now to FIGS. 25 through 34 of the drawings, a detailed description of yet another alternative embodiment of a power latch assembly, identified by reference numeral 18' and constructed in accordance with the present disclosure, will now be provided. In general, power latch assembly 18' is similar in structure and function to power latch assembly 18 but includes an alternative actuation mechanism that is configured to use a pair of power-operated actuators to provide the power cinching and power release features previously disclosed and described in detail. To this end, common components are hereinafter identified with common reference numerals, with no further description thereof required. Likewise, "primed" reference numerals are used to identify components of dual motor power latch assembly 18' that are slightly modified in terms of function and/or structure but which are directly related to components of power latch assembly 18.

In general, dual motor power latch assembly 18' is shown in a "built-up" construction in FIGS. 25-31 to include: latch mechanism 32 (FIG. 25); a latch release mechanism 72' (FIG. 26); cinch mechanism 130 (FIG. 27); cinch disengage mechanism 160 (FIG. 28); an actuation mechanism 180' including a release actuator arrangement 320 (FIG. 29) and a cinch actuator arrangement (FIG. 31); and an inside release mechanism 210' (FIG. 32). While not shown, dual motor power latch assembly 18' is adapted to also include outside release mechanism 230 as previously disclosed and shown (FIG. 8) in association with power latch assembly 18.

Referring to FIG. 25, latch mechanism 32 is generally identical to that shown in FIG. 2 and described previously such that the structure, function and positions of the components of latch assembly 32 are considered to be understood.

Referring now to FIG. 26, dual motor power latch assembly 18' is shown to include latch release mechanism 72' having a pawl lever 90', a release lever 92', and an inside backup lever 300, all three of which are mounted for independent pivotal movement on pawl pivot pin 60. Pawl lever 90' includes an elongated plate segment 94' and a flange segment 96'. Plate segment 94' of pawl lever 90' is configured to include a first bent end segment 98', a second bent end segment 100', and an intermediate segment defining an arcuate lost motion slot 302 and a drive tab 304. Arrow 104 indicates pawl spring 66 again acts to normally bias pawl lever 90' in a first (clockwise) rotary direction. Pawl lever 90' is pivotably moveable between first and second pawl lever positions. Second bent end segment 100' extends through second guide slot 80 in latch housing 70 and directly engages leg segment 64 of pawl 38. Thus, pawl lever 90' is located in its first pawl lever position when pawl 38 is located in its ratchet checking position and the second pawl lever position is established when pawl 38 is located in its ratchet release position. Lugs 106' and 108' are formed on flange segment 96'. Magnet 110' is fixed to lug 106' and cooperates with pawl sensor 112 to detect and provide a positional signal indicative of the position of pawl lever 90' and, in turn, the position of pawl 38.

Release lever 92' includes a first drive arm segment 118' and a second drive arm segment 306 which is configured to extend through lost motion slot 302 in pawl lever 90'. Arrows 122A and 122B illustrate an over-center biasing member configured to normally bias release lever 92' to a centered non-actuated position. As before, release lever 92' can be rotated in both directions from its non-actuated position. Inside backup lever 300 is configured to include a first end segment 312, a second end segment 314, and an intermediate segment 316 having a lost motion slot 318 generally aligned with a portion of lost motion slot 302 formed in pawl lever 90' and into which second drive arm segment 306 of release lever 92' extends.

FIG. 27 illustrates the components of latch cinch mechanism 130 associated with the dual motor power latch assembly 18'. In addition, FIG. 28 illustrates the components of cinch disengage mechanism 160. Those skilled in the art will recognize that the structure and function of these components were previously described in detail referring to single motor power latch assembly 18 and perform the same functionality in association with dual motor power latch assembly 18'.

Referring to FIGS. 29 and 30, actuation mechanism 180' is disclosed to provide a first power-operated actuator arrangement 320 for controlling the power release function and a second power-operated actuator arrangement 321 for controlling the power cinching function. Thus, power latch assembly 18' is configured as a two-motor version of the single-motor power latch assembly 18. Latch control system 114 is again shown schematically in FIG. 29 and FIG. 31.

Power-operated actuator arrangement or power-operated release actuator 320 is shown in FIG. 29 configured to generally include an electric motor 322, a gearset 324, a pawl release lever 326, and a pawl release lever biasing member 328. Gearset 324 includes a worm 330 driven by the output of electric motor 322 and a power release gear 332 driven by worm 330. Power release gear 332 is supported for rotation about a gear pivot post 334 and includes a geared section 336 and a body section 338. Geared section 336 includes a sector of gear teeth 340 in constant meshed engagement with threads of worm 330. Body section 338 is shown to include an elongated drive arm 342. Pawl release lever 326 is supported from latch housing 70 for rotation about a pivot point 344 and is configured to include a first lug segment 346, a second lug segment 348, and a spring retainer segment 350. Pawl release lever biasing member 328 acts between spring retainer segment 350 and latch housing 70 to normally bias pawl release lever 326 in a first rotary direction (counterclockwise) toward a non-actuated position (shown). As seen, first lug segment 346 on pawl release lever 326 is located in close proximity to drive arm 342 of power release gear 332 while second lug segment 348 is located in close proximity to first bent end segment 98' of pawl lever 90'. As will be described, pawl lever 90' is located in its first pawl lever position when pawl release lever 326 is located in its non-actuated position. Likewise, pawl lever 90' is located in its second pawl lever position when pawl release lever 326 is located in an actuated position.

Rotation of pawl release lever 326 between its non-actuated position and its actuated position is caused by rotation of power release gear 332 between a "release start" position and a "release stop" position in response to controller unit 113 of latch control system 114 receiving a release signal from power release switch 117. Electric motor 322 controls the direction of rotation of power release gear 332. Specifically, rotation of power release gear 332 in a releasing direction (counterclockwise in FIG. 29) from its release start position toward its release stop position causes drive arm 342 to engage first lug segment 346 and forcibly rotate pawl release lever 326, in opposition to the biasing of spring 328, from its non-actuated position into its actuated position. Such rotation of pawl release lever 326 causes its second lug segment 348 to engage first bent end segment 98' of pawl lever 90' and forcibly pivot pawl lever 90' about pivot 60 from its first pawl lever position into its second pawl lever position, thereby forcibly pivoting pawl 38 from its ratchet checking position into its ratchet release position.

Referring now to FIG. 30, dual motor power latch assembly 18' is further shown with second power-operated actuator arrangement or power-operated cinch actuator 321 which is configured to include many components of actuator mechanism 180 associated with power latch assembly 18. As before, electric motor 182 still controls rotation of cinch gear 188 between its cinch start and cinch stop positions. Cinch gear 188 includes integral drive flange 190 having drive slot 192, recessed segment 194 and cam segment 196. Drive post 198 on cinch lever 134 is again retained within drive slot 192 to coordinate movement of cinch mechanism 130 with rotation of cinch gear 188.

Power latch assembly 18' is further shown in FIG. 31 to include an inside release mechanism 210' having inside release lever 212 configured to provide a mechanical backup release system for moving pawl 38 from its ratchet checking position into its ratchet release position and for actuating cinch disengage mechanism 160 for causing ratchet rivet 50 to be released from engagement shoulder 144 on cinch link lever 136, thereby allowing ratchet 36 to rotate to its striker release position. A first end segment 214 of inside release lever 212 is pivotably attached to latch housing 70 about pivot point 344 and a second end segment 218 is adapted to be mechanically coupled to inside door handle 24. Spring 328 acts on inside release lever 212, in addition to pawl release lever 326, and normally biases inside release lever 212 in a first direction (counterclockwise) toward a non-actuated position (shown). In its non-actuated position, drive tab 222 on inside release lever 212 is disengaged from first end segment 312 of inside backup lever 300 which is normally located in a first inside backup lever position. Rotation of inside release lever 212 in a second direction (clockwise) toward an actuated position (not shown) causes its drive tab 222 to engage end segment 312 on inside backup lever 300 and forcibly pivot inside backup lever 300 to a second inside backup lever position. As will be described, such movement of inside backup lever 300 from its first inside backup lever position to its second inside backup lever position acts to coordinate movement of pawl 38 from its ratchet checking position into its ratchet release position with the disengagement of ratchet 50 on ratchet 36 from engagement shoulder 144 on cinch link lever 136 for permitting ratchet 36 to move into its striker release position.

Power latch assembly 18' is configured to provide a power cinching operation solely via actuation of power-operated cinching actuator 321 and a soft opening power release operation via coordinated actuation of both power-operated actuators 320 and 321. As before, the power cinching operation is employed to rotate ratchet 36 from either of its low-energy/soft close striker capture position (FIG. 13A) or its high-energy/hard close striker capture position (FIG. 13B) into its fully closed/cinched striker capture position (FIG. 13C). In this regard, the soft close cinch perception (angle A in FIG. 14A) and the hard close cinch perception (angle B in FIG. 14B) are again provided with ratchet 36 being mechanically held in its cinched striker capture position by cinch mechanism 130. The power cinching operation is again initiated upon detection of pawl 38 being located in its pawl checking position via sensor 112 and controller 113 of latch control system 114 actuating electric motor 182 for rotating cinch gear 188 from its cinch start position into its cinch stop position.

Figure 33A:
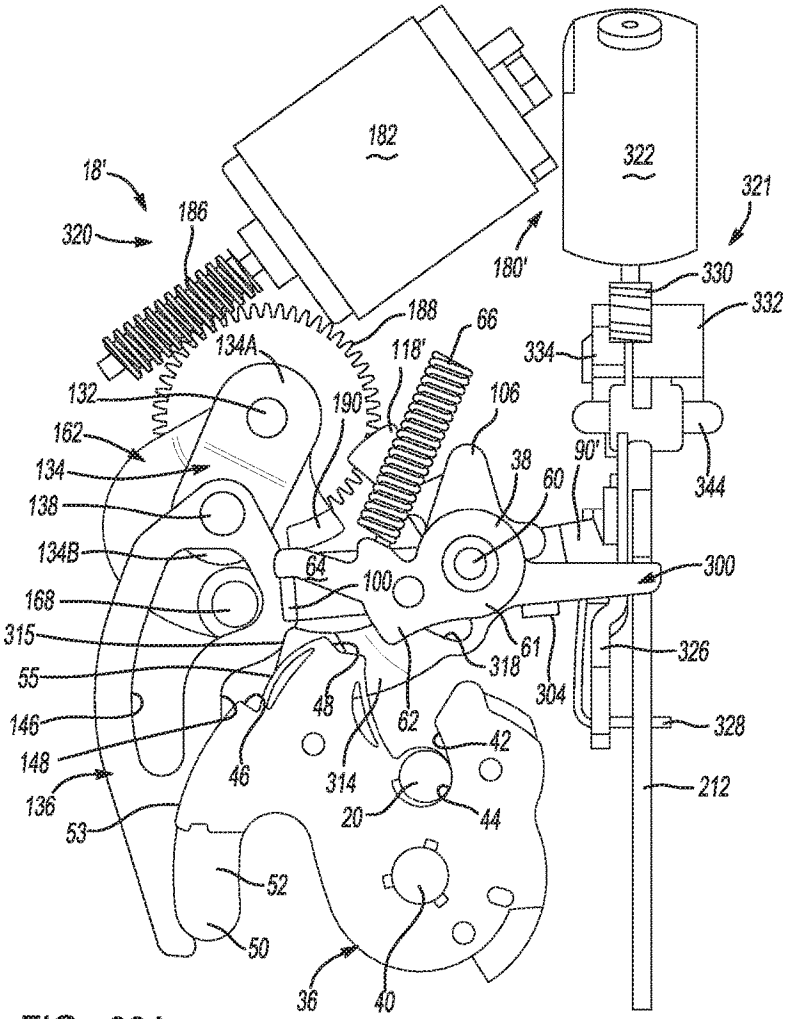
Figure 32A:
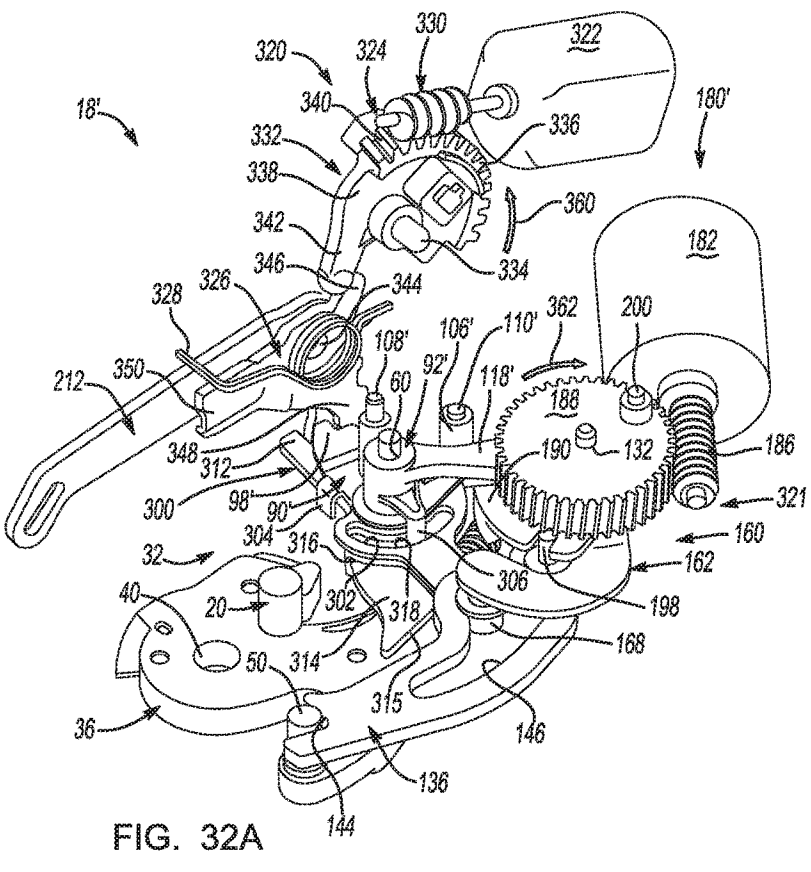
Figure 33B:
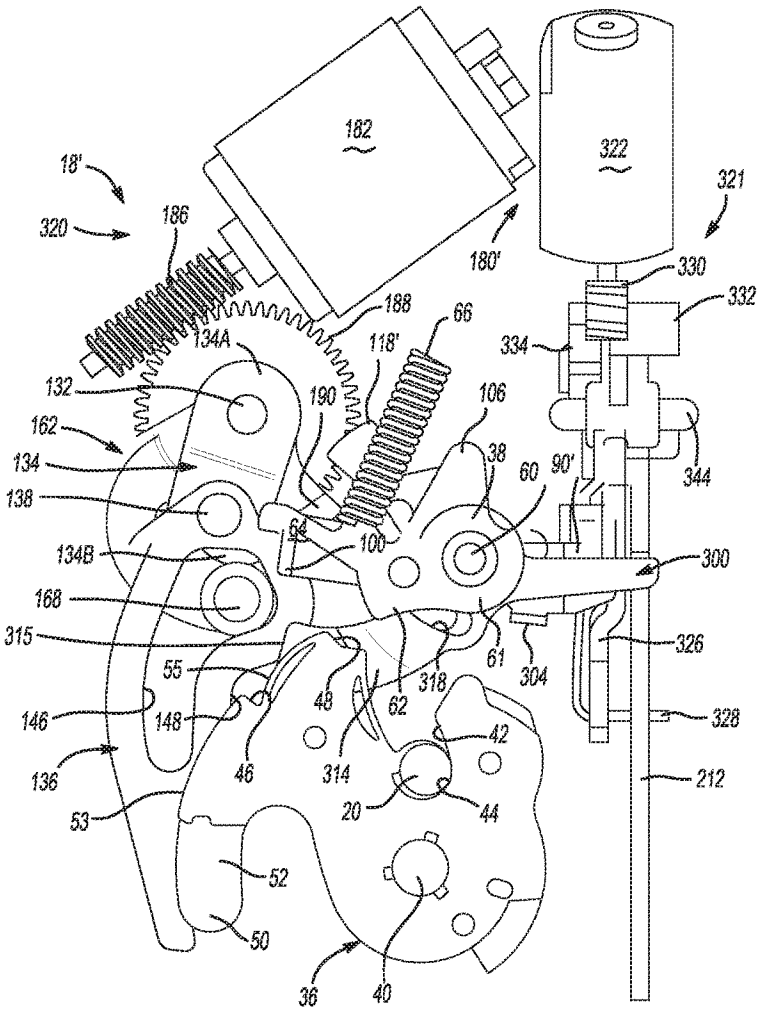
Figure 32B:
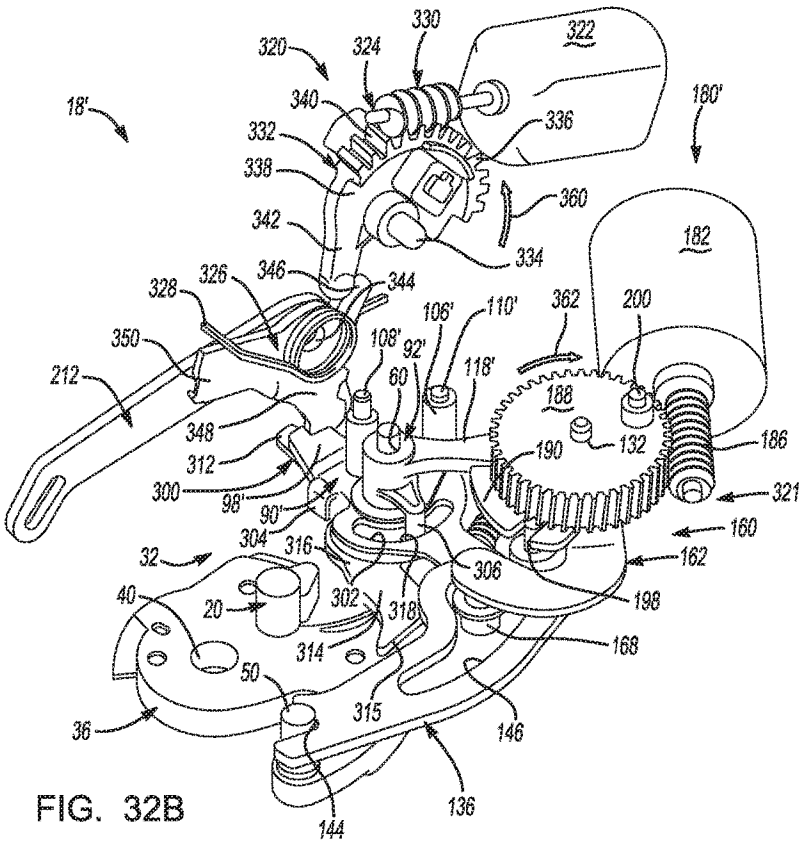
Figure 33C:
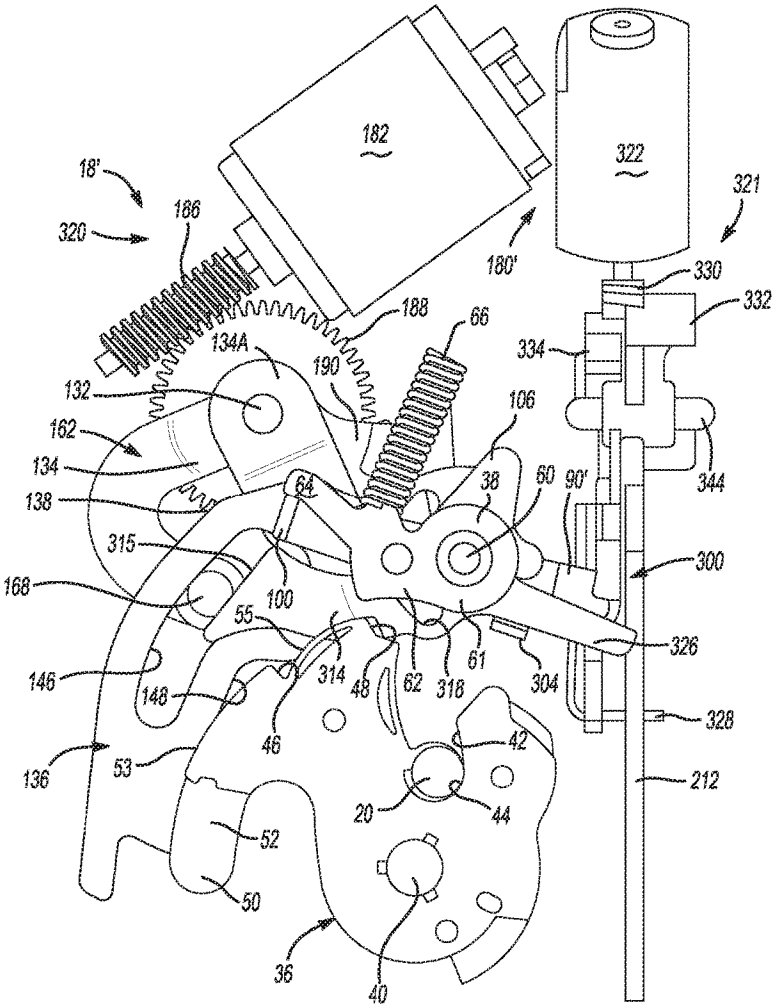
Figure 32C:
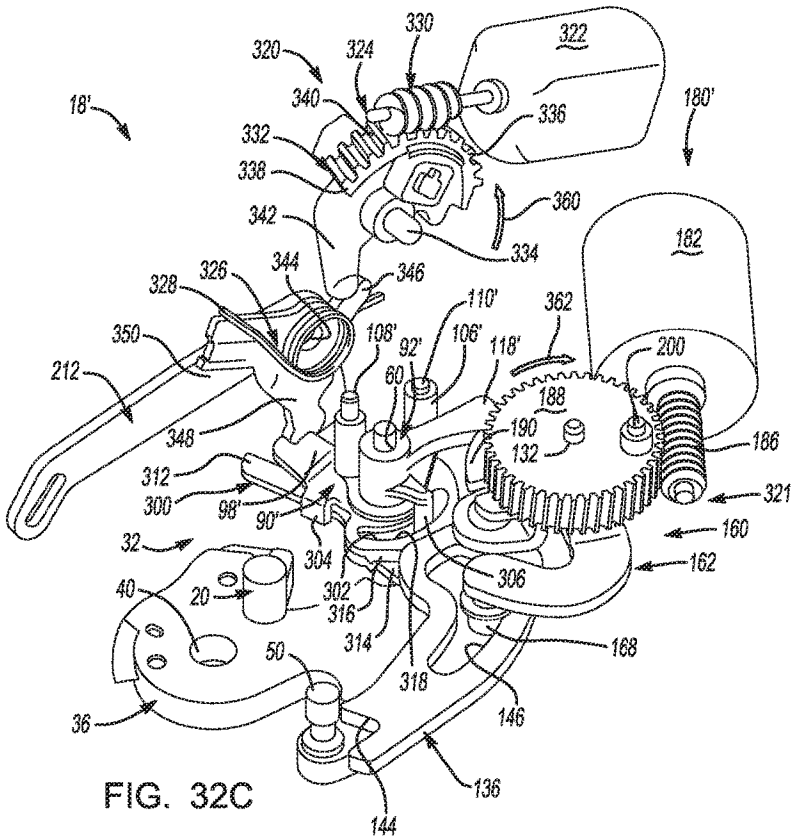
Figure 33D:
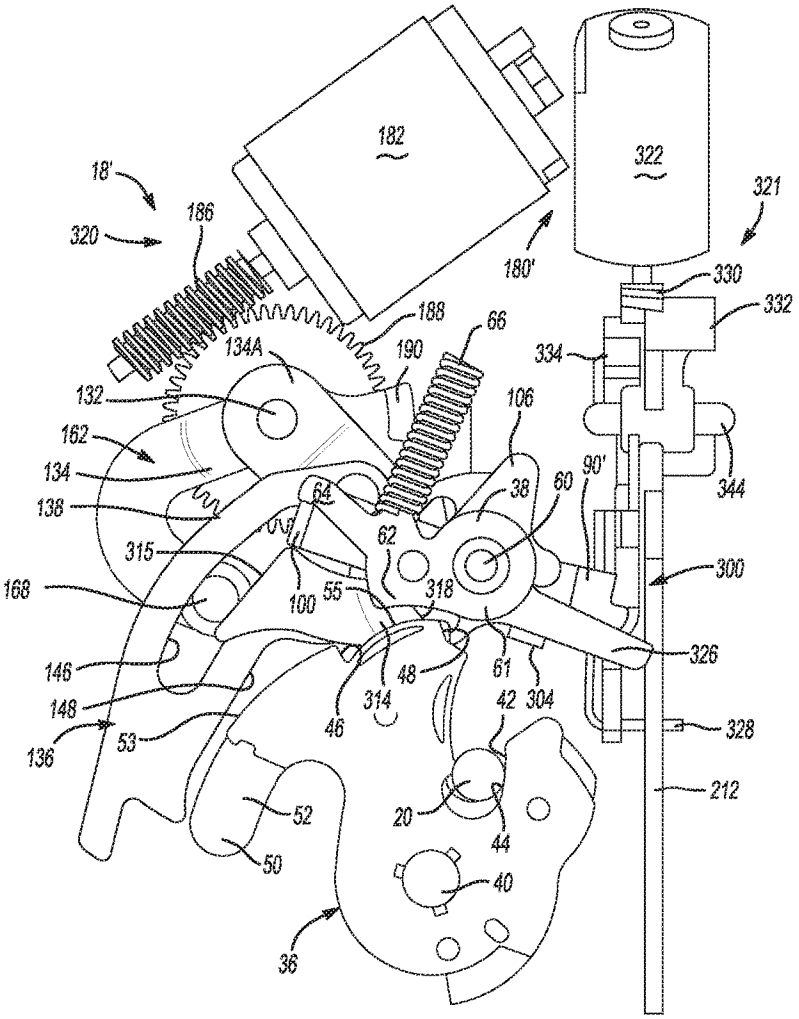
Figure 32D:
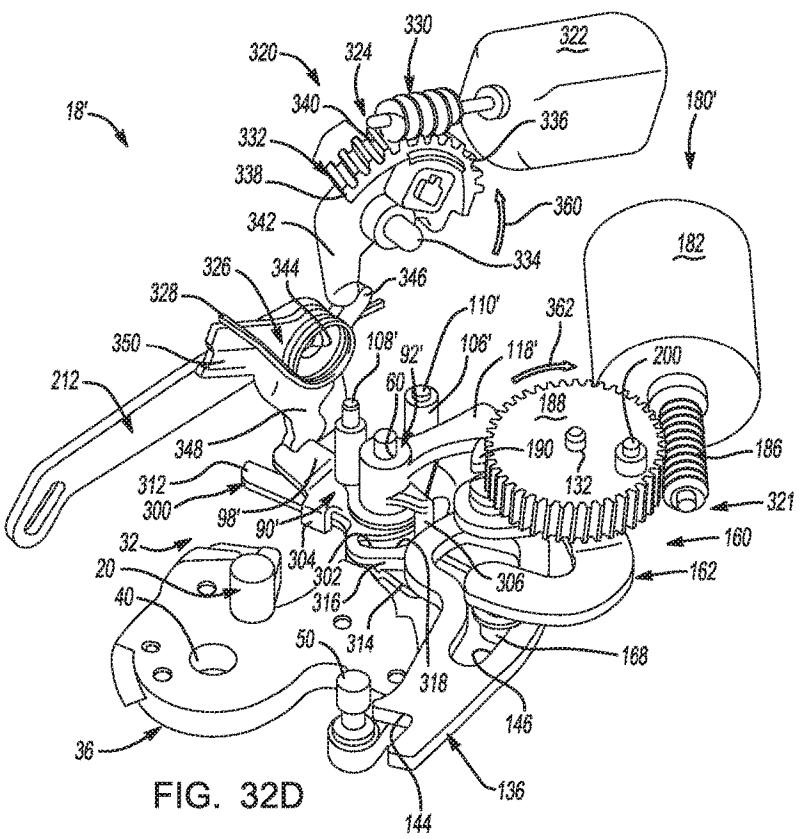
Figure 33E:
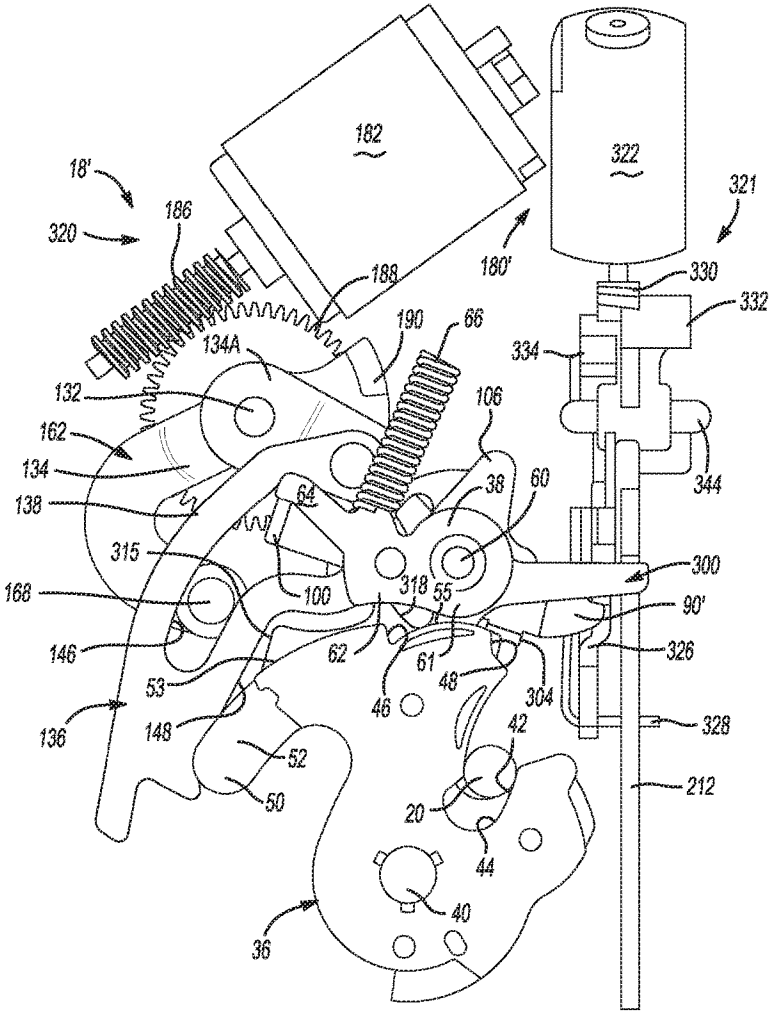
Figure 32E:
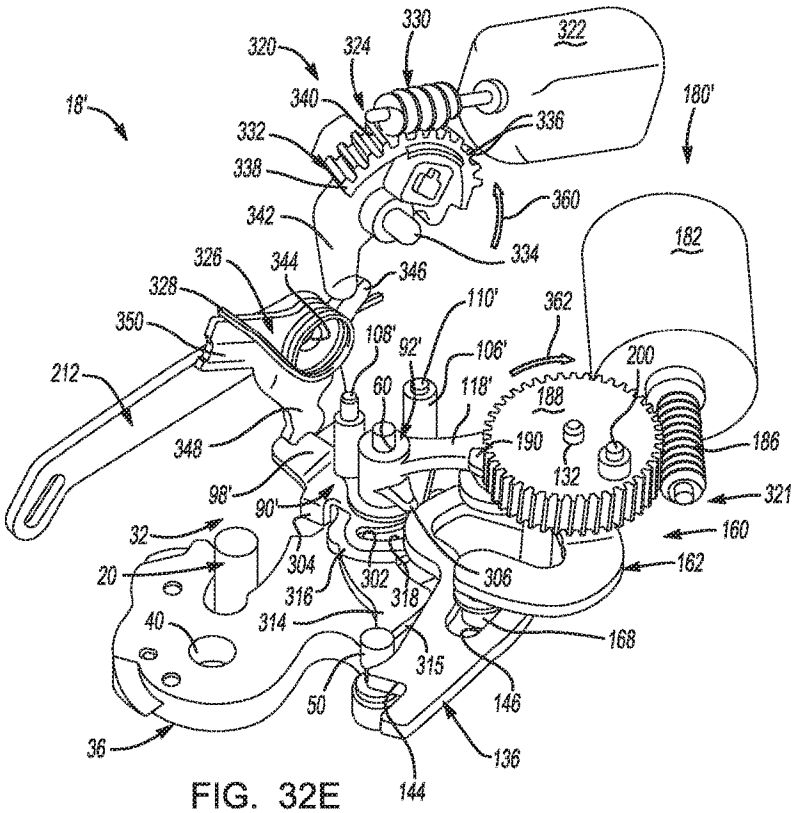
Figure 33F:
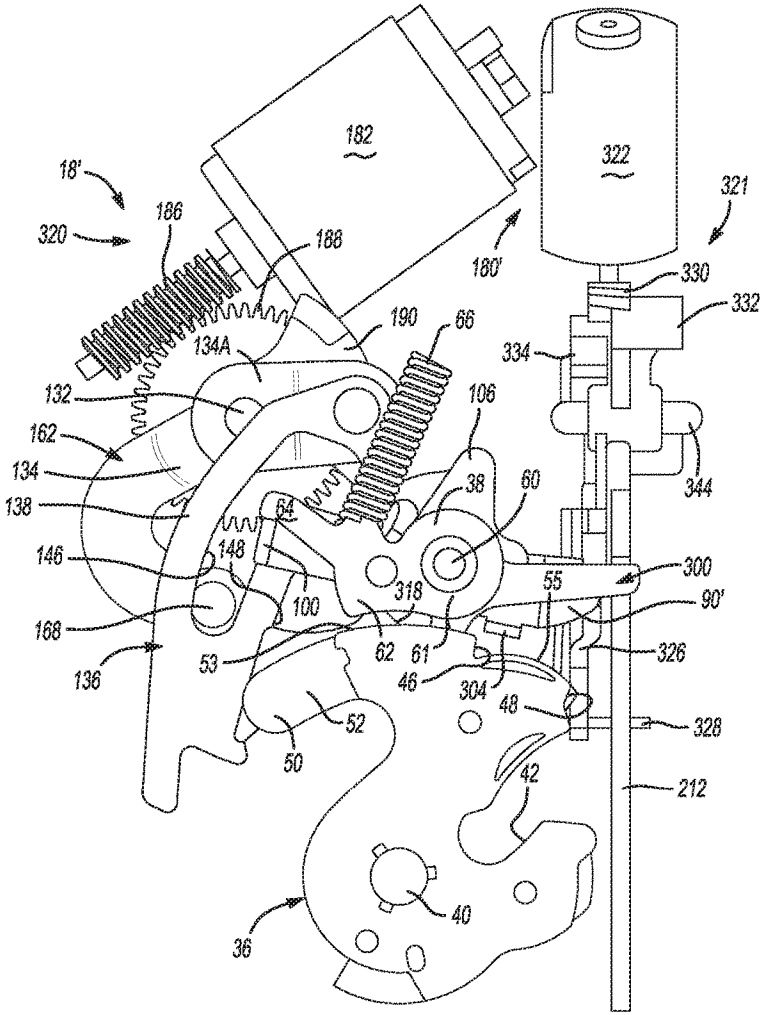
Figure 32F:
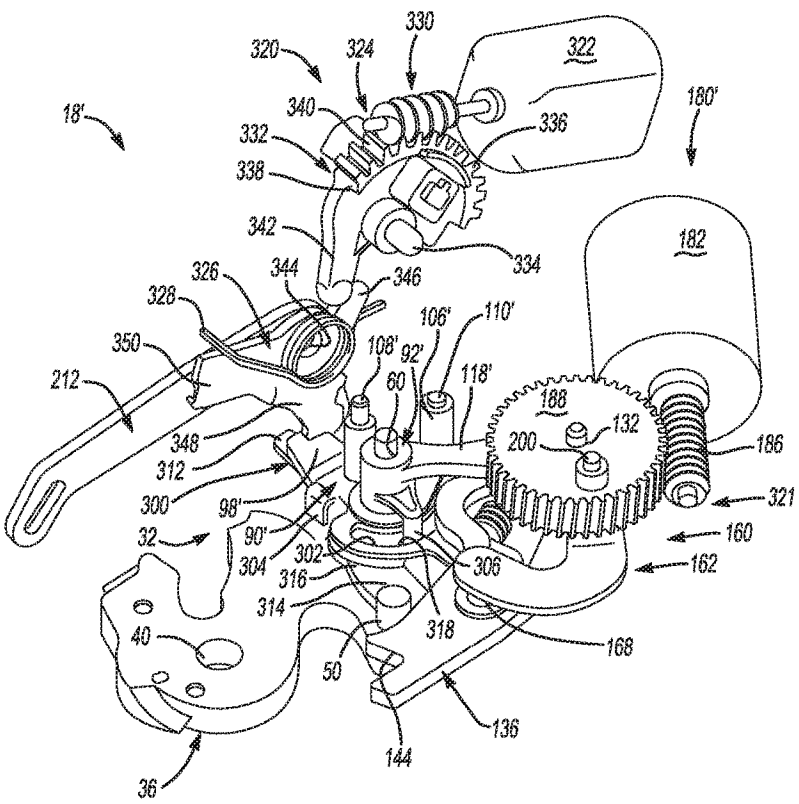

Referring now to FIGS. 32A through 32F and 33A through 33F, two corresponding series of sequential views of dual motor power latch assembly 18' are provided to illustrate the relative movement of the components required to complete the power release function. In this regard, FIGS. 32A and 33A show ratchet 36 held in its cinched striker capture position via engagement of ratchet rivet 50 with engagement shoulder 144 on cinch link lever 136. In addition, pawl 38 is located in its ratchet checking position, cinch gear 188 is located in its cinch stop position, and power release gear 332 is located in its release start position. Upon receipt of a signal from power release switch 117, power release motor 322 is actuated to rotate power release gear 332 in the direction indicated by arrow 360 for rotating pawl release lever 326 from its non-actuated position toward its actuated position. A position sensor 333 provides a position signal to latch control system 114 indicative of the position of power release gear 332. In addition, cinch motor 182 is actuated to rotate cinch gear 188 in the direction indicated by arrow 362 from its cinch stop position toward its cinch start position.

Following the sequence of illustrations provided in FIGS. 32 and 33, it is shown that actuation of power release motor 322 to rotate power release gear 332 in the releasing direction (arrow 360) from its release start position (FIGS. 32A, 33A) to its released stop position (FIGS. 32C, 33C) results in pivotal movement of pawl lever 90' from its first pawl lever position into its second pawl lever position which, in turn, functions to forcibly pivot pawl 36 from its ratchet checking position into its ratchet release position. In coordination with this rotation of power release gear 332, cinch motor 182 is actuated to rotate cinch gear 188 in the uncinching direction (arrow 362) from its cinch stop position (FIGS. 32A, 33A) to its cinch start position (FIGS. 32F, 33F). This functions to initially move ratchet 36 from its cinched striker capture position into its uncinched striker capture position for uncinching striker 20 (the soft opening feature) and subsequently causes ratchet rivet 50 to be released from engagement with engagement shoulder 144 so as to permit ratchet 36 to rotate to its striker release position (FIGS. 32F, 33F).

In particular, rotation of cinch gear 188 in the direction of arrow 362 causes cam segment 196 on cinch gear 188 to engage first drive arm segment 188' and forcibly pivot release lever 92' from its central non-actuated position into its second actuated position. Such pivotal movement of release lever 92' about pivot 60 causes its second drive arm segment 306 to engage an end surface of lost motion slot 318 formed in inside backup lever 300 and forcibly cause inside backup lever 300 to pivot about pivot 60 in a first direction (counterclockwise) from its first inside backup lever position into its second inside backup lever position. Such pivotal movement of inside backup lever 300 results in its cam edge surface 315 engaging follower 168 and forcibly moving follower 168 into engagement with an edge surface of guide slot 146 in cinch link lever 146. This camming action, in combination with pivotal movement of cinch lever 134 about pivot 132 due to retention of drive post 198 with cinch gear drive slot 192, causes cinch link lever 136 to pivot and translate for moving engagement shoulder 144 out of engagement with ratchet rivet 50. Since pawl 38 is held in its ratchet release position by pawl lever 90', ratchet 36 is subsequently permitted to move to its striker release position.

Upon cinch gear 188 reaching its cinch start position (FIGS. 32F, 33F), cinch motor 182 is stopped and power release motor 322 is reversed to rotate power release gear 332 back to its release start position. It will be recognized that rotation of cinch gear 188 to is cinch start position permits first drive arm segment 118' of release lever 92' to disengage cam segment 196 of cinch gear 188 and enter recessed segment 194 which functions to return release lever 92' to its central non-actuated position and permits inside backup lever 300 to pivot back to its first inside backup lever position whereat it engages bent tab 304 formed on pawl lever 90'.

Since the power-operated components associated with the power cinching function have not been modified, it will be appreciated that ratchet 36 is still configured to be mechanically positioned in either of its soft closed striker capture or hard closed striker capture positions upon initial contact with striker 20 during a door closing condition. As indicated, this action results in ratchet rivet 50 engaging shoulder 144 on cinch link lever 136. Thereafter, cinch motor 182 is actuated to rotate cinch gear 188 in its cinching direction from its cinch start position into its cinch stop position which results in continued rotation of ratchet 36 into its cinched striker capture position due to the interaction of the cinch mechanism components. As noted, cinch mechanism 130 functions to hold ratchet 36 in its third/cinched striker capture position while pawl 38 is positioned in its ratchet checking position. However, pawl surface 62 does not engage ratchet 36 in accordance with the power cinch features of this invention.

Figure 34A:
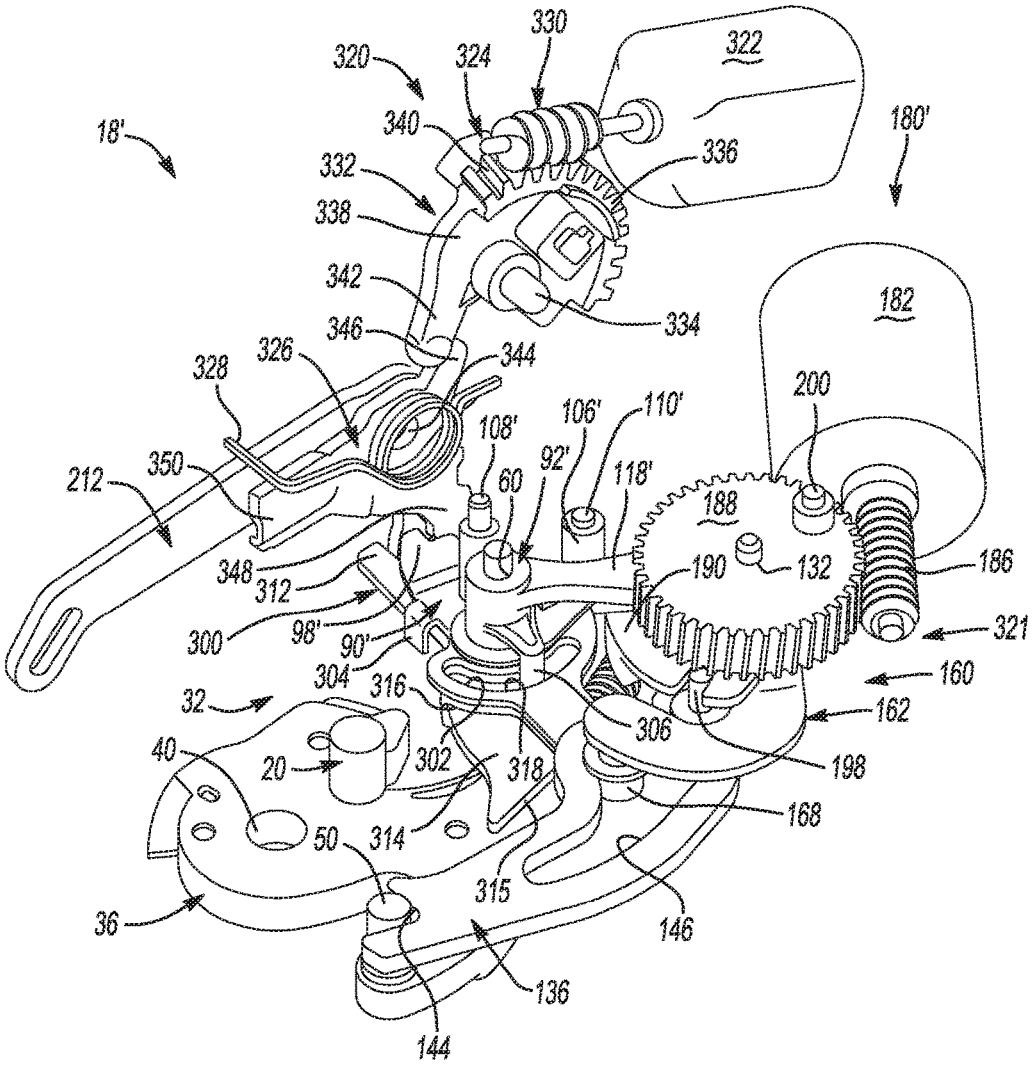
Figure 34B:
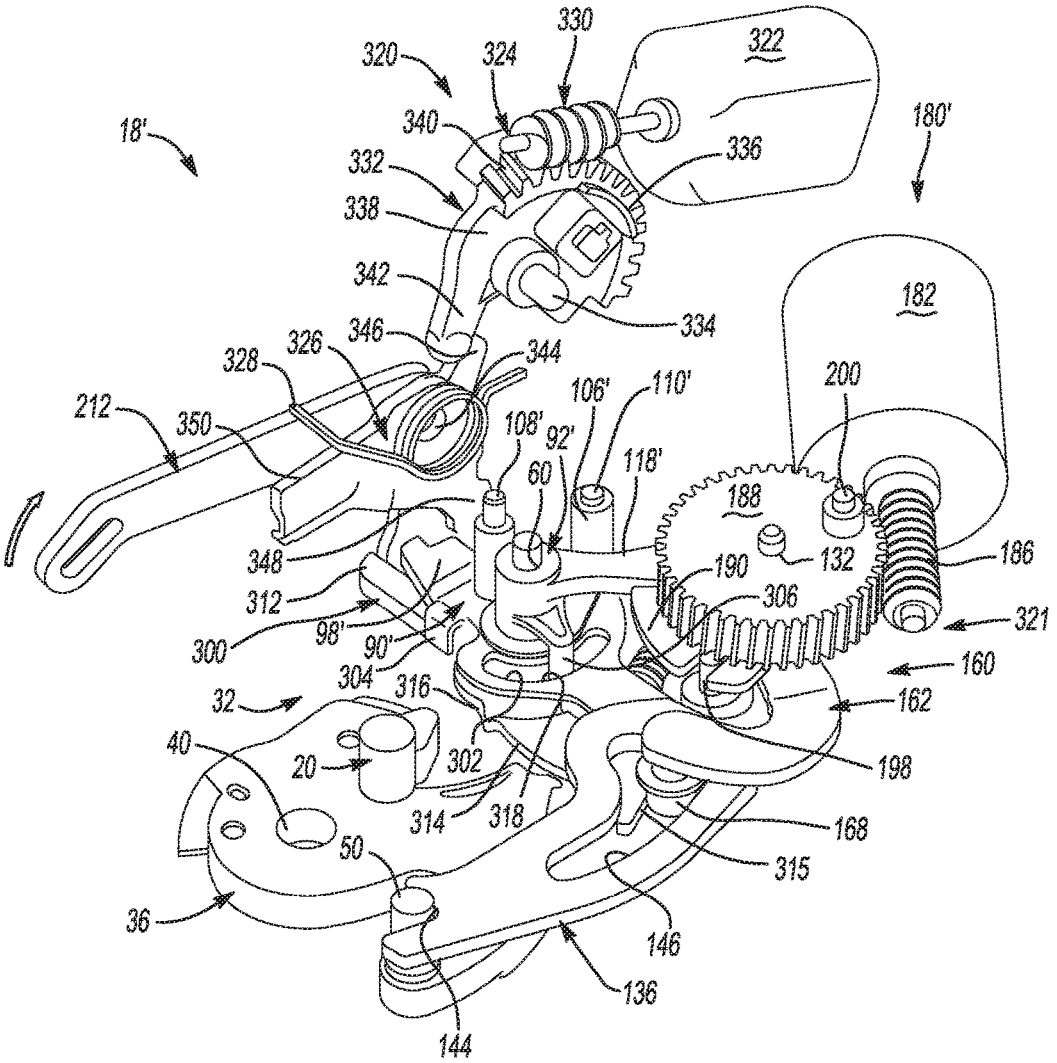
Figure 34C:
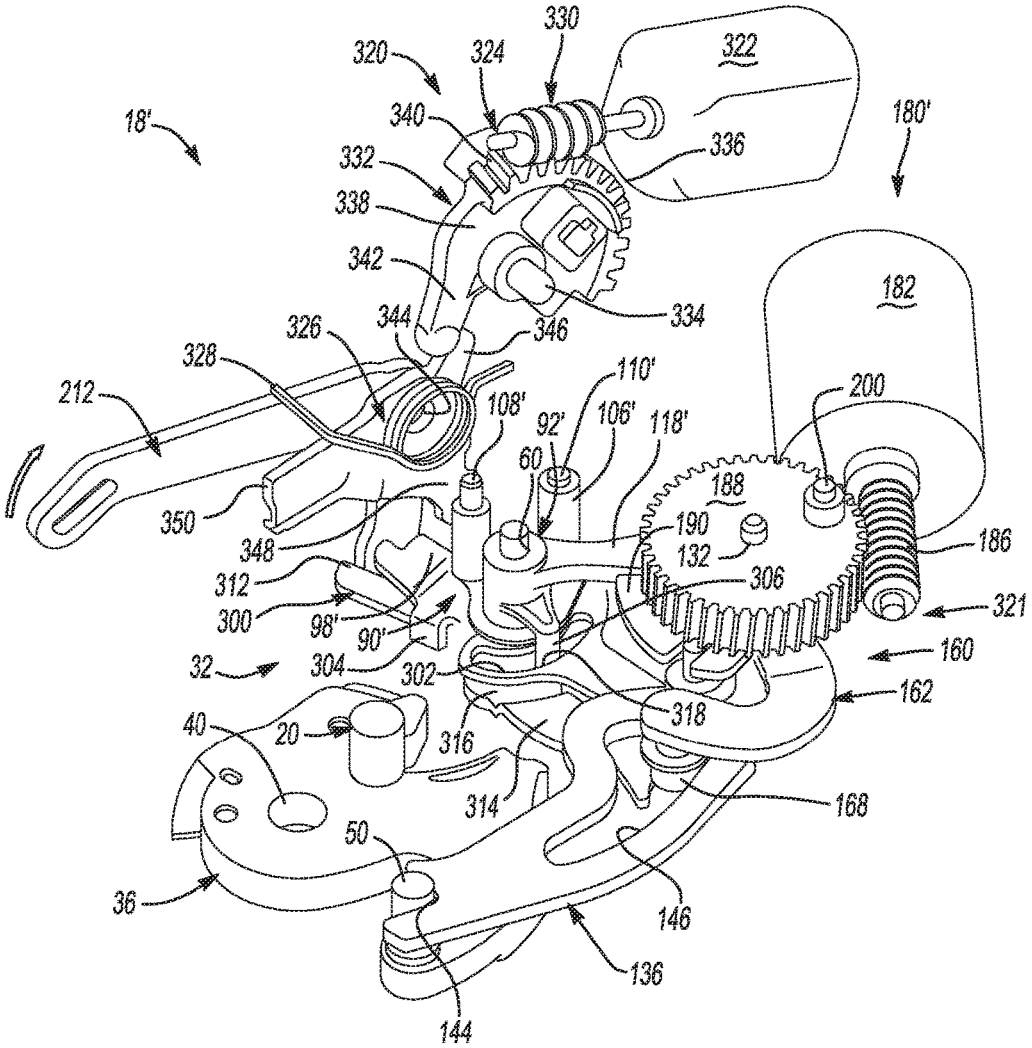
Figure 34D:
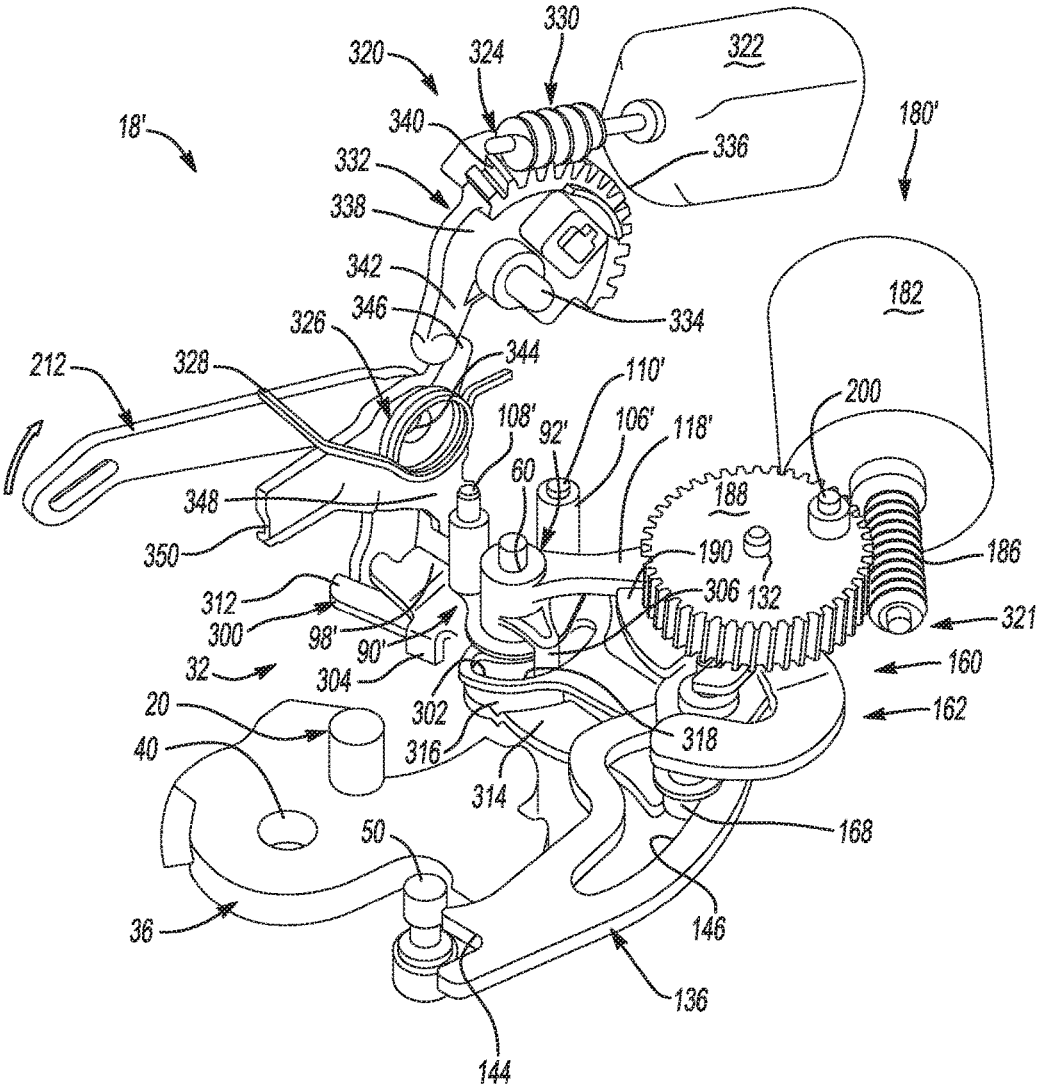
Figure 34E:
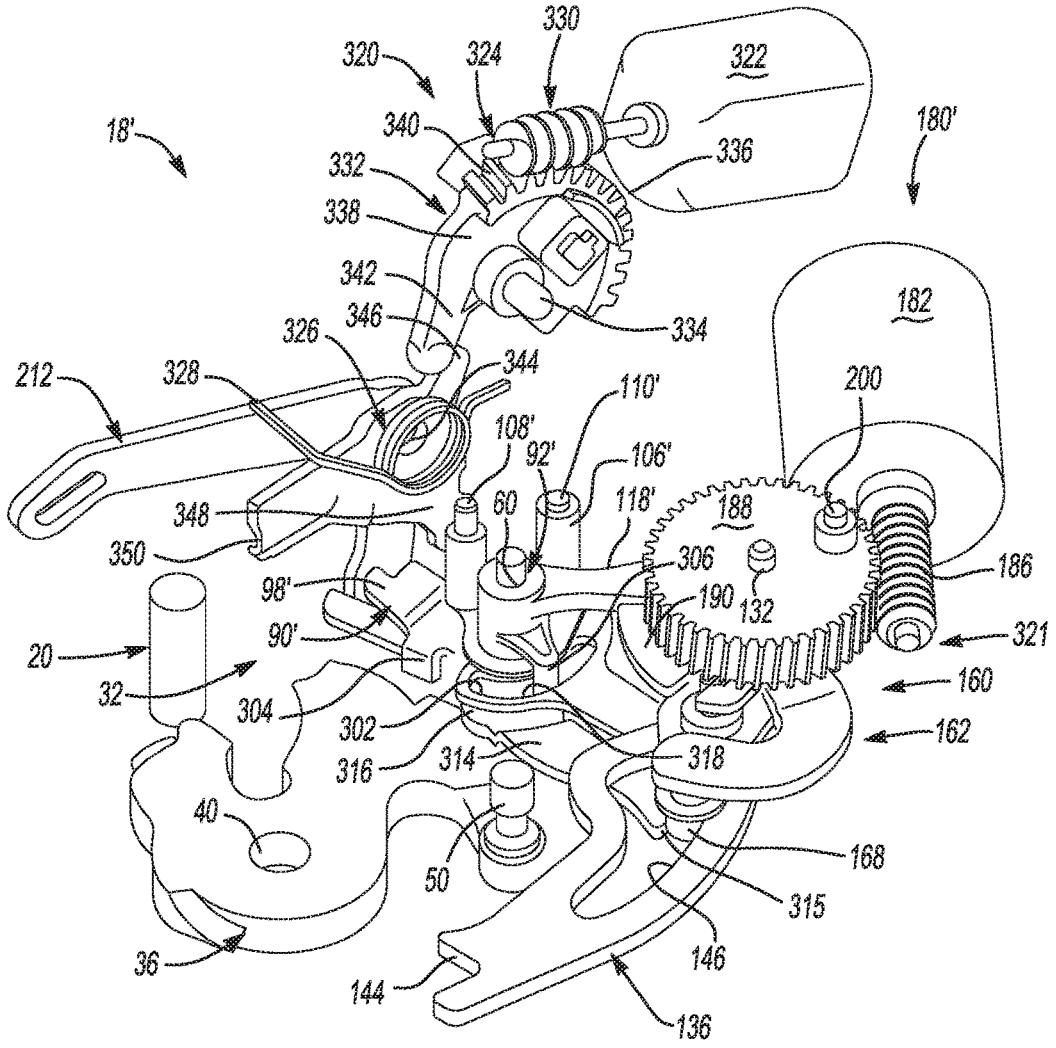

Referring now to FIGS. 34A through 34E, a series of sequential isometric views are provided to illustrate manual opening of the door via actuation of inside release mechanism 210'. FIG. 34A illustrates ratchet 36 in its cinched striker capture position, pawl 38 in its ratchet checking position, cinch gear 188 in its cinch stop position, and power release gear 332 located in its release start position, all established with dual motor power latch assembly 18' in its cinch latched mode. As seen, pivotal movement of inside release lever 212 about axis 344 from its non-actuated position (FIG. 34A) to its actuated position (FIG. 34E) causes pivotal movement of inside backup lever 300 between its first position and its second position due to engagement of drive tab 222 with end segment 312. Such pivotal movement of inside backup lever 300 causes coordinated movement of pawl lever 90' from its first pawl lever position into its second pawl lever position due to engagement of inside backup lever 300 with bent tab 304 on pawl lever 90'. This movement of pawl lever 90' causes pawl 38 to forcibly pivot from its ratchet checking position into its ratchet release position. In addition, such pivotal movement of backup lever 300 causes its cam edge 315 to engage follower pin 168 and cause cinch link lever 136 to pivot about its axis 136 with cinch lever 134 so as to move engagement shoulder 144 out of engagement with ratchet rivet 50. Once ratchet rivet 50 is released, with pawl 38 held in its ratchet release position, ratchet 36 is permitted to rotate to its striker release position.

Each of the power latch assemblies described above is adapted to overcome acknowledged shortcomings of conventional power latch devices including the elimination of the audible "pop" sound generated upon quick release of the seal loads and use of the cinch actuator to always assist in completing the door closing function independently of the closing energy applied to the door. The cinch actuator associated with the power latch assemblies of the present disclosure is configured to drive the ratchet slowly in a release direction from its cinched striker capture position to its cinch released striker capture position to provide a predetermined amount of striker travel selected to significantly reduce the seal load prior to complete release of the ratchet. While latch control system 114 is only schematically shown in association with controller 113 and various sensors that are configured to provide input signals used to control coordinated control of electric motor 182 in the one-motor versions of power latch assembly 18, 18A and 18B, those skilled in the art will appreciate that any suitable controllers, sensors and control schemes can be used to provide the required functionality disclosed herein.

In addition, each of the power latch assemblies described above is adapted to provide a mechanical coupling arrangement between the ratchet and the cinch link lever that is configured to cause movement of the ratchet to its cinched striker capture position during the power cinching operation, to hold the ratchet in its cinched striker capture position, and to cause movement of the ratchet from its cinched striker capture position to its cinch released striker capture position during the soft opening power release operation. While this mechanical coupling arrangement has been disclosed to include a projection extending from the ratchet that is releaseably engageable with an engagement shoulder formed on the cinch link lever, those skilled in the art will understand that the present disclosure contemplates and includes alternative mechanical coupling arrangements. For example, a projection could extend from the cinch link lever for releaseable engagement with an engagement shoulder formed on the ratchet. As a further alternative, engageable lugs can be formed on each of the ratchet and the cinch link lever that are configured to provide a releaseable mechanical coupling arrangement. Thus, the present disclosure embodies a mechanical coupling arrangement having a first engagement member associated with the cinch link lever that is releaseably engageable with a second engagement member associated with the ratchet.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A power latch assembly for a motor vehicle, comprising:

a ratchet moveable between a striker release position whereat said ratchet is positioned to release a striker and three distinct striker capture positions whereat said ratchet is positioned to retain the striker, wherein said three distinct striker capture positions include a first striker capture position, a second striker capture position and a third striker capture position;

a ratchet biasing member for normally biasing said ratchet toward its striker release position;

a pawl moveable between a ratchet checking position whereat said pawl is positioned to hold said ratchet in one of its first and second striker capture positions and a ratchet release position whereat said pawl permits movement of said ratchet to its striker release position;

a pawl biasing member for normally biasing said pawl toward its ratchet checking position;

a latch cinch mechanism having a cinch lever and a cinch link lever pivotably connected to said cinch lever, wherein said cinch link lever includes a first engagement member configured to selectively engage a second engagement member on said ratchet when said ratchet is initially rotated into one of its first and second striker capture positions; and an actuation mechanism including an electric motor, a cinch gear driven by said electric motor, and a cam flange fixed for common rotation with said cinch gear, wherein said cam flange includes a drive slot with a drive post extending from said cinch lever being disposed within said drive slot for coordinating pivotal movement of said cinch lever and said cinch link lever with rotation of said cam flange and said cinch gear;

wherein a power cinching function is provided by said electric motor rotating said cinch gear in a cinching direction from a cinch start position to a cinch stop position, said power cinching function being initiated when said ratchet is rotated by the striker into one of its first and second striker capture positions and said pawl is located in its ratchet checking position such that rotation of said cinch gear from its cinch start position to its cinch stop position causes pivotal movement of said cinch lever and said cinch link lever which forcibly rotates said ratchet into its third striker capture position due to engagement of said of said first and second engagement members, and wherein said pawl is positioned in its ratchet checking position but is disengaged from said ratchet when said ratchet is rotated to and held in its third striker capture position.

2. The power latch assembly of claim 1 further including a latch release mechanism having a pawl lever and a release lever, said pawl lever engaging said pawl and being moveable between a first pawl lever position whereat said pawl is located in its ratchet checking position and a second pawl lever position whereat said pawl is located in its ratchet release position, said release lever being moveable between a non-actuated position and an actuated position for moving said pawl lever between its first and second pawl lever positions.

3. The power latch assembly of claim 2 wherein a power release function is provided by said electric motor rotating said cinch gear in a releasing direction from its cinch stop position toward its cinch start position when said ratchet is held in its third striker capture position by said latch cinch mechanism, and wherein said cinch gear includes a cam segment such that rotation of said cinch gear from its cinch stop position toward its cinch start position causes said cam segment to engage and move said release lever from its non-actuated position toward its actuated position for causing said pawl lever to move said pawl from its ratchet checking position toward its ratchet release position while said cinch link lever is concurrently moved to release said first engagement member from engagement with said second engagement member, whereby said ratchet is permitted to rotate to its striker release position.

4. The power latch assembly of claim 3 wherein said power releasing function is operable to rotate said ratchet from its third striker capture position into a fourth striker capture position while said first engagement member is maintained in engagement with said second engagement member for uncinching the striker to provide a soft opening feature prior to release of said ratchet to its striker release position.

5. The power latch of claim 1 further comprising:

a latch release mechanism having a pawl lever and a release lever, said pawl lever engaging said pawl and moveable between a first pawl lever position whereat said pawl is located in its ratchet checking position and a second pawl lever position whereat said pawl is located in its ratchet release position, said release lever being moveable between a non-actuated position and an actuated position; and a cinch disengage mechanism including a disengage lever having a first segment pivotably mounted on said cinch pivot pin and a second segment with a follower pin disposed in a guide slot formed in said cinch link lever.

6. The power latch assembly of claim 5 wherein said latch release mechanism further includes an inside backup lever, wherein said actuation mechanism further includes a pawl release lever supported for movement between a non-actuated position and an actuated position, and a second electric motor for moving said pawl release lever, wherein a power release function is provided by actuating said second electric motor for moving said pawl release lever to its actuated position which causes said pawl release lever to move said pawl lever to its second pawl lever position for moving said pawl to its ratchet release position, and wherein said power release function is further provided by causing said first electric motor to rotate said cinch gear from its cinch stop position toward its cinch start position which causes a cam segment on said cinch gear to engage and move said release lever from its non-actuated position toward its actuated position which causes said backup lever to move into engagement with said follower pin for forcibly driving said cinch link lever to a position causing disengagement of said first engagement member from said second engagement member, whereby said ratchet is permitted to rotate to its striker release position.

7. The power latch assembly of claim 6 wherein a gearset interconnects said second electric motor to said release lever, and wherein said release lever is normally biased by a release lever biasing member toward its non-actuated position.

8. The power latch assembly of claim 6 wherein said release lever includes a first drive arm segment engageable with said cam segment of said cinch gear and a second drive arm segment engaging said inside backup lever such that movement of said release lever from its non-actuated position to its actuated position causes corresponding movement of said inside backup lever from a first position whereat a cam edge portion thereof is disengaged from said follower pin and second position whereat said cam edge portion engages said follower pin and moves said cinch link lever to said position releasing said first engagement member from said second engagement member.

9. The power latch assembly of claim 6 further including an inside release mechanism interconnecting said inside backup lever to an inside door handle and which is operable to move said inside backup lever to its second position for causing said pawl lever to move said pawl to its ratchet release position and to move said cinch link lever to a position releasing said first engagement member from engagement with said second engagement member so as to release said ratchet for movement to its striker release position in response to actuation of the inside door handle.

10. The power latch assembly of claim 6 further including an outside release mechanism interconnecting said pawl lever to an outside door handle and which is operable to move said pawl lever to its second pawl lever position for moving said pawl to its ratchet release position and move said cinch link lever to a position releasing said first engagement member from engagement with said second engagement member so as to release said ratchet for movement to its striker release position in response to actuation of the outside door handle.

11. The power latch assembly of claim 5 wherein said pawl lever includes a pawl position sensor for detecting movement of said pawl, and wherein said cinch gear includes a first cinch position sensor detecting the location of said cinch gear in its cinch start position and a second cinch position sensor detecting the location of said cinch gear in its cinch stop position.

12. The power latch of claim 1 wherein said first engagement member is an engagement shoulder formed on an end segment of said cinch link lever, and wherein said second engagement member is a projection extending from said ratchet.

13. A power latch assembly, comprising:

a ratchet moveable between a striker release position whereat the ratchet is positioned to release a striker and three distinct striker capture positions whereat the ratchet is positioned to retain the striker, wherein the three distinct striker capture positions include a first striker capture position, a second striker capture position and a third striker capture position;

a ratchet biasing member for normally biasing the ratchet toward its striker release position;

a pawl moveable between a ratchet checking position whereat the pawl is positioned to hold the ratchet in one of its first and second striker capture positions and a ratchet release position whereat the pawl permits movement of the ratchet to its striker release position;

a pawl biasing member for normally biasing the pawl toward its ratchet checking position;

a latch release mechanism having a pawl lever, a release lever, and a backup lever, the pawl lever engaging the pawl and being moveable between a first pawl lever position whereat the pawl is located in its ratchet checking position and a second pawl lever position whereat the pawl is located in its ratchet release position, the release lever being selectably engageable with the backup lever and moveable between a non-actuated position whereat the backup lever is located in a first position and an actuated position whereat the backup lever is located in a second position;

a latch cinch mechanism having a cinch lever and a cinch link lever pivotably mounted to the cinch lever, wherein the cinch link lever includes a first engagement member configured to selectively engage a second engagement member on the ratchet when the ratchet is positioned in its first striker capture position; and an actuation mechanism having a power cinching actuator and a power release actuator, the power cinching actuator including a first electric motor, a cinch gear driven by the first electric motor and a cam flange fixed for rotation with said cinch gear, wherein the cam flange includes a drive slot and the cinch gear includes a cam segment, wherein a drive post extending from the cinch lever is disposed within the drive slot for coordinating pivotal movement of the cinch lever and the cinch link lever with rotation of the cinch gear and the cam flange, and wherein the power release actuator includes a second electric motor and a power release gear driven by the second electric motor for moving the pawl lever between its first and second pawl lever position.

14. The power latch assembly according to claim 13 further comprising a cinch disengage mechanism including a pivotable disengage lever having a follower pin disposed in a guide slot formed in the cinch link lever.

15. The power latch assembly according to claim 14 wherein the power cinching function is provided by causing the first electric motor to rotate the cinch gear in a cinching direction from a cinch start position to a cinch stop position, the power cinching function being initiated following the ratchet being rotated by the striker into one of its first and second striker capture positions while the pawl is located in its ratchet checking position, and wherein rotation of the cinch gear to its cinch stop position causes pivotal movement of the cinch lever and the cinch link lever which forcibly rotates the ratchet into its third striker position due to engagement of the first engagement member with the second engagement member while the pawl is maintained in its ratchet checking position but being disengaged from the ratchet.

16. The power latch assembly according to claim 14 wherein the power release function is provided by initially causing the first electric motor to rotate the power release gear in a releasing direction for pivoting the pawl lever of the latch release mechanism from its first pawl lever position into its second pawl lever position for moving the pawl from its ratchet checking position into its ratchet release position, wherein the first electric motor rotates the cinch gear in a releasing direction from its cinch stop position toward its cinch start position which causes the release lever to rotate from its non-actuated position into an actuated position which in turn forcibly pivots the inside backup lever from a first position to a second position, wherein such pivotal movement of the inside backup lever causes it to engage and move the cinch link lever which causes the first engagement member to disengage the second engagement member for permitting the ratchet to rotate from its ratchet position into its striker release position, and wherein concurrent rotation of the cinch gear acts on the cinch disengage mechanism to assist in moving the cinch link lever to a position releasing engagement between the first and second engagement members.

17. The power latch assembly according to claim 13 wherein the first engagement member is an engagement shoulder formed on the cinch link lever and the second engagement member is a lug extending from the ratchet.

18. The power latch assembly of claim 1 wherein said cinch lever has a first segment pivotably mounted on a cinch pivot pin and a second segment having a cinch link pivot pin, wherein said cinch link lever has a first end segment pivotably mounted on said cinch link pivot pin, and wherein said drive post extends from said cinch link pivot pin into said drive slot in said cam flange.

19. The power latch assembly of claim 18 wherein said cinch gear is mounted for rotation on said cinch pivot pin.

20. The power latch assembly of claim 13 wherein the cinch lever has a first segment pivotably mounted on a cinch pivot pin and a second segment having a cinch link pivot pin, wherein the cinch link lever has a first end segment pivotably mounted on the cinch link pivot pin, wherein the drive post extends from the cinch link pivot pin into the drive slot in the cam flange, and wherein the cinch gear is rotatably mounted on the cinch pivot pin.

* * * * *